US010905158B2

(12) United States Patent
Kang et al.

(10) Patent No.: US 10,905,158 B2
(45) Date of Patent: Feb. 2, 2021

(54) TWO WAY HUMIDITY CONTROL PACK

(71) Applicants: Jason Kang, Beverly Hills, CA (US); Daniel Chu, Beverly Hills, CA (US); Delia Aguilar, Beverly Hills, CA (US)

(72) Inventors: Jason Kang, Beverly Hills, CA (US); Daniel Chu, Beverly Hills, CA (US); Delia Aguilar, Beverly Hills, CA (US)

( * ) Notice: Subject to any disclaimer, the term of this patent is extended or adjusted under 35 U.S.C. 154(b) by 0 days.

(21) Appl. No.: 16/181,438

(22) Filed: Nov. 6, 2018

(65) Prior Publication Data

US 2019/0297942 A1 Oct. 3, 2019

Related U.S. Application Data

(63) Continuation-in-part of application No. 15/940,614, filed on Mar. 29, 2018.

(51) Int. Cl.

| | |
|---|---|
| ***A24F 25/02*** | (2006.01) |
| ***A24F 9/10*** | (2006.01) |
| ***A24C 1/34*** | (2006.01) |
| ***A24C 5/10*** | (2006.01) |
| ***C06F 5/00*** | (2006.01) |
| ***A24F 13/24*** | (2006.01) |
| ***A24F 29/00*** | (2006.01) |
| ***A24F 23/00*** | (2006.01) |
| ***A24C 1/04*** | (2006.01) |

(52) U.S. Cl.

CPC ..... *A24F 25/02* (2013.01); *A24C 1/04* (2013.01); *A24C 1/34* (2013.01); *A24C 5/10* (2013.01); *A24F 9/10* (2013.01); *A24F 13/24* (2013.01); *A24F 23/00* (2013.01); *A24F 29/00* (2013.01); *C06F 5/00* (2013.01)

(58) Field of Classification Search

None

See application file for complete search history.

(56) References Cited

U.S. PATENT DOCUMENTS

| | | | | |
|---|---|---|---|---|
| 908,065 | A * | 12/1908 | Berg | A24F 13/24 131/251 |
| 4,262,802 | A * | 4/1981 | Laauwe | A61J 1/03 206/540 |
| 2016/0290641 | A1* | 10/2016 | Nix | A24F 9/10 |
| 2016/0358244 | A1* | 12/2016 | Schmitz | G06Q 30/0635 |
| 2017/0332699 | A1* | 11/2017 | Kurthy | A24F 13/24 |

OTHER PUBLICATIONS

Cigar Asylum Cigar Forum, "Who Needs a Cutter when Ya Have a Toothpick??", Dec. 2008, <www.cigarasylum.com/vb/archive/index.php/t-5599.html> (Year: 2008).*

* cited by examiner

*Primary Examiner* — Michael H. Wilson
*Assistant Examiner* — Katherine A Will
(74) *Attorney, Agent, or Firm* — Edmond DeFrank

(57) ABSTRACT

The embodiments disclose an apparatus including a smoking material care kit, a matchstick and pick combination device for igniting smoking materials, a two-way humidity control pack device for controlling humidity of a smoking material stored in a smoking material protective container, and a protective container safety cap device coupled to the protective container to prevent access to smoking materials inside the protective container by children.

7 Claims, 42 Drawing Sheets

TWO WAY HUMIDITY CONTROL PACK

CROSS-REFERENCE TO RELATED APPLICATIONS

This patent application is a Continuation-In-Part and claims priority to United States patent application entitled: "BLUNT ROLLING METHOD AND DEVICES", U.S. Ser. No. 15/940,614 filed on Mar. 29, 2018, the U.S. patent application being incorporated herein by reference.

BACKGROUND

Cigarettes were originally sold with a bag of smoking materials and paper wrappers which the smoker would use to roll their own cigarettes. Subsequently, factory rolled cigarettes come on to the market. Cigars have generally have always been sold pre-rolled by hand. Cigar smokers have not had the opportunity to roll their own cigars to save money.

DETAILED DESCRIPTION OF THE INVENTION

In a following description, reference is made to the accompanying drawings, which form a part hereof, and in which is shown by way of illustration a specific example in which the invention may be practiced. It is to be understood that other embodiments may be utilized and structural changes may be made without departing from the scope of the embodiments.

General Overview:

It should be noted that the descriptions that follow, for example, in terms of blunt rolling method and devices, is described for illustrative purposes and the underlying system can apply to any number and multiple types of the smoking materials. In one embodiment of the present invention, the blunt rolling method and devices can be configured using pipe tobacco. In another embodiment, the blunt roller device and method can be used for medical and legalized cannabis products and the like. The blunt rolling method and devices can be configured to include the paper blunt wrappers and the smoking material leaf wrappers using the embodiments.

Figure 1:
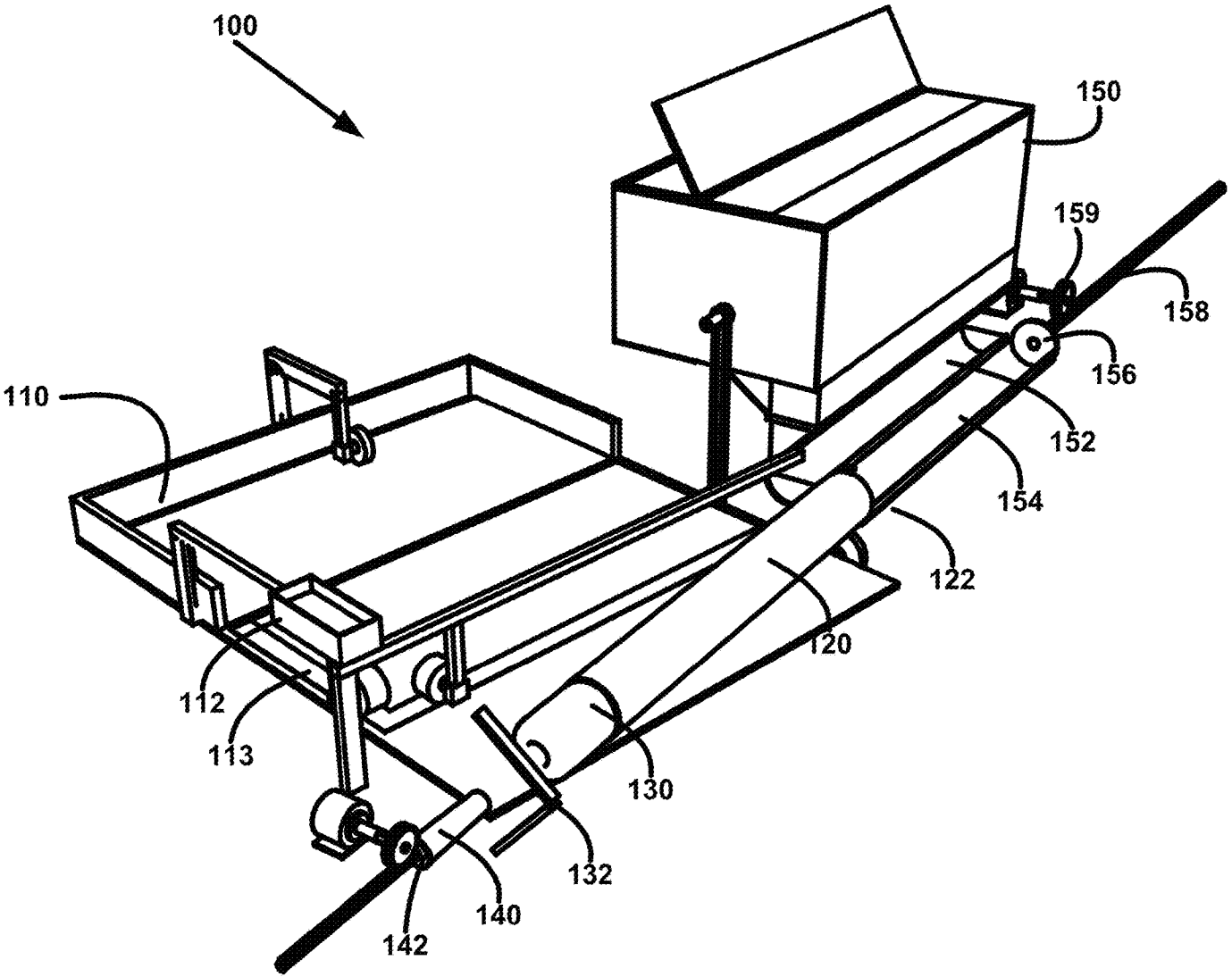
FIG. 1 shows for illustrative purposes only an example of the blunt rolling method and devices of one embodiment.

General Overview:

FIG. 1 shows for illustrative purposes only an example of the blunt rolling method and device of one embodiment. FIG. 1 shows the blunt rolling device 100. The twisted end cutter 640 is configured to include the wrapper supply tray 110. The blunt as herein described is a cigar shaped smoking product. The wrapper can be a precut piece of paper or a precut smoking material leaf. To hold the wrapper in place the wrapper adhesive supply 112 is used and can include a pectin liquid applied to the wrapper for example in the second applied wrapper adhesive strip 113. The wrapper roller tube 120 is used to roll the wrapper into a tube to hold the smoking material pushed inside the wrapper tube. The smoking material is held in a humidor supply dispenser 150 until processed into a smoking material dispensed tray 152 for delivery to a smoking material tamping supply tray 154. The tamping plate 156 coupled to the tamping rod 158 and extended and retracted using the tamper rod activator 159. The glass tip 130 is positioned at one end of the wrapper roller tube 120 wherein the glass tip 130 will be included in the rolled wrapper tube. The wrapper twist device 132 is used to create the twisted end of excess wrapper material at the tip end. The twisted end is tucked into the glass tip 130 and held in place using a crutch 140 inserted into the glass tip 130 using the crutch insertion plate 142 of one embodiment.

The processes described herein are controlled by a computer not shown that includes the blunt rolling method and device program that operates the solenoid motors used to operate a number of devices. Coupling of the computer and the blunt rolling method and device can be a digital wireless connection and can be a hard cabled connection. The user selects a blunt size using the program. The user pushes a start button and begins the operations and processes to roll a blunt. The sequencing of the processes can be automatically repeated wherein the user can select a quantity of blunts to be produced. The blunt rolling method and the device program using the sensors, humidity and temperature control devices in the humidor and not shown monitors the humidor conditions of humidity and temperature and can initiate regulation of the humidity and temperature to predetermined settings selected by the user. Other processes regulated by the blunt rolling method and the device program using digital processors and digital memory storage devices are the raising and lowering of the wrapper roller tube 120 wherein the digital memory storage devices is queried by the digital processors to access the predetermined distance for the vertical distance adjustments corresponding to the size of the blunt selected by the user. Additionally the user can select the tamping density desired. The digital processors access the predetermined tamping density data stored in the digital memory storage devices to adjust the settings on the travel distances of the tamping plate 156 coupled to the tamping rod 158 and operations of the tamper rod activator 159 of one embodiment.

Figure 2:
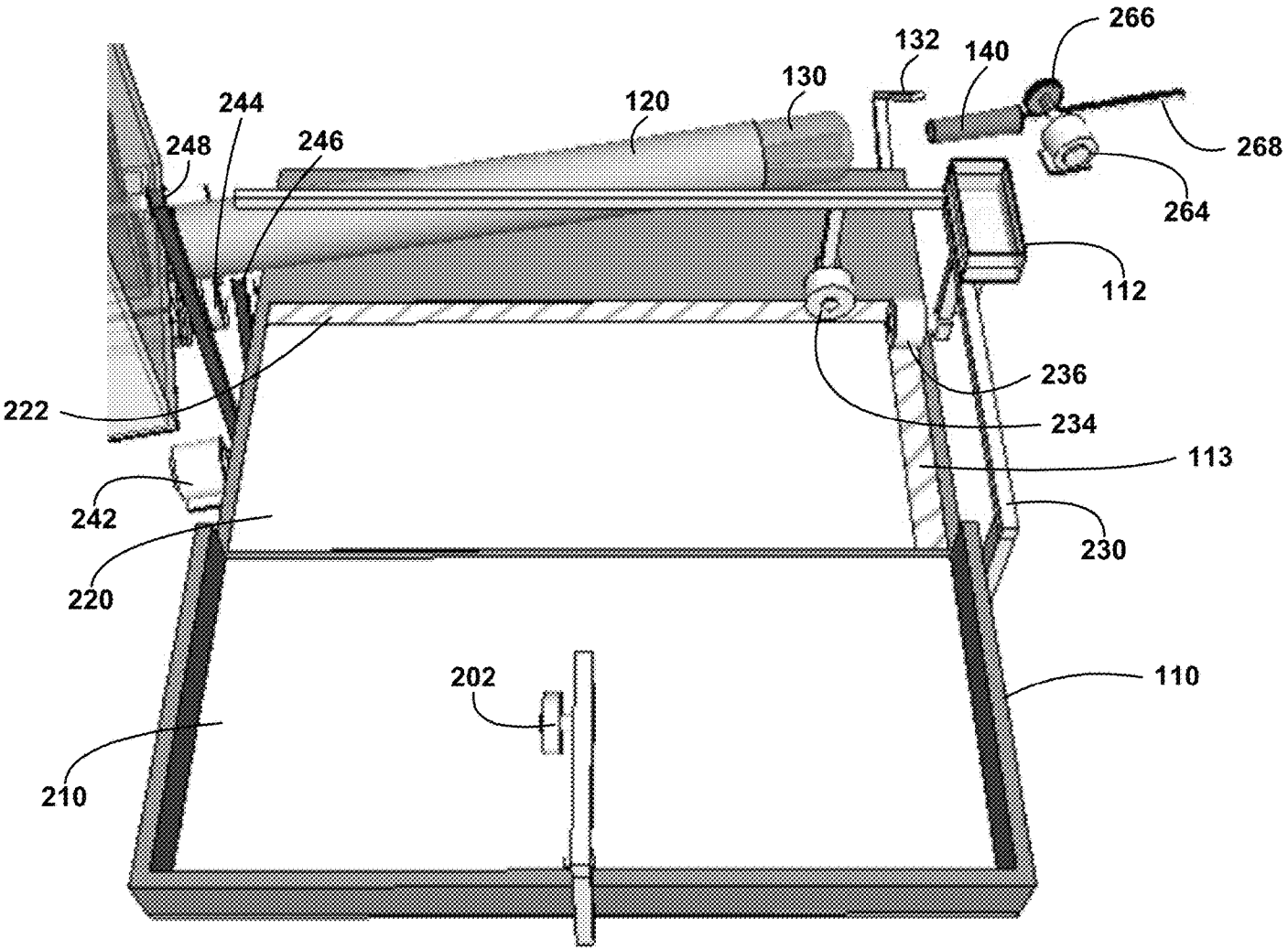
FIG. 2 shows for illustrative purposes only an example of the wrapper preparation device of one embodiment.

Detailed Description:

FIG. 2 shows for illustrative purposes only an example of the wrapper preparation device of one embodiment. FIG. 2 shows the wrapper supply tray 110 wherein the wrapper dispenser roller 202 positions the wrapper sheet 210 to a staging platform and also showing is the staged wrapper sheet 220. The wrapper adhesive supply 112 supplies the adhesive include a pectin liquid to the first adhesive application roller 234 which rolls the adhesive and applies a first applied adhesive strip 222. The second adhesive application roller 236 applies the adhesive to the second applied wrapper adhesive strip 113. The wrapper roller tube 120 is lowered along with the glass tip 130 to contact an angled section of the first applied adhesive strip 222 of the staged wrapper sheet 220. Also showing, is the wrapper twist device 132 and crutch 140. The wrapper roller tube drive motor 242 coupled to the wrapper roller tube drive wheel 244 with the wrapper roller tube drive belt and pulley 246 for rolling the staged wrapper sheet 220 around the wrapper roller tube 120. The wrapper roller tube drive motor 242 also operates the humidor dispenser drive belt and pulley 248 for dispensing the smoking materials from the humidor for tamping the smoking material into the rolled wrapper. A tuck and crutch drive motor 264 is used to extend and retract a tuck and crutch drive rod 268 using a tuck and crutch drive gear 266 of one embodiment.

Figure 3A:
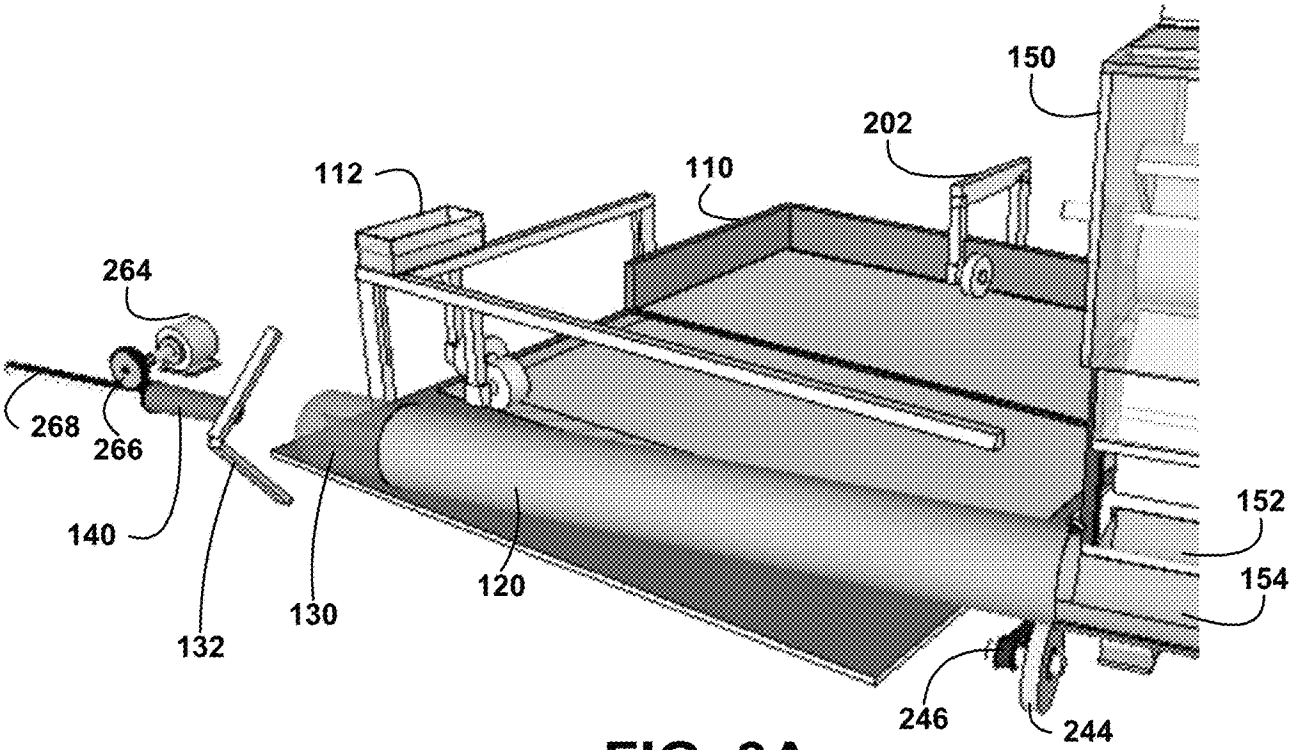
FIG. 3A shows for illustrative purposes only an example of the wrapper rolling device of one embodiment.

Wrapper Rolling Device:

FIG. 3A shows for illustrative purposes only an example of the wrapper rolling device of one embodiment. FIG. 3A shows the wrapper supply tray 110, the wrapper adhesive supply 112, the wrapper roller tube 120, the humidor supply dispenser 150, the smoking material dispensed tray 152, the smoking material tamping supply tray 154, the glass tip 130, the wrapper twist device 132, the crutch 140, the wrapper dispenser roller 202, the tuck and crutch drive motor 264, the tuck and crutch drive rod 268, the tuck and crutch drive gear 266, the wrapper roller tube drive wheel 244, the wrapper roller tube drive belt and pulley 246, the wrapper roller tube drive motor 242, the smoking material tamping supply tray 154 and the smoking material pre-tamp load 317. FIG. 3A shows these wrapper rolling device elements from a different prospective position for clarity of the respective positions of one embodiment.

Figure 3B:
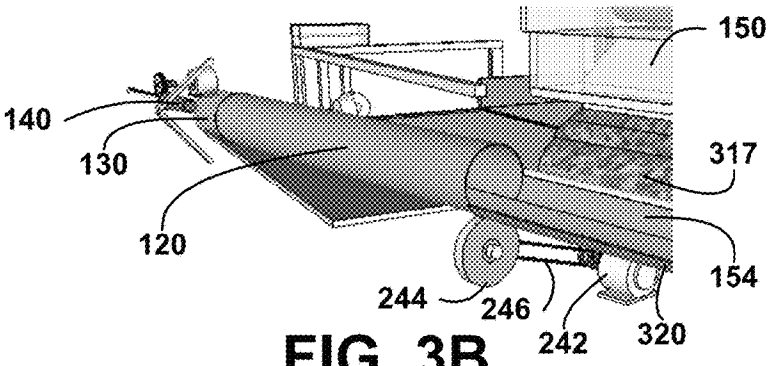
FIG. 3B shows for illustrative purposes only an example of the wrapper roller of one embodiment.

Wrapper Roller:

FIG. 3B shows for illustrative purposes only an example of the wrapper roller of one embodiment. FIG. 3B shows the humidor supply dispenser 150, the wrapper roller tube 120, the smoking material tamping supply tray 154, the glass tip 130, the crutch 140, wrapper twist device 132, the wrapper roller tube drive wheel 244, the wrapper roller tube drive belt and pulley 246, the wrapper roller tube drive motor 242 and the smoking material pre-tamp loader 317. Also showing is the roller and tray slide channel 320. The roller and tray slide channel 320 is a guide for the extending and retracting of the wrapper roller tube 120 and the smoking material tamping supply tray 154. The smoking material pre-tamp loader 317 is rotated to deposit the smoking material into the smoking material tamping supply tray 154 in preparation for tamping into the rolled wrapper of one embodiment.

Figure 4:
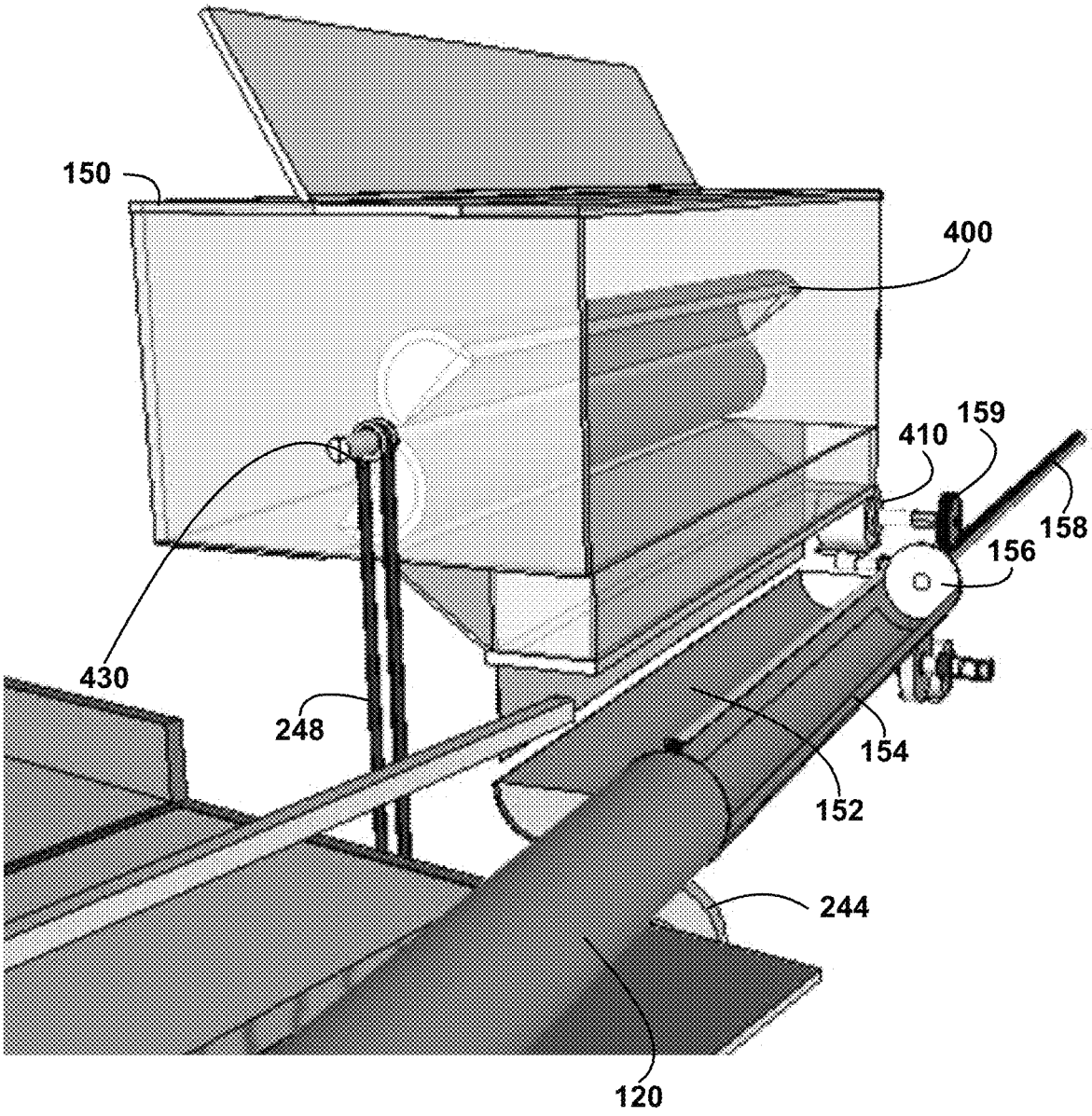
FIG. 4 shows for illustrative purposes only an example of the humidor dispenser of one embodiment.

Humidor Dispenser:

FIG. 4 shows for illustrative purposes only an example of the humidor dispenser of one embodiment. FIG. 4 shows wrapper roller tube 120, smoking material tamping supply tray 154, tamping plate 156, tamping rod 158, and tamper rod activator 159. The humidor supply dispenser 150 includes the humidor dispenser drive belt and pulley 248 used to rotate a smoking material scoop axle 430 to rotate a smoking material scoop 400 to scoop smoking material for dispensing to the smoking material dispensed tray 152. The tamping plate 156, tamping rod 158, and tamper rod activator 159 are operated by a tamping rod drive motor 410. Also showing is the wrapper roller tube drive wheel 244 used to rotate the wrapper roller tube 120 of one embodiment.

Figure 5:
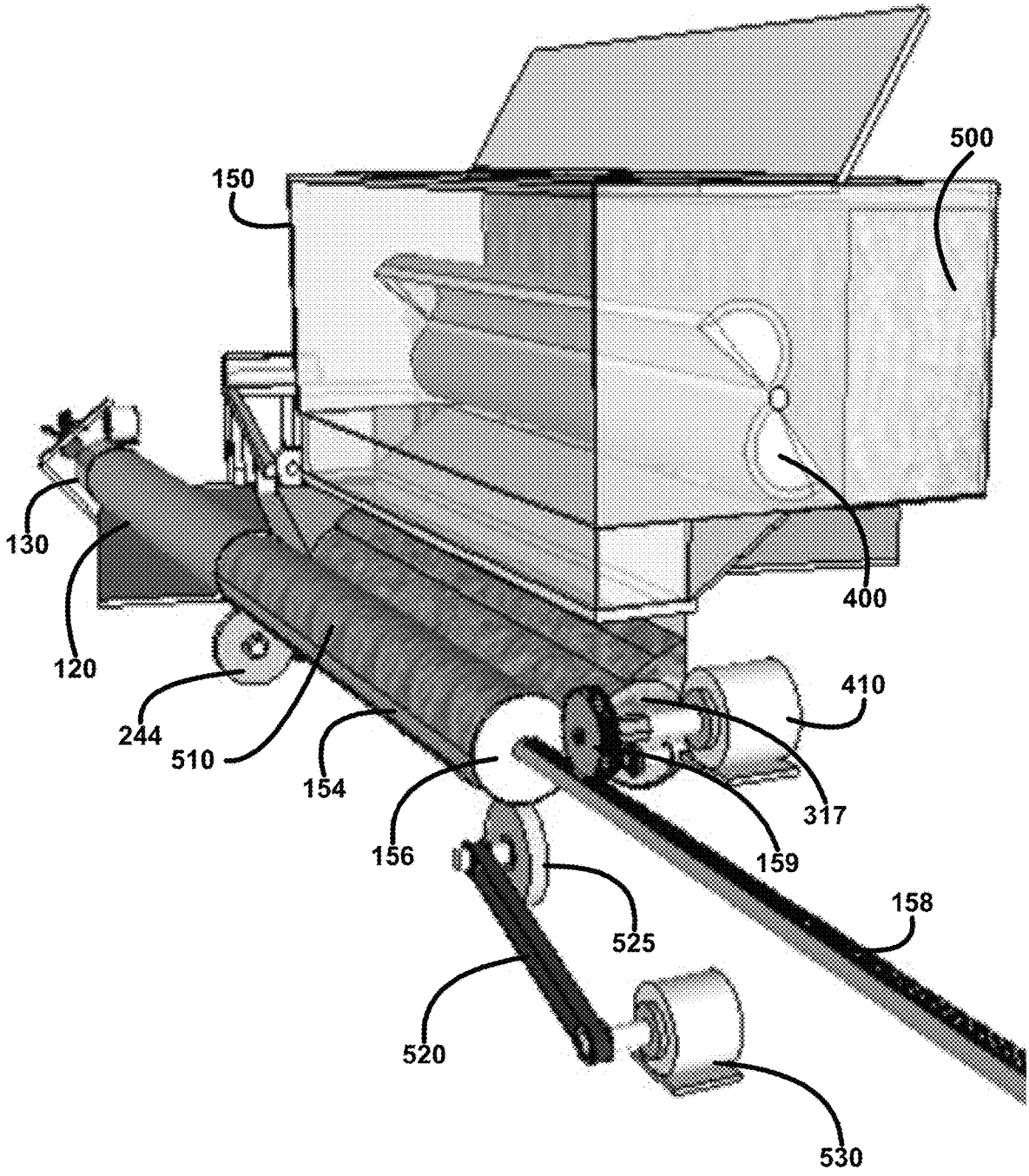
FIG. 5 shows for illustrative purposes only an example of the smoking material tamping device of one embodiment.

Smoking Material Tamping Device:

FIG. 5 shows for illustrative purposes only an example of the smoking material tamping device of one embodiment. FIG. 5 shows the wrapper roller tube 120, the glass tip 130, and the humidor supply dispenser 150 filled with the smoking material supply 500 that is dispensed using the smoking material scoop 400 to form a smoking material pre-tamp load 317. Also showing are the wrapper roller tube drive wheel 244, the smoking material tamping supply tray 154, the tamping plate 156, the tamping rod 158, the tamper rod activator 159 and the tamping rod drive motor 410. The tamping rod 158 is extended towards the rolled wrapper and retracted using the tamping rod drive motor 410. When the full amount of the smoking material has been tamped into the rolled wrapper the wrapper roller tube 120 and smoking material tamping supply tray 154 are retracted using the roller and tray slide drive wheel 525 operated using the roller and the tray slide drive wheel belt and pulley 520 coupled to a roller and tray slide drive wheel motor 530 of one embodiment.

Figure 6A:
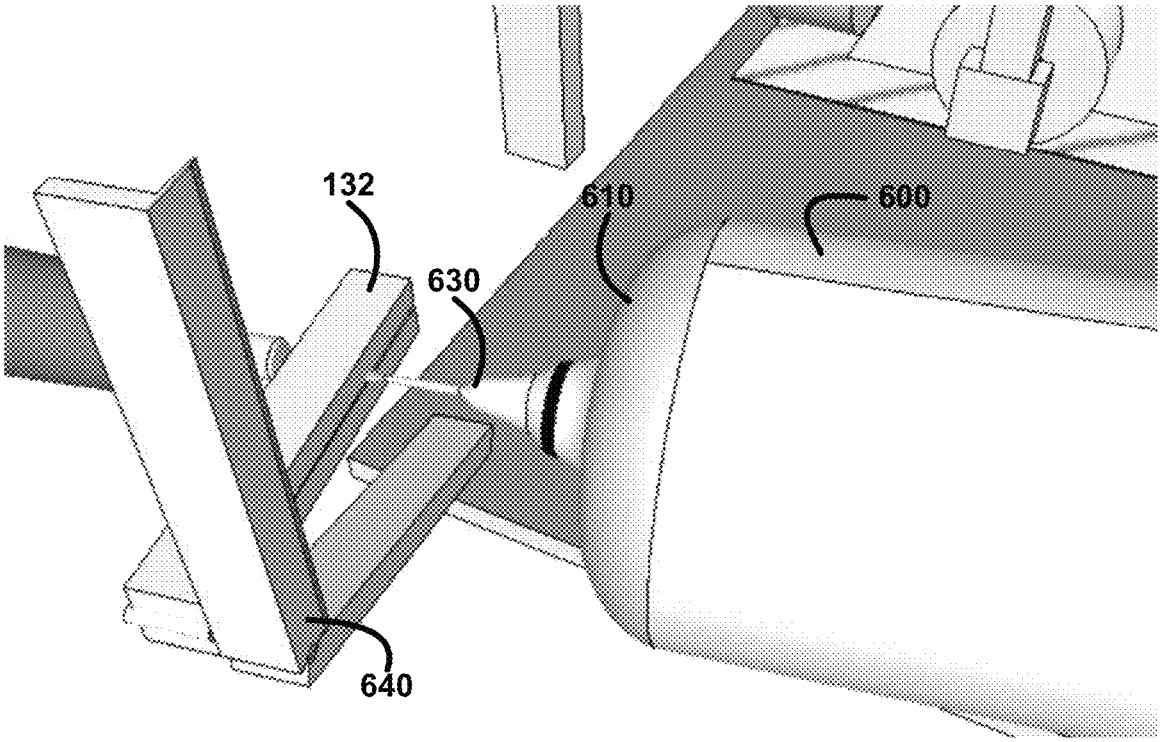
FIG. 6A shows for illustrative purposes only an example of wrapper twist device of one embodiment.

Wrapper Twist Device:

FIG. 6A shows for illustrative purposes only an example of the wrapper twist device of one embodiment. FIG. 6A shows the rolled wrapper 600 and the rolled wrapper tip end 610. The wrapper twist device 132 clamps down on the excess wrapper material at the tip end. The wrapper roller tube 120 of FIG. 1 is rolled to create the rolled wrapper twisted end 630. A twisted end cutter 640 is in the position for cutting a portion of the rolled wrapper twisted end 630 as described in FIG. 6B of one embodiment.

Figure 6B:
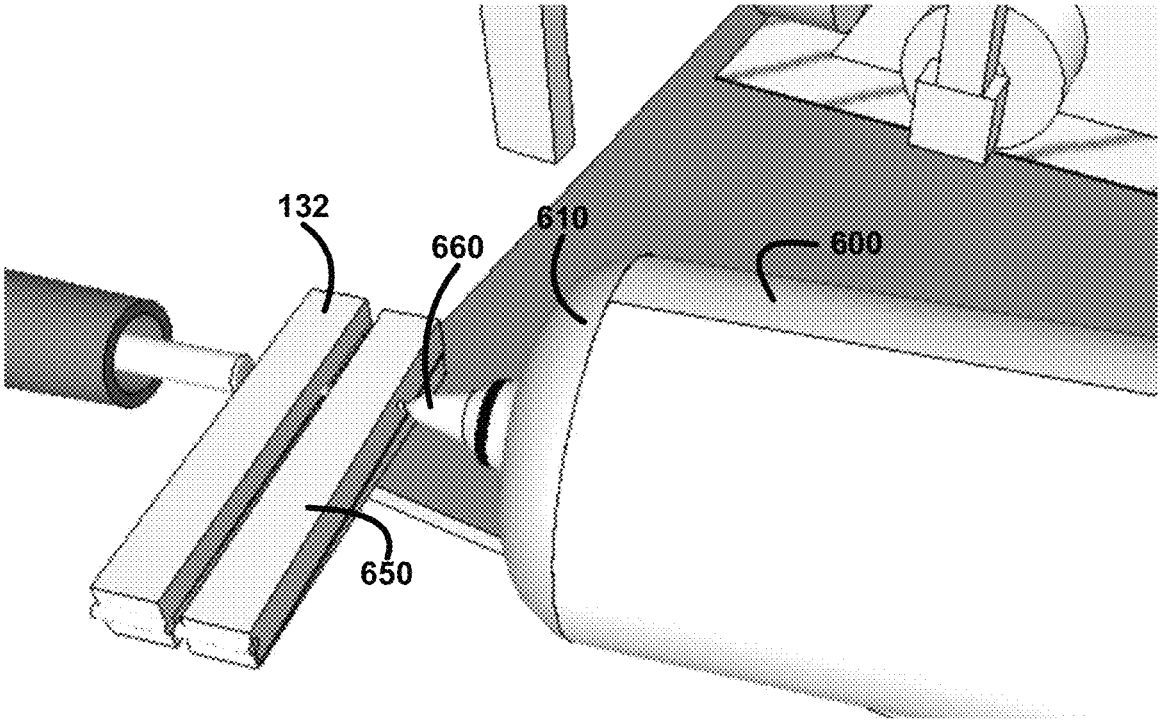
FIG. 6B shows for illustrative purposes only an example of the wrapper trimmer device of one embodiment.

Wrapper Trimmer Device:

FIG. 6B shows for illustrative purposes only an example of the wrapper trimmer device of one embodiment. FIG. 6B shows a continuation of the process from FIG. 6A. Showing is the rolled wrapper 600, rolled wrapper tip end 610 and the wrapper twist device 132. The closed twisted end cutter 650 is shown wherein closing the blades of the twisted end cutter 640 of FIG. 6A are used to cut the wrapper twisted end 660 to a predetermined length of one embodiment.

Figure 7A:
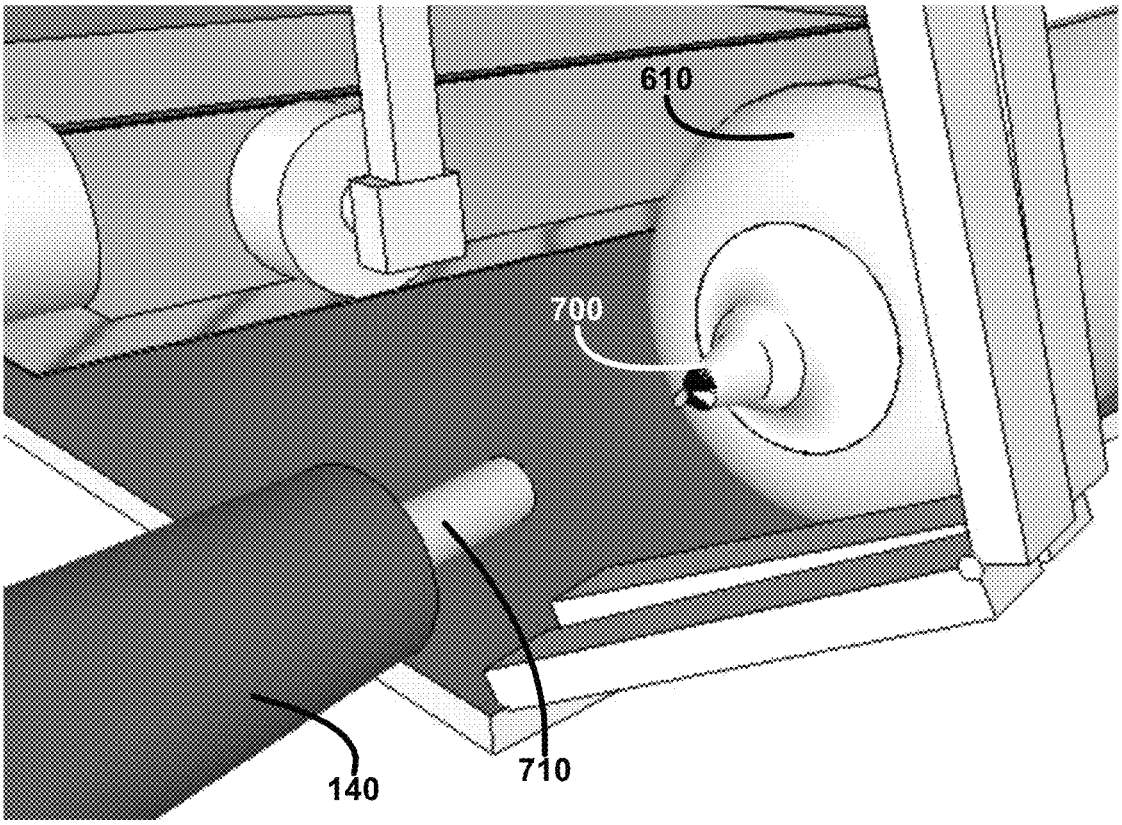
FIG. 7A shows for illustrative purposes only an example of the wrapper tuck device of one embodiment.

Wrapper Tuck Device:

FIG. 7A shows for illustrative purposes only an example of the wrapper tuck device of one embodiment. FIG. 7A shows the rolled wrapper tip end 610 and a twisted wrapper cut stub 700. A tuck rod 710 includes a crutch 140 positioned on the tuck rod 710 for insertion into the tip of one embodiment.

Figure 7B:
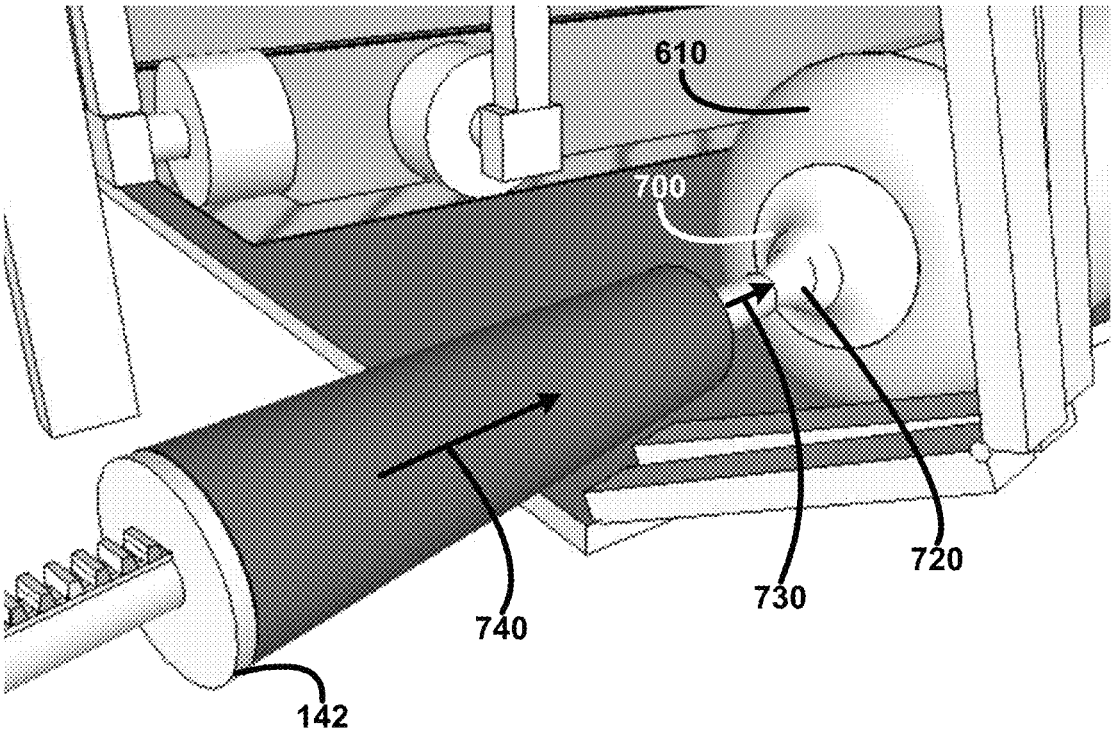
FIG. 7B shows for illustrative purposes only an example of the wrapper tuck process of one embodiment.

Wrapper Tuck Process:

FIG. 7B shows for illustrative purposes only an example of the wrapper tuck process of one embodiment. FIG. 7B shows a continuation of the process from FIG. 7A. The rolled wrapper tip end 610 includes the twisted wrapper cut stub 700. The crutch insertion plate 142 is extended towards the tip wherein the tuck rod is pushed into the tip and tucks the cut wrapper excess into the tip 730. The crutch insertion plate 142 pushes the crutch into the tip to hold the tucked wrapper excess inside the tip 740. After the insertion of crutch the cut wrapper excess 720 is secured flush against the tip of one embodiment.

Figure 8:
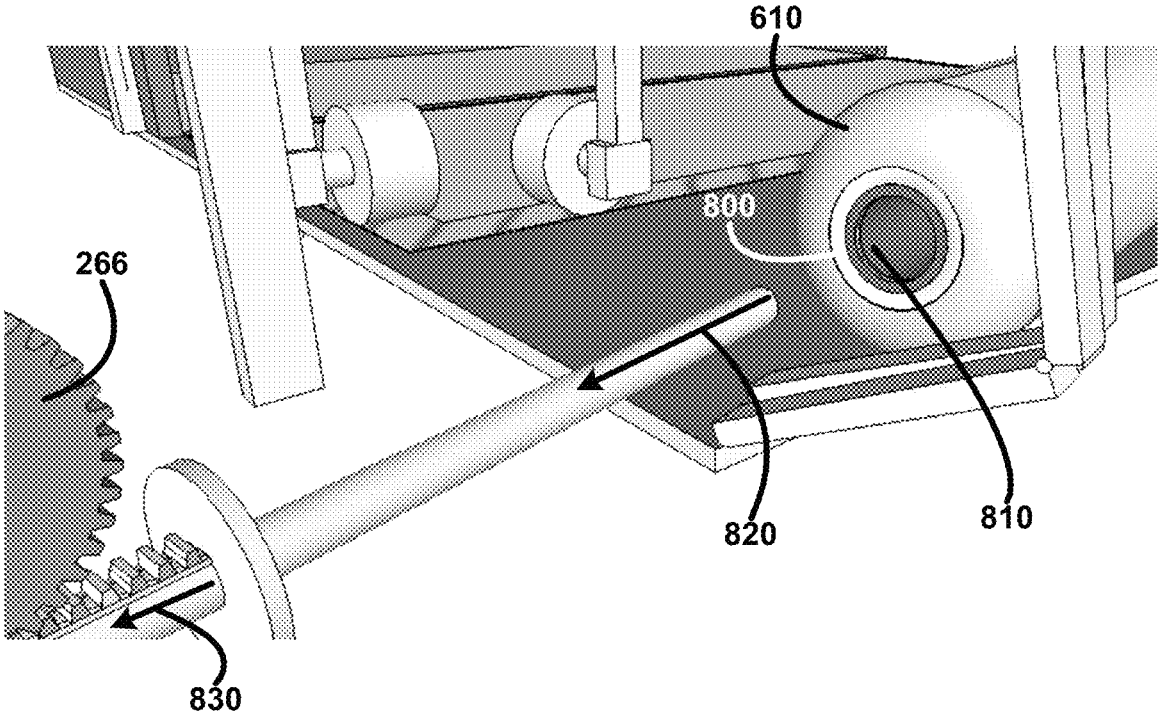
FIG. 8 shows for illustrative purposes only an example of the crutch insertion process of one embodiment.

Crutch Insertion Process:

FIG. 8 shows for illustrative purposes only an example of the crutch insertion process of one embodiment. FIG. 8 shows the rolled wrapper tip end 610 and the tucked cut wrapper excess 800 in the tip. An inserted crutch 810 has been pushed into the tip to secure the tucked cut wrapper excess 800 in the tip. The tuck and crutch drive gear 266 is rotated in reverse for retracting the tuck and crutch drive rod 830 and for retracting the tuck rod 820 of one embodiment.

Figure 9:
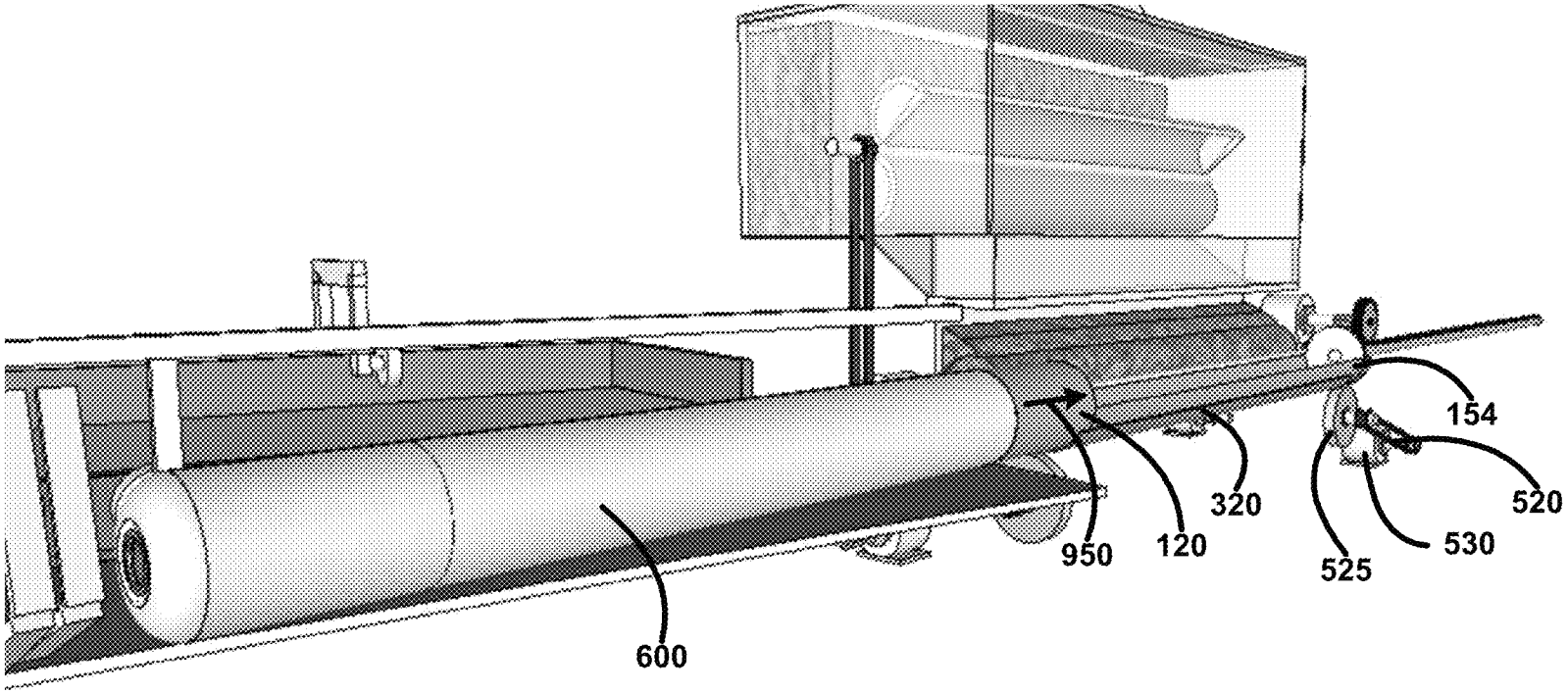
FIG. 9 shows for illustrative purposes only an example of the first wrapper roller withdrawal process of one embodiment.

First Wrapper Roller Withdrawal Process:

FIG. 9 shows for illustrative purposes only an example of the first wrapper roller withdrawal process of one embodiment. FIG. 9 shows the rolled wrapper 600, the wrapper roller tube 120, the smoking material tamping supply tray 154, the roller and tray slide drive wheel 525, the roller and tray slide drive wheel belt and pulley 520, the roller and tray slide drive wheel motor 530 and the roller and tray slide channel 320. A process begins wherein the wrapper roller tube pulled out of rolled wrapper 950 to prepare for a final tamping of the smoking material of one embodiment.

Figure 10:
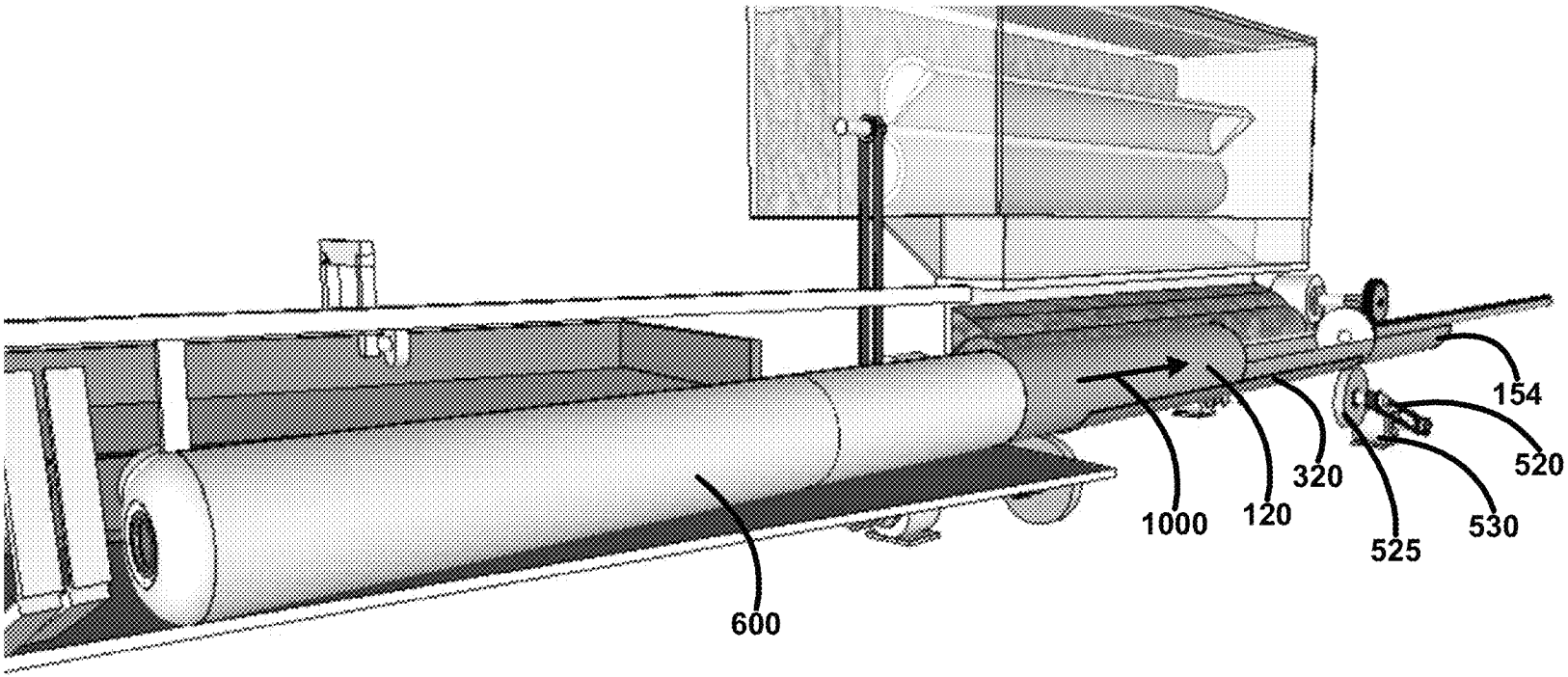
FIG. 10 shows for illustrative purposes only an example of the second wrapper roller withdrawal process of one embodiment.

Second Wrapper Roller Withdrawal Process:

FIG. 10 shows for illustrative purposes only an example of the second wrapper roller withdrawal process of one embodiment. FIG. 10 shows the rolled wrapper 600, the wrapper roller tube 120, the smoking material tamping supply tray 154, the roller and tray slide drive wheel 525, the roller and tray slide drive wheel belt and pulley 520, the roller and tray slide drive wheel motor 530 and roller and the tray slide channel 320. The wrapper roller tube pulled out of the rolled wrapper sliding on the roller and tray slide channel 1000 of one embodiment.

Figure 11:
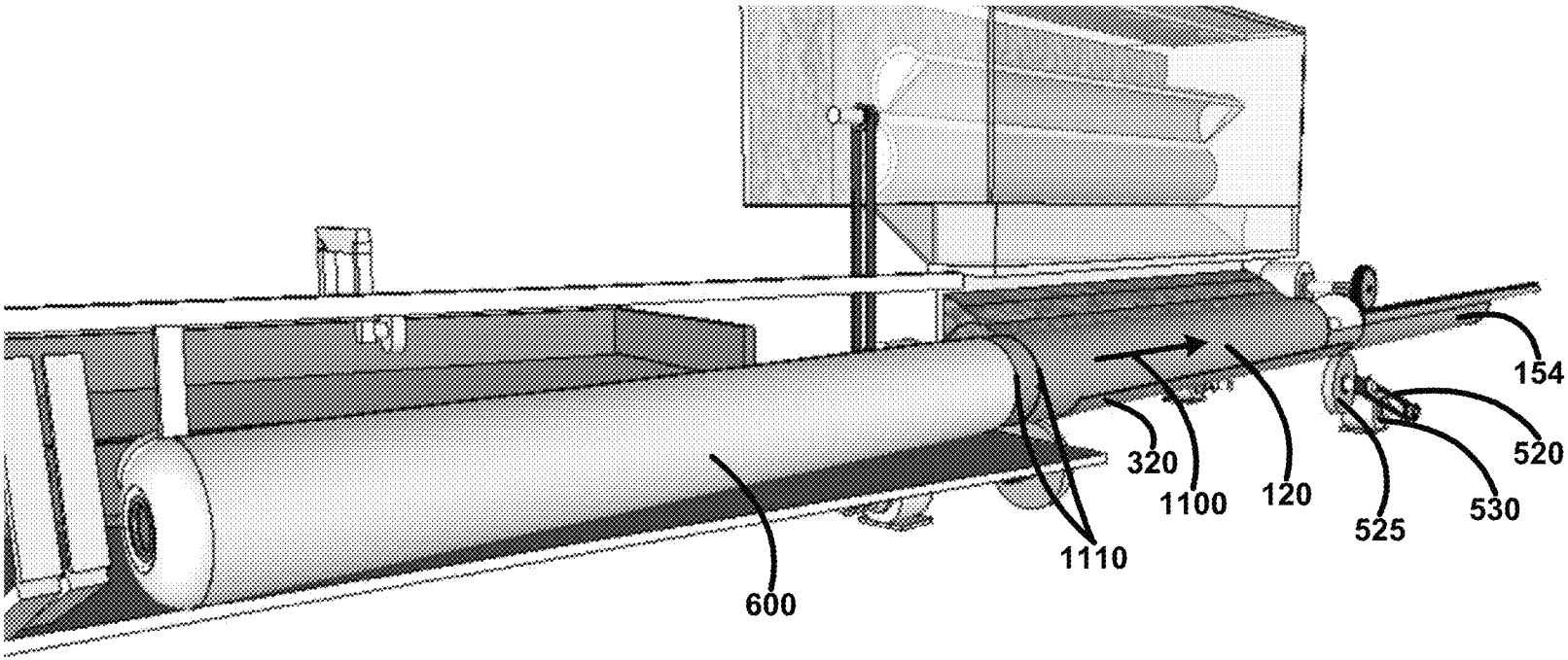
FIG. 11 shows for illustrative purposes only an example of the final roller withdrawal process of one embodiment.

Final Roller Withdrawal Process:

FIG. 11 shows for illustrative purposes only an example of the final roller withdrawal process of one embodiment. FIG. 11 shows the rolled wrapper 600, the wrapper roller tube 120, the smoking material tamping supply tray 154, the roller and tray slide drive wheel 525, the roller and tray slide drive wheel belt and pulley 520, the roller and tray slide drive wheel motor 530 and the roller and tray slide channel 320. The wrapper roller tube pulled completely out of the rolled wrapper 1100 is shown positioned to a predetermined gap opening of the wrapper roller tube and blunt 1110 of one embodiment.

Figure 12:
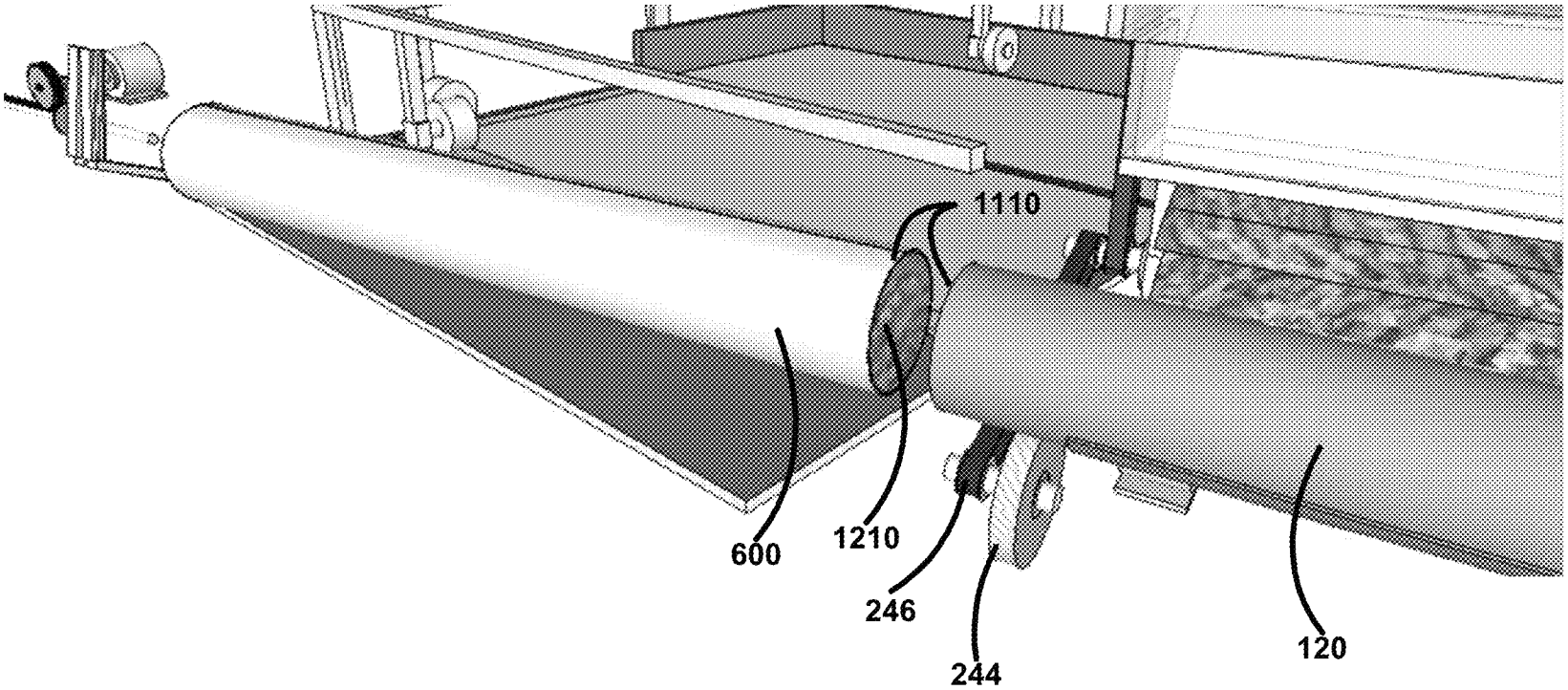
FIG. 12 shows for illustrative purposes only an example of the smoking material tamped of one embodiment.

Smoking Material Tamped:

FIG. 12 shows for illustrative purposes only an example of the smoking material tamped of one embodiment. FIG. 12 shows the rolled wrapper 600, the wrapper roller tube 120, the wrapper roller tube drive wheel 244, the wrapper roller tube drive belt and pulley 246 and predetermined gap opening of the wrapper roller tube and blunt 1110. A packed tamped smoking material 1210 is shown at the end of the blunt opposite the tip end of one embodiment.

Figure 13:
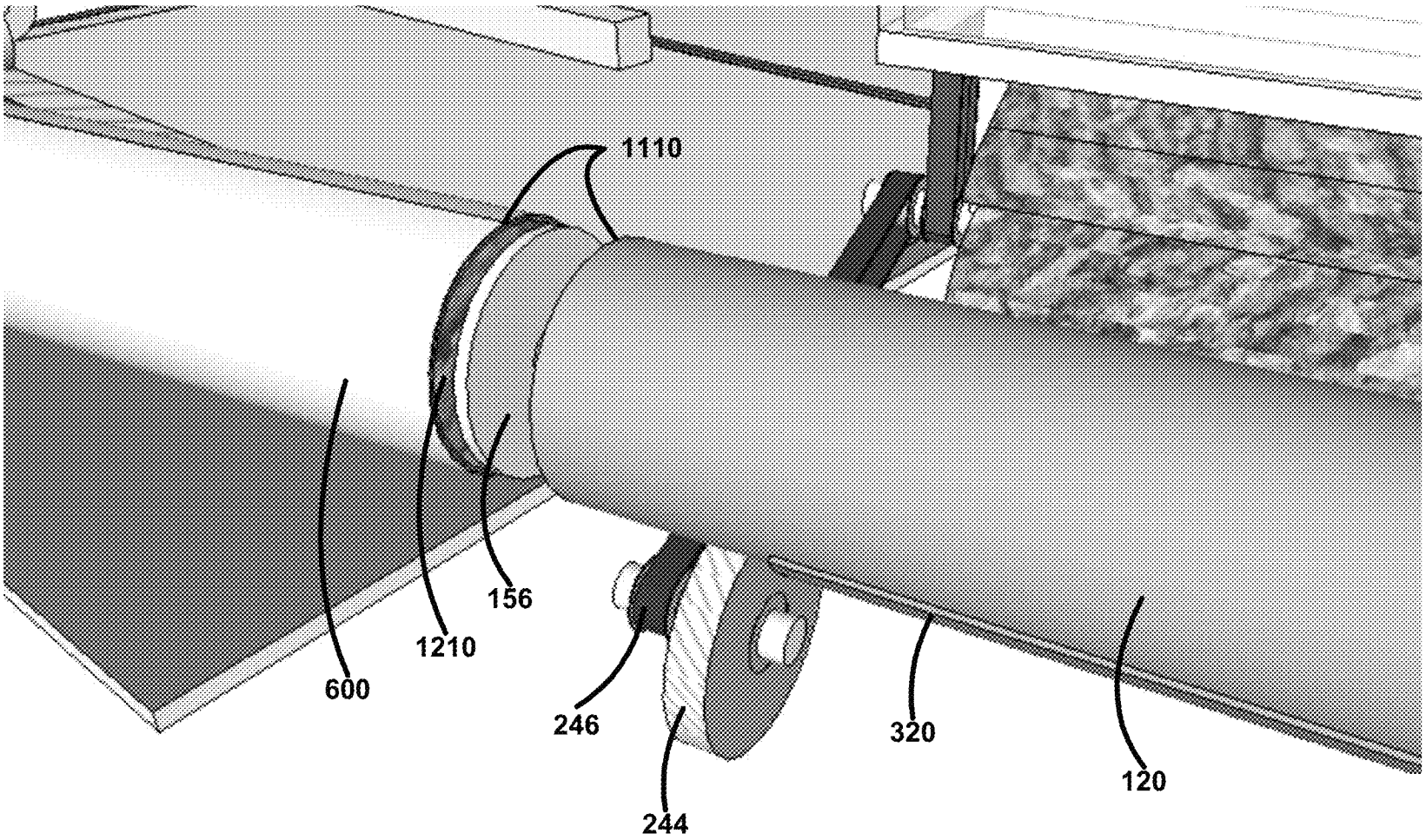
FIG. 13 shows for illustrative purposes only an example of final smoking material tamping process of one embodiment.

Final Smoking Material Tamping Process:

FIG. 13 shows for illustrative purposes only an example of the final smoking material tamping process of one embodiment. FIG. 13 shows the rolled wrapper 600, wrapper roller tube 120, the wrapper roller tube drive wheel 244, the wrapper roller tube drive belt and pulley 246, the predetermined gap opening of the wrapper roller tube and blunt 1110, the packed tamped smoking material 1210 and the tamping plate 156. The tamping plate 156 is positioned against the packed tamped smoking material 1210 to perform the final tamping process to press the smoking materials firmly against the rolled wrapper of one embodiment.

Figure 14A:
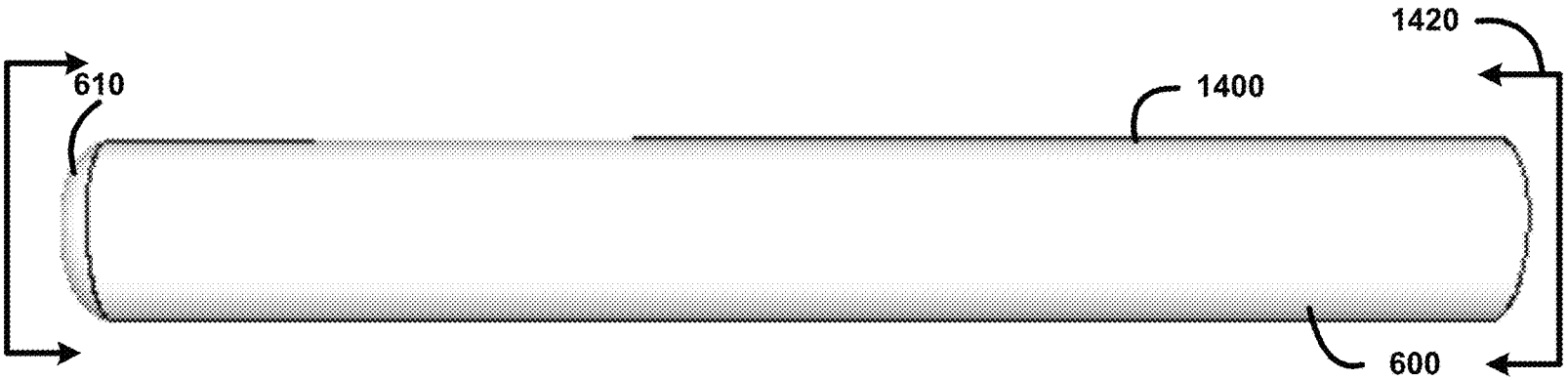
FIG. 14A shows for illustrative purposes only an example of the blunt section lines of one embodiment.

Blunt Section Lines:

FIG. 14A shows for illustrative purposes only an example of the blunt section lines of one embodiment. FIG. 14A shows the rolled wrapper 600, the rolled wrapper tip end 610, the complete blunt 1400 and section cut lines 1420 of one embodiment.

Figure 14B:
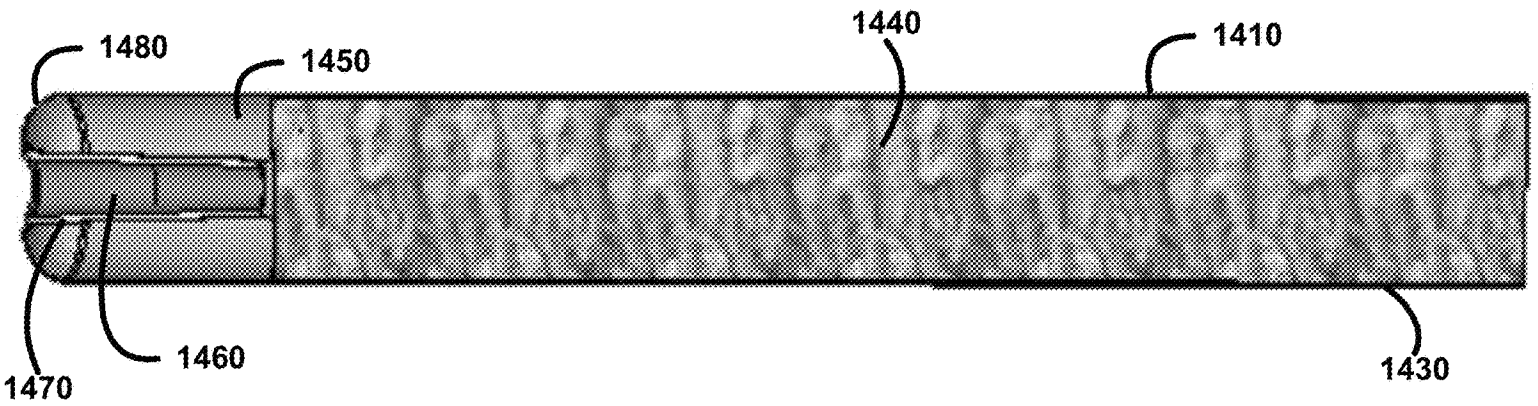
FIG. 14B shows for illustrative purposes only an example of the blunt cross section of one embodiment.

Blunt Cross Section:

FIG. 14B shows for illustrative purposes only an example of the blunt cross section of one embodiment. FIG. 14B shows the complete blunt section view 1410 showing the rolled wrapper layer 1430, the final packed tamped smoking material 1440, the rolled wrapper tip end layer 1480, the tip cross section 1450, the crutch cross section 1460 and the tucked cut wrapper excess layer 1470 of one embodiment.

Figure 15:
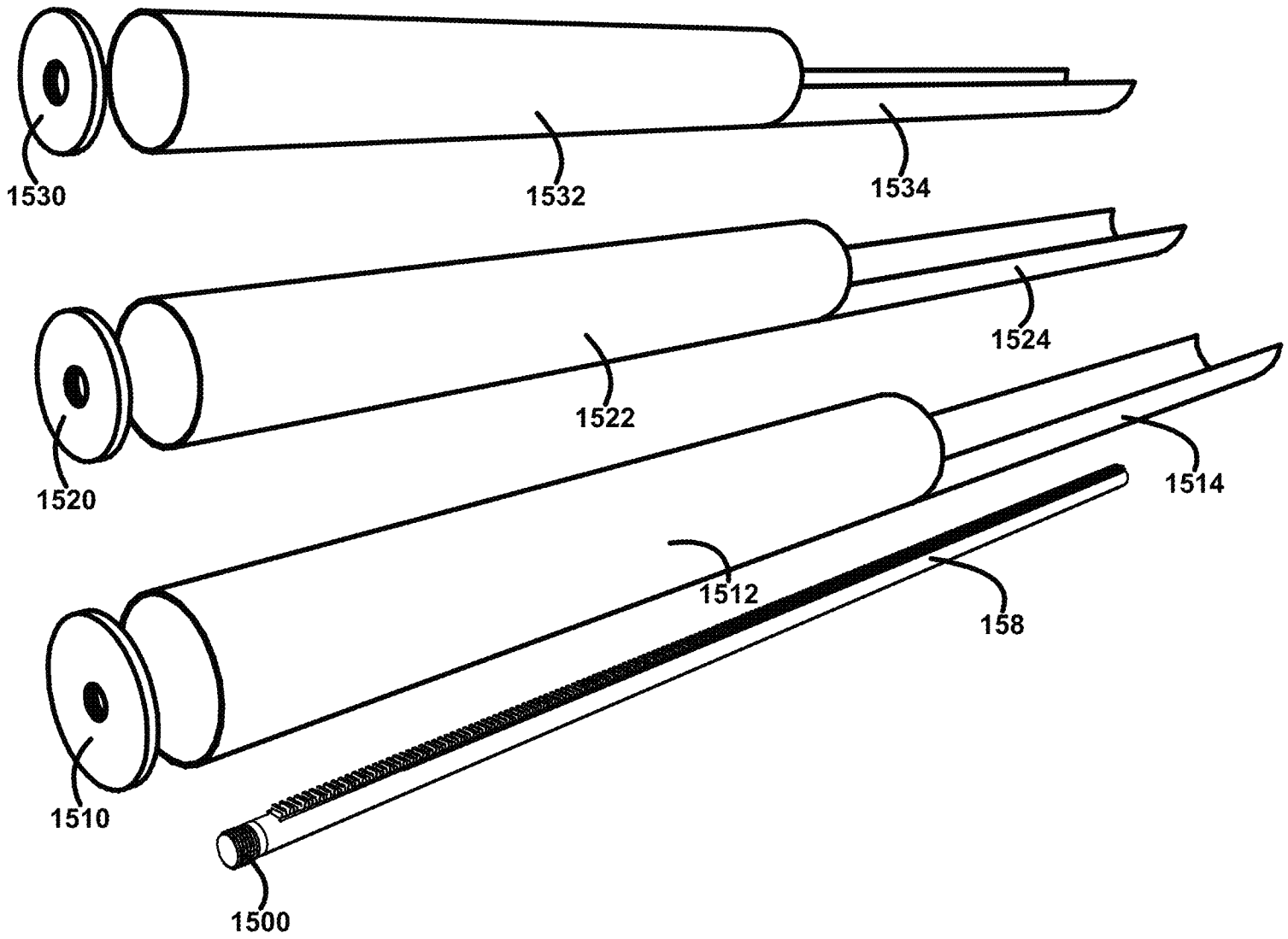
FIG. 15 shows for illustrative purposes only an example of the blunt roller and tamper sizes of one embodiment.

Blunt Roller and Tamper Sizes:

FIG. 15 shows for illustrative purposes only an example of blunt roller and tamper sizes of one embodiment. FIG. 15 shows the tamping rod 158 with a threaded rod end 1500. The threaded rod end 1500 screws into the threaded hole in the center of a tamping plate. Also showing is a matched set of the 13 mm tamping plate 1510, the 13 mm wrapper roller tube 1512 and the 13 mm smoking material tamping supply tray 1514. A matching set of 12 mm tamping plate 1520, 12 mm wrapper roller tube 1522 and a 12 mm smoking material tamping supply tray 1524 is shown. FIG. 15 shows a matched set of a 10 mm tamping plate 1530, 10 mm wrapper roller tube 1532 and a 10 mm smoking material tamping supply tray 1534. The mm dimension is the outer diameter of the tamping plate, inside diameter of the wrapper roller tube and smoking material tamping supply tray of one embodiment.

Figure 16B:
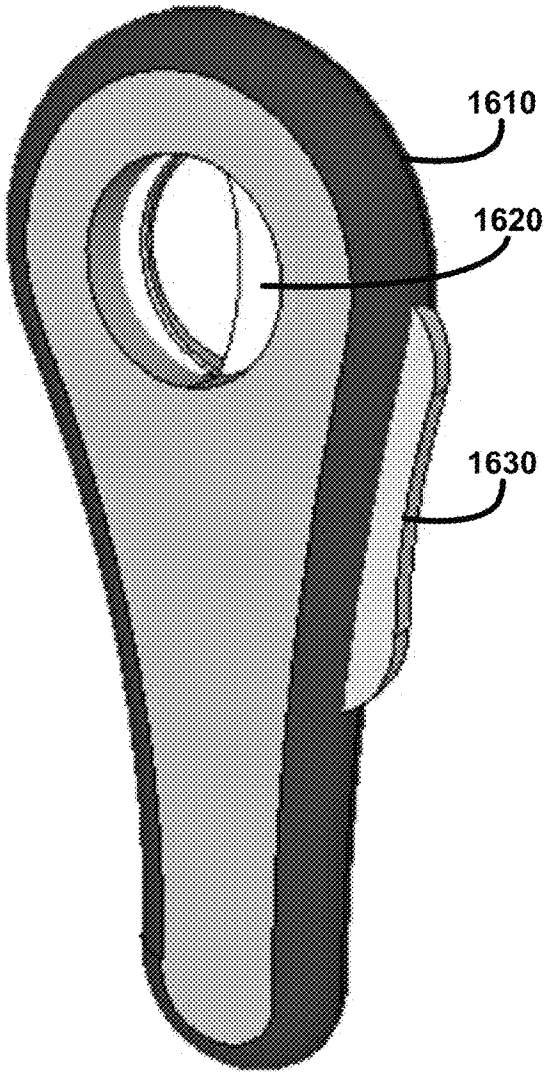
FIG. 16B shows for illustrative purposes only an example of the wrapper cutter device of one embodiment.
Figure 16A:
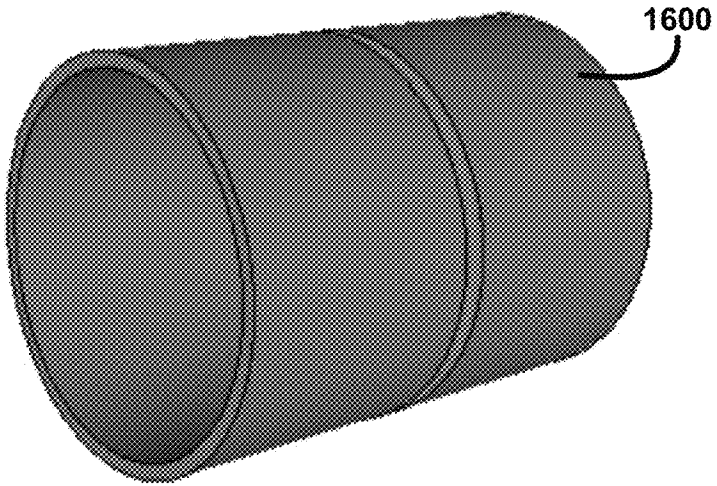
FIG. 16A shows for illustrative purposes only an example of the blunt tip cutter device of one embodiment.

Blunt Tip Cutter Device:

FIG. 16A shows for illustrative purposes only an example of the blunt tip cutter device of one embodiment. FIG. 16A shows a cap cutter 1600 of one embodiment.

Wrapper Cutter Device:

FIG. 16B shows for illustrative purposes only an example of the wrapper cutter device of one embodiment. FIG. 16B shows the tobacco leaf cutter 1610 used for cutting tobacco leaves into wrapper dimensions. The tobacco leaf cutter 1610 is configured to include the cutter blade lever 1630 and at least one cutter blade 1620 of one embodiment.

Figure 17A:
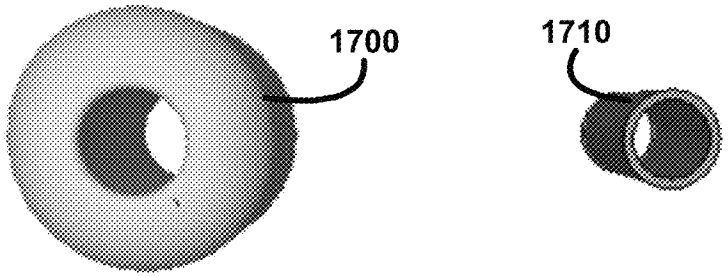
FIG. 17A shows for illustrative purposes only an example of the 13 mm non-tapered tip and non-tapered crutch device end view of one embodiment.

13 mm Tip and Non-Tapered Crutch Device End View:

FIG. 17A shows for illustrative purposes only an example of the 13 mm non-tapered tip and non-tapered crutch device end view of one embodiment. FIG. 17A shows the 13 mm non-tapered tip end view 1700 and the 13 mm non-tapered crutch end view 1710, wherein the outside diameter of the tip is 13 mm. The crutch dimensions of each crutch shown in FIG. 17A to FIG. 18D match the inside dimensions of the center hole of its corresponding tip of one embodiment.

Figure 17B:
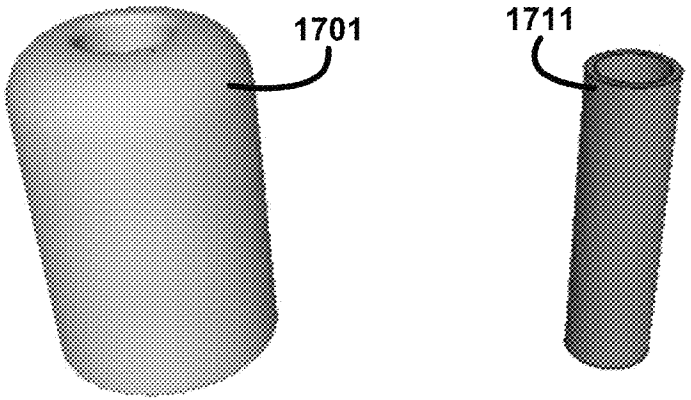
FIG. 17B shows for illustrative purposes only an example of the 13 mm non-tapered tip and non-tapered crutch device side view of one embodiment.

13 mm Tip and Non-Tapered Crutch Device Side View:

FIG. 17B shows for illustrative purposes only an example of 13 mm non-tapered tip and non-tapered crutch device side view of one embodiment. FIG. 17B shows a 13 mm non-tapered tip side view 1701 and a 13 mm non-tapered crutch side view 1711 of one embodiment.

Figure 17C:
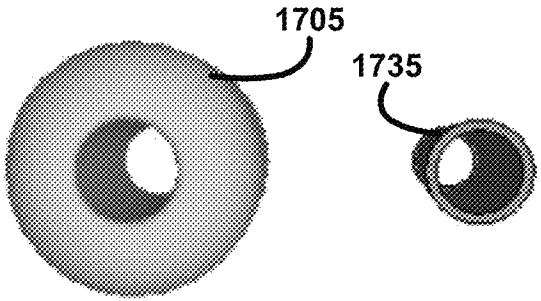
FIG. 17C shows for illustrative purposes only an example of the 13 mm tapered tip and tapered crutch device end view of one embodiment.

13 mm Tip and Tapered Crutch Device End View:

FIG. 17C shows for illustrative purposes only an example of 13 mm tapered tip and tapered crutch device end view of one embodiment. FIG. 17C shows a 13 mm tapered tip end view 1705 and a 13 mm tapered crutch device end view 1735, wherein the outside diameter of the tip is 13 mm of one embodiment.

Figure 17D:
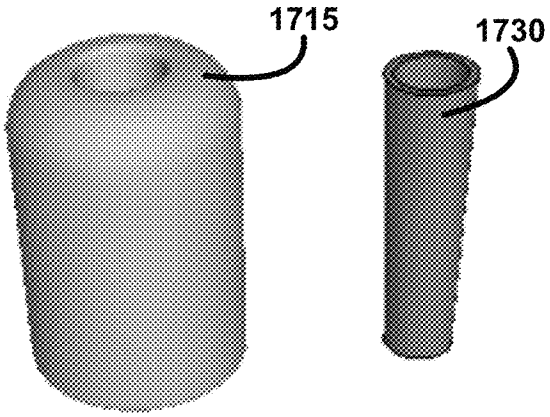
FIG. 17D shows for illustrative purposes only an example of the 13 mm tapered tip and tapered crutch device side view of one embodiment.

13 mm Tip and Tapered Crutch Device Side View:

FIG. 17D shows for illustrative purposes only an example of 13 mm tapered tip and tapered crutch device side view of one embodiment. FIG. 17D shows a 13 mm tapered tip side view 1715 and a 13 mm tapered crutch device side view 1730 of one embodiment.

Figure 18A:
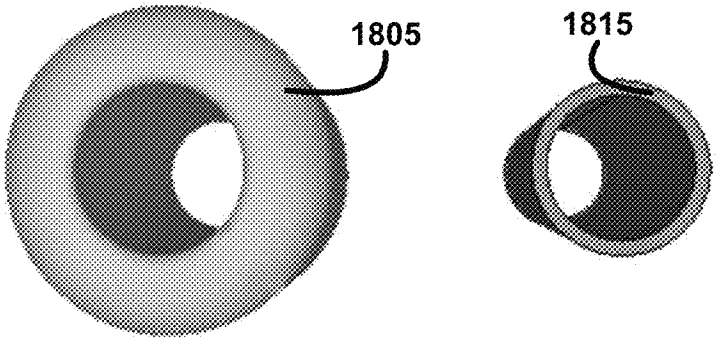
FIG. 18A shows for illustrative purposes only an example of the 12 mm tapered tip and tapered crutch device end view of one embodiment.

12 mm Tip and Tapered Crutch Device End View:

FIG. 18A shows for illustrative purposes only an example of 12 mm tapered tip and tapered crutch device end view of one embodiment. FIG. 18A shows a 12 mm tapered tip end view 1805 and a 12 mm tapered crutch device end view 1815, wherein the outside diameter of the tip is 12 mm of one embodiment.

Figure 18C:
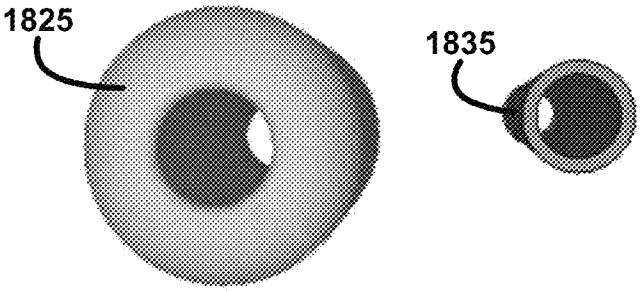
FIG. 18C shows for illustrative purposes only an example of the 10 mm tapered tip and tapered crutch device end view of one embodiment.
Figure 18B:
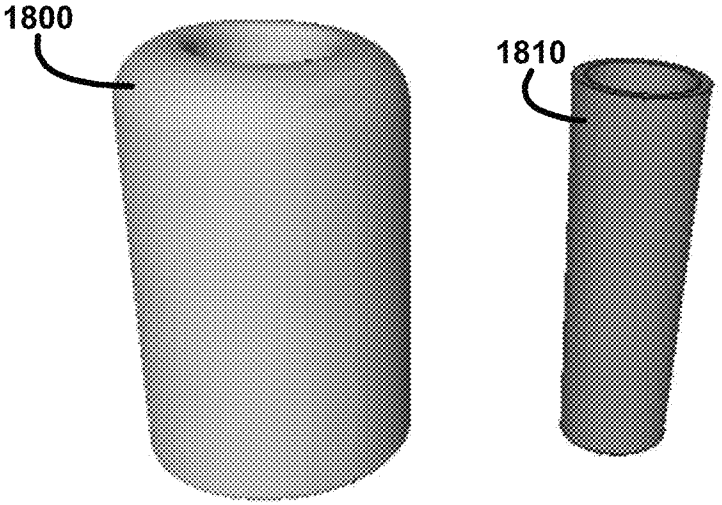
FIG. 18B shows for illustrative purposes only an example of the 12 mm tapered tip and tapered crutch device side view of one embodiment.

12 mm Tip and Tapered Crutch Device Side View:

FIG. 18B shows for illustrative purposes only an example of 12 mm tapered tip and tapered crutch device side view of one embodiment. FIG. 18B shows a 12 mm tapered tip side view 1800 and a 12 mm tapered crutch device side view 1810 of one embodiment.

10 mm Tip and Tapered Crutch Device End View:

FIG. 18C shows for illustrative purposes only an example of 10 mm tapered tip and tapered crutch device end view of one embodiment. FIG. 18C shows a 10 mm tapered tip end view 1825 and a 10 mm tapered crutch device end view 1835, wherein the outside diameter of the tip is 10 mm of one embodiment.

Figure 18D:
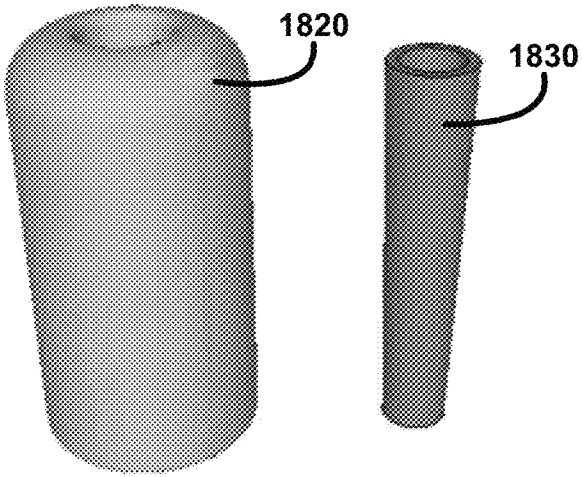
FIG. 18D shows for illustrative purposes only an example of the 10 mm tapered tip and tapered crutch device side view of one embodiment.

10 mm Tip and Tapered Crutch Device Side View:

FIG. 18D shows for illustrative purposes only an example of 10 mm tapered tip and tapered crutch device side view of one embodiment. FIG. 18D shows a 10 mm tapered tip side view 1820 and a 10 mm tapered crutch device side view 1830 of one embodiment.

Smoking Material Care Kit Method and Devices:

It should be noted that the descriptions that follow, for example, in terms of the smoking material care kit method and devices, is described for illustrative purposes and the underlying system can apply to any number and multiple types of the smoking materials. In one embodiment of the present invention, the smoking material care kit method and devices can be configured for use with cigars and smoking pipes. In another embodiment, the smoking material care kit method and devices can be used for medical and legalized cannabis smoking products.

Cigarettes were originally sold with a bag of smoking materials and paper wrappers which the smoker would use to roll their own cigarettes. Subsequently, factory rolled cigarettes came into the market. Cigars generally have always been sold pre-rolled by hand. Smoking pipes for use with tobacco products and the like are typically sold separately from the tobacco. Cigar and/or rolled tobacco products usually need something to facilitate flow in the middle of the tobacco product and something to ignite them. Pipe tobacco products usually need something to ignite them and something to clean them.

Figure 19:
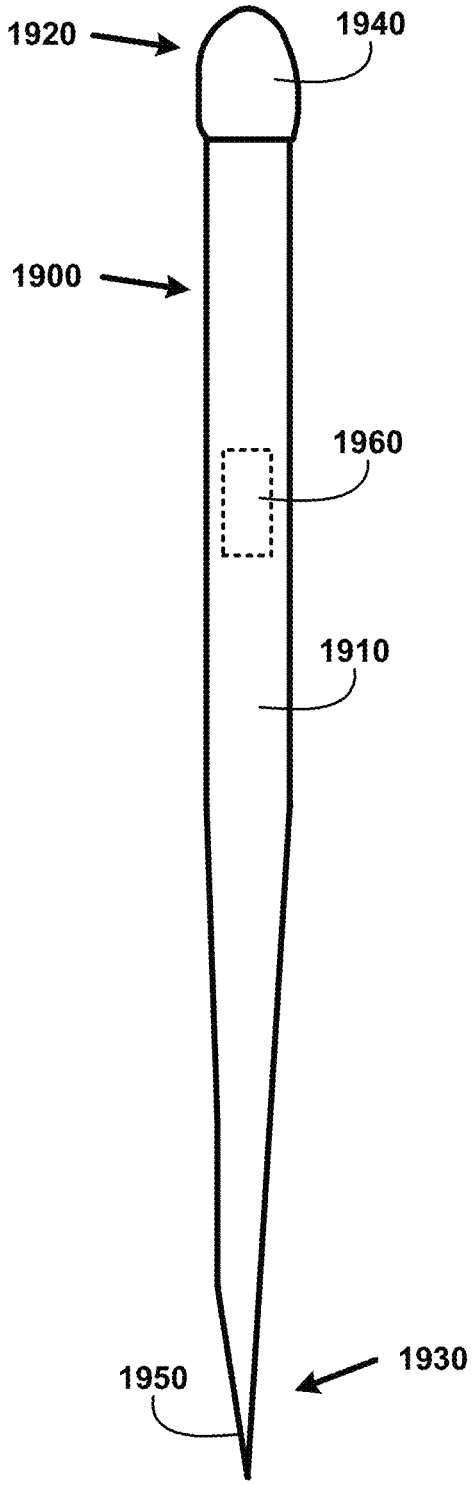
FIG. 19 shows for illustrative purposes only a front view of the matchstick and pick combination device of one embodiment.

FIG. 19 shows for illustrative purposes only a front view of the matchstick and pick combination device of one embodiment. The matchstick and pick combination device 1900 can be used for smoking products, for example pipes, tobacco, cigars and other blunt rolled smoking products, including legal medicinal cannabis smoking products. The matchstick and pick combination device 1900 includes an elongated section 1910 having a proximal end 1920 and a distal end 1930. The matchstick and pick combination device 1900 also includes an ignition section 1940 located at a tip of the proximal end 1920 and a cleaning device 1950 located at the tip of the distal end 1930. The matchstick and pick combination device 1900 can also include matchstick sensors and electronic devices 1960 embedded within it. The length of the matchstick and pick combination device 1900 can be between 2.5 inches and 3.5 inches.

In one embodiment, the ignition section 1940 is coated with a material that can be ignited by frictional heat generated by striking the match against a suitable surface. The coated material of the ignition section 1940 can consist of a bead of active ingredients and binder, which can be a different color from the elongated section 1910 to distinguish itself as the ignition area. The coated material can be a safety coating that can only be struck against a specially prepared surface and ignited or a friction activated coating that can be ignited when struck using frictional force to ignite the coated material. In one embodiment, the friction coating ignition section 1940 is comprised of at least a phosphorus material.

In one embodiment, the cleaning device 1950 is a sharp pointed surface resembling a pick. In another embodiment, the cleaning device 1950 is a pointed, but non-sharped, blunt tip. In another embodiment, the cleaning device 1950 has bristles on the end of it and/or any suitable tip to allow breaking up, picking at, or chipping away at and cleaning debris. In another embodiment, the ignition section 1940 and the cleaning device 1950 have replaceable and disposable sections that can be replaced with new tips. The cleaning device 1950 is used as a tool to break up, pick at, or chip at something to gather unwanted residue in an area so it can be removed from the area.

The entire matchstick and pick combination device 1900 can be configured to be inserted in a tobacco product container and used to help keep a clean channel within an approximate center section of the tobacco product and the ignition section 1940 is configured to be used to ignite a tobacco product on an ignition location of the tobacco product. In addition, the matchstick and pick combination device 1900 can be configured to be used to ignite tobacco located in a tobacco repository of a smoking pipe and the cleaning tip can be configured to be used as a cleaning device to remove combusted materials, ashes and/or unwanted debris from the tobacco repository of a smoking pipe after the smoking pipe is used by a smoker.

The products used with the matchstick and pick combination device 1900 can be smoking materials including legalized and medicinal cannabinoid-based smoking products including cannabidiol antioxidant drugs with application as neuroprotectants. The infused cannabinoids can be used for treatment and prophylaxis of a wide variety of oxidation associated diseases, including ischemic, age-related, inflammatory and autoimmune diseases. In one embodiment, the cannabinoids do not include THC, HU-210, HU-211 or any other NMDA receptor antagonist and wherein the cannabinoid is not psychoactive, and is not psychotoxic even at high doses.

Figure 20:
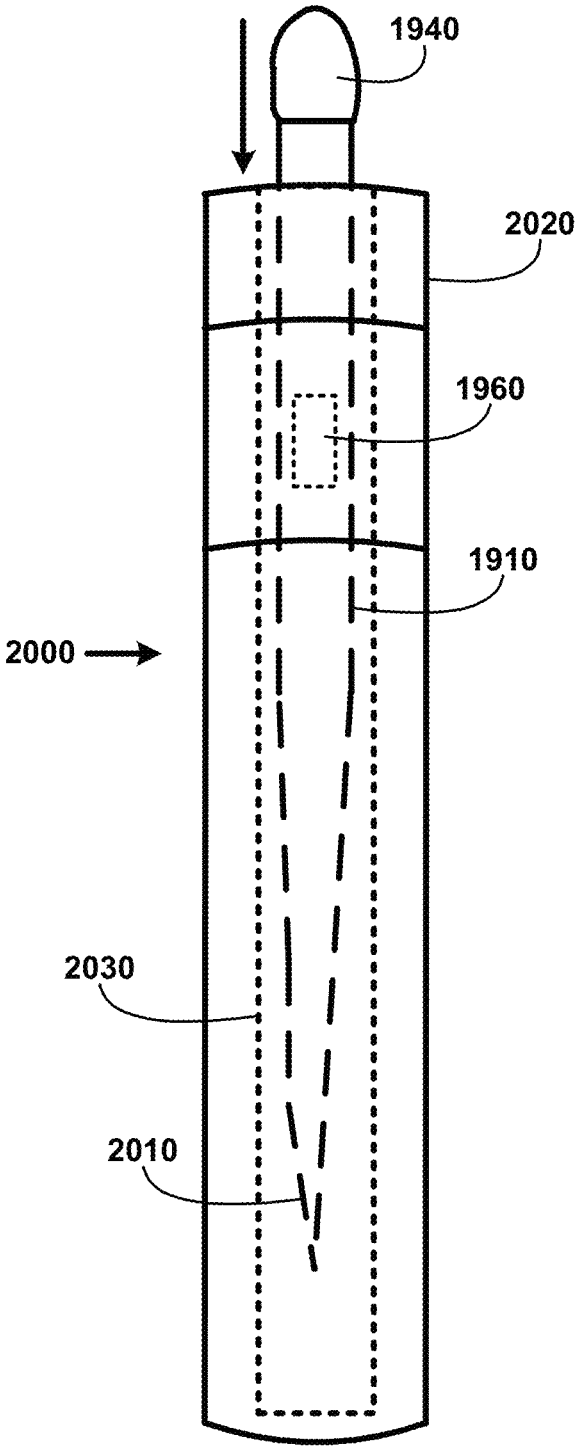
FIG. 20 shows for illustrative purposes only the matchstick and pick combination device for use with a cigar or tobacco product of one embodiment.

Smoking Product Use:

FIG. 20 shows for illustrative purposes only the matchstick and pick combination device for use with a cigar or tobacco product of one embodiment. The matchstick and pick combination device 1900 includes the elongated section 1910 with the ignition section 1940 located at the tip of the proximal end 1920 of FIG. 19 and a pick 2010 as the cleaning device 1950 of FIG. 19 located at the tip of the distal end 1930 of FIG. 19. The pick 2010 is configured to be inserted in a non-ignition location of a cigar or tobacco product container 2000 and used to help keep a clean channel 2030 within an approximate center section of the cigar or tobacco product container 2020.

The matchstick and pick combination device 1900 includes the ignition section 1940. The ignition section 1940 can be used to ignite a smoking material including a cigar, tobacco and cannabis product on an ignition location of the cigar or tobacco product. The ignition section 1940 can be struck against a suitable surface to allow ignition of the ignition section 1940, which then can be used to ignite an ignition location of for example of a tobacco product.

Figure 21A:
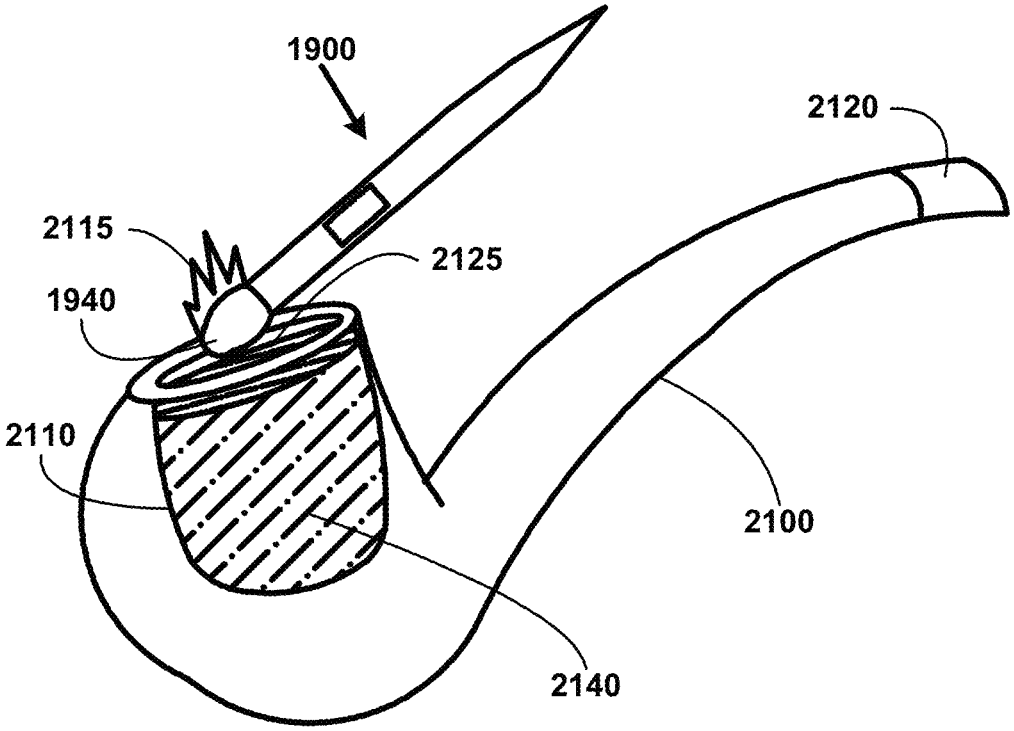
FIG. 21A shows for illustrative purposes only the matchstick and pick combination device igniting a pipe tobacco product of one embodiment.

Igniting a Tobacco Product:

FIG. 21A shows for illustrative purposes only the matchstick and pick combination device 1900 igniting a pipe tobacco product of one embodiment. The matchstick and pick combination device 1900 can be configured to ignite tobacco 2140 located in a tobacco repository 2110 of a smoking pipe 2100 with an inhaler section 2120. The ignition section 1940 can be struck against a suitable surface and ignited producing a flame 2115 used to ignite an ignition location 2125 of for example a tobacco product of one embodiment.

Figure 21B:
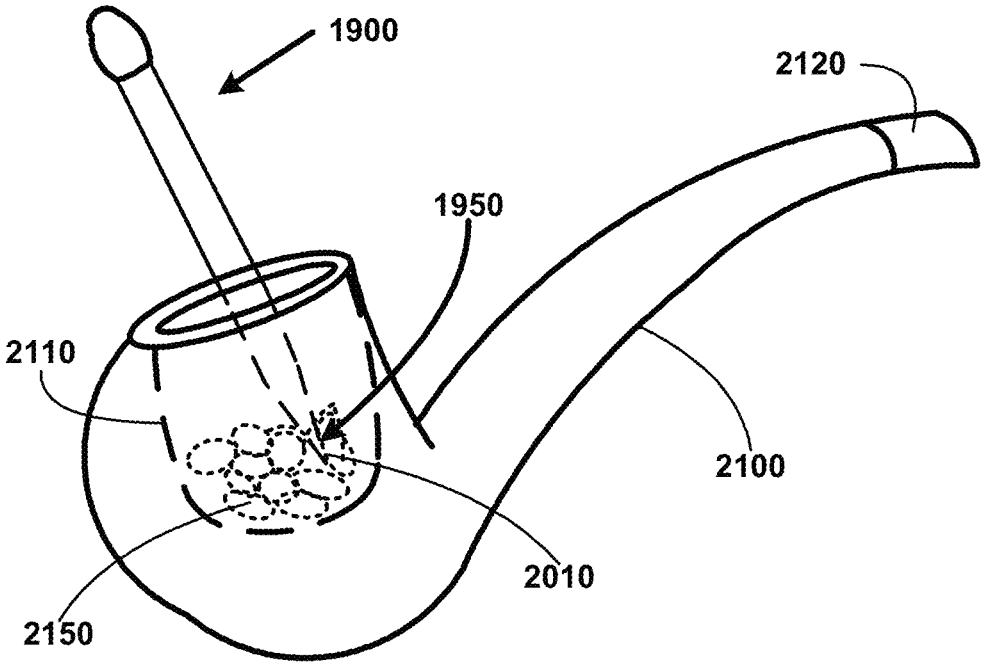
FIG. 21B shows for illustrative purposes only the matchstick and pick combination device cleaning pick of one embodiment.

Cleaning Device Use:

FIG. 21B shows for illustrative purposes only the matchstick and pick combination device cleaning pick of one embodiment. FIG. 21B shows the matchstick and pick combination device 1900 with the cleaning device 1950 for example a pick 2010 located at the distal end 1930 of FIG. 19. FIG. 21B also shows the smoking pipe 2100 with the inhaler section 2120. Showing in the tobacco repository 2110 is combusted materials 2150, including ashes and unwanted debris from smoking the tobacco product. The sharp pointed pick 2010 is used for breaking up and picking at combusted materials 2150 to loosen the combusted materials 2150 for removal and cleaning the tobacco repository 2110 of one embodiment.

Figure 22A:
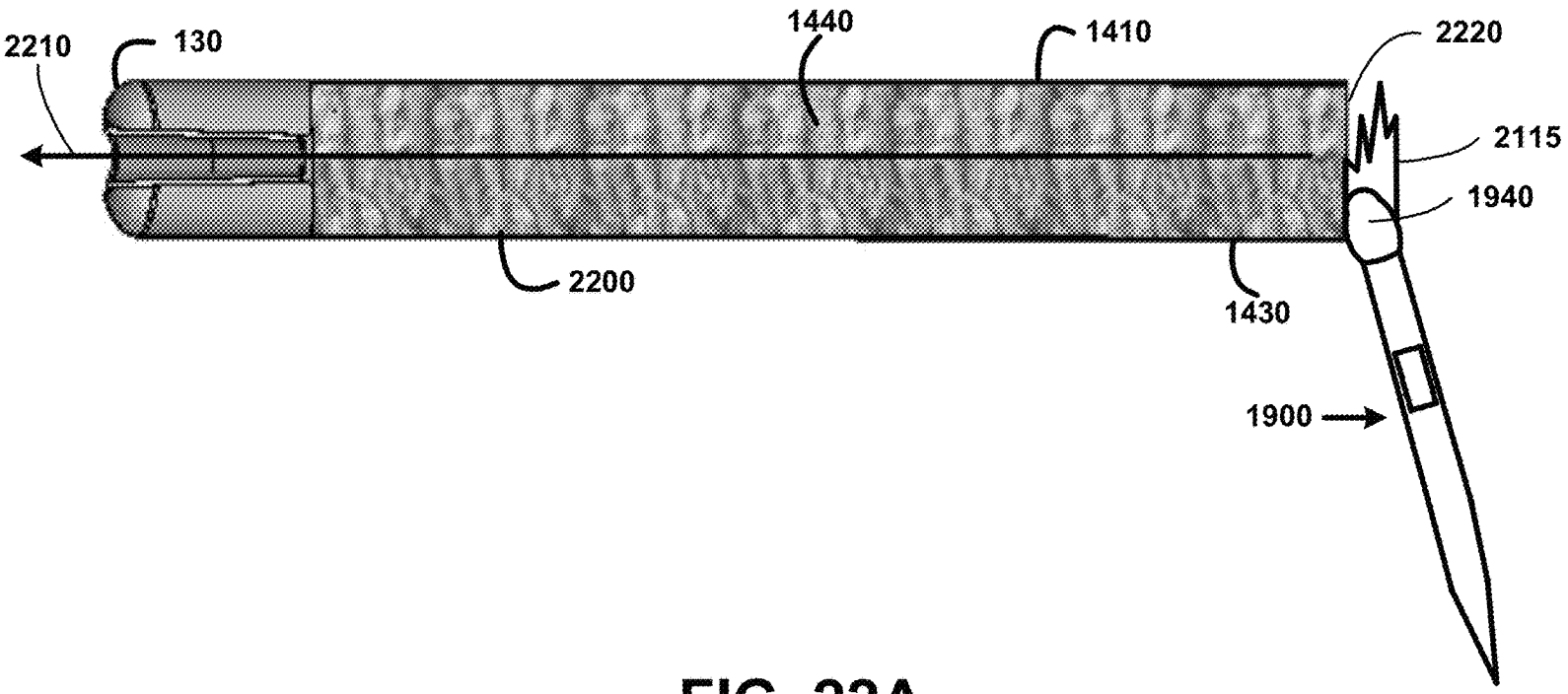
FIG. 22A shows for illustrative purposes only the matchstick and pick combination device igniting a rolled blunt product of one embodiment.

Igniting a Rolled Blunt:

FIG. 22A shows for illustrative purposes only the matchstick and pick combination device igniting a rolled blunt product of one embodiment. FIG. 22A shows the matchstick and pick combination device 1900 can be configured to ignite the final packed tamped smoking material 1440 at a rolled blunt ignition location 2220 located in the rolled wrapper layer 1430 of a rolled blunt 2200 with the glass tip 130 shown in the complete blunt section view 1410 of FIG. 14B. The ignition section 1940 can be struck against a suitable surface and ignited producing a flame 2115 used to ignite the rolled blunt 2200 of for example a legal cannabis product as a smoker draws 2210 or inhales of one embodiment.

Figure 22B:
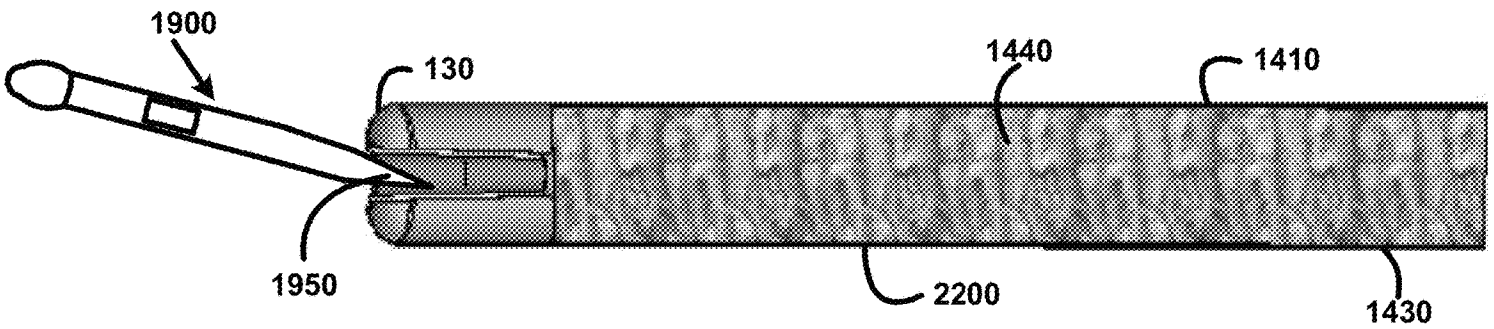
FIG. 22B shows for illustrative purposes only the matchstick and pick combination device pick cleaning a rolled blunt glass tip of one embodiment.

Cleaning Rolled Blunt Tip:

FIG. 22B shows for illustrative purposes only the matchstick and pick combination device pick cleaning a rolled blunt glass tip of one embodiment. FIG. 22B shows the matchstick and pick combination device 1900 with the cleaning device 1950. FIG. 22B also shows a rolled blunt 2200 with the glass tip 130 shown in the complete blunt section view 1410 of FIG. 14B including the final packed tamped smoking material 1440 and rolled wrapper layer 1430. The cleaning device 1950 is shown cleaning the interior of the glass tip 130 of any combusted materials 350, including ashes and unwanted debris from smoking to keep clear the glass tip 130 to facilitate the smoker draws 2210 of FIG. 22A of one embodiment.

Figure 23:
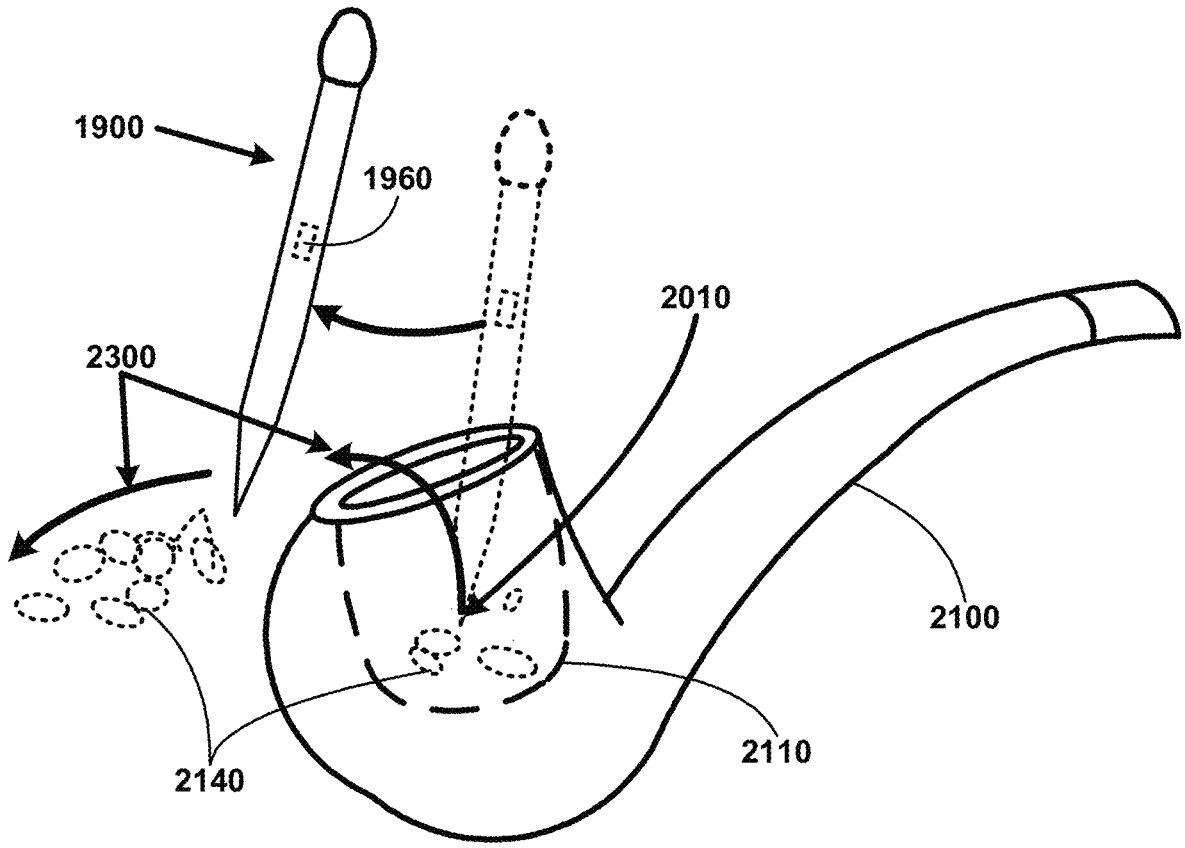
FIG. 23 shows for illustrative purposes only the matchstick and pick combination device for cleaning a smoking pipe of one embodiment.

Smoking Pipe Cleaning:

FIG. 23 shows for illustrative purposes only the matchstick and pick combination device for cleaning a smoking pipe of one embodiment. The matchstick and pick combination device 1900 includes for example a pick 2010 located at the tip of the distal end 1930 of FIG. 19. The pick 2010 is configured to pick at, scrape, break up, collect and dispose and remove (shown by arrows 2300) of ashes and unwanted combusted materials 2140 debris from the tobacco repository 2110 of the smoking pipe 2100 of one embodiment.

In another embodiment, the matchstick sensors and electronic devices 1960 of the matchstick and pick combination device 1900 includes an RFID chip and a GPS semiconductor chip to locate and track the matchstick and pick combination device 1900. In one embodiment, the matchstick sensors and electronic devices 1960 include a heat and humidity sensory to detect and monitor the humidity and heat of the tobacco product the matchstick and pick combination device 1900 is embedded within. The matchstick and pick combination device 1900 matchstick sensors and electronic devices 1960 can be positioned above the smoke coming from the ignited tobacco product in the tobacco repository 2110 wherein the heat and humidity can be detected. The sensors and electronic devices can be wirelessly connected to an external digital device and a digital application via any suitable wireless connection, for example Wi-Fi and Bluetooth® of one embodiment.

Two-Way Humidity Control Pack:

Small humidity control packs are commonly used in an attempt to control the atmospheric moisture and relative humidity of humidity sensitive contained products, for example packaged cigars and tobacco products. However, these humidity packs randomly reside within their environment, for example a storage container 2020 of FIG. 20, and cannot be strategically located in container 2020 of FIG. 20. As such, they are limited in how they distribute controlled humidity. Further, these humidity packs are geometrically incompatible with many containers, for example cylindrical containers, for cigars and tobacco products.

Figure 24:
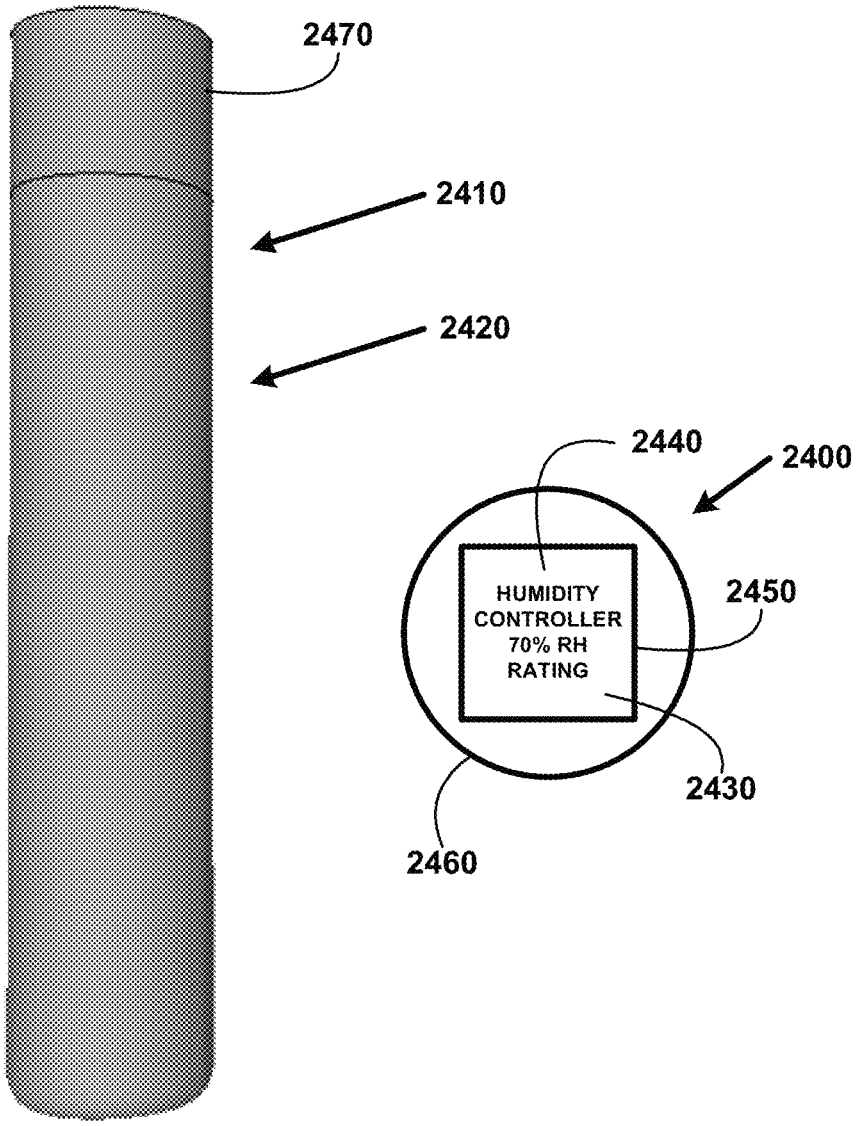
FIG. 24 shows for illustrative purposes only an overview of the two-way humidity control pack of one embodiment.

FIG. 24 shows for illustrative purposes only an overview of a two-way humidity control pack of one embodiment. FIG. 24 shows a two-way humidity control pack 2400 of the smoking material care kit method and devices. It should be noted that the descriptions that follow, for example, in terms of a two-way humidity control pack for atmospheric moisture monitoring, detection and control within a container 2020 of FIG. 20 is described for illustrative purposes and the underlying system can apply to any number and multiple types of containers and environments. In one embodiment, the two-way humidity control pack can be used for atmospheric moisture monitoring, detection and control of smoking materials including for example medical and legalized cannabis based smoking products, and tobacco products. In another embodiment of the present invention, the two-way humidity control pack can be configured for any product that needs relative humidity and atmospheric moisture monitoring, detection and control.

In one embodiment, the two-way humidity control pack 2400 is circular 2460 or approximately circular in shape and is approximately two inches in diameter and easily fits and conforms to the circular shape of a cylindrical container 2410 that is used to store smoking products 2420. Approximately circular in shape can mean any shape that conforms to a circular cap 2470 of a cylindrical container 2410, for example an oval shape, substantially curved shape, an octagonal shape and other shapes. In addition, the two-way humidity control pack 2400 can be manufactured with specific humidity control RH ratings 2430, for example, from 60% to 68%, depending on a predetermined humidity range control of the user. Also, the humidity pack can have custom branding 2440 on either side of the pack and near the RH ratings 2430. In addition, the two-way humidity control pack 2400 has a self-adhering surface 2450 on one or both of its sides.

The two-way humidity control pack 2400 is used to control the atmospheric moisture and relative humidity of the humidity sensitive smoking products 2420 within the cylindrical container 2410 based on the pack used. Also, the two-way humidity control pack 2400 can be strategically located within the inside of any container by using its self-adhering surface 2450. As such, two-way humidity control pack 2400 can uniformly distribute controlled humidity throughout the container 2020 of FIG. 20. Further, since the two-way humidity control pack 2400 is circular in shape, it is geometrically compatible with many containers, for example cylindrical containers, for smoking products including cigars and tobacco products.

In one embodiment, the two-way humidity control pack 2400 has two-way relative humidity control to ensure the product it's controlling, for example a tobacco maintains a user predetermined moisture content. In one embodiment, the moisture content is between 12-16%, so an ambient relative humidity of 60 to 68% is predetermined to maintain equilibrium of the tobacco product. Low relative humidity (RH), for example below 60% RH, could cause the tobacco product to lose moisture, weight and quality. In many cases, temperatures over 78° F. can reduce the quality of the tobacco product and can promote post fermentation. The two-way humidity control continually responds to ambient conditions and adds or removes moisture. By doing this, the contained environment is controlled and delivered the predetermined RH level. However, depending on the predetermined humidity level, the humidity pack can be rated from around 0% to close to 100%.

The products used with the matchstick and pick combination device 1900 can be legalized and medicinal cannabinoid-based smoking products including cannabidiol antioxidant drugs with application as neuroprotectants. The infused cannabinoids can be used for treatment and prophylaxis of a wide variety of oxidation associated diseases, including ischemic, age-related, inflammatory and autoimmune diseases. In one embodiment, the cannabinoids do not include THC, HU-210, HU-211 or any other NMDA receptor antagonist and wherein the cannabinoid is not psychoactive, and is not psychotoxic even at high doses.

Figure 25:
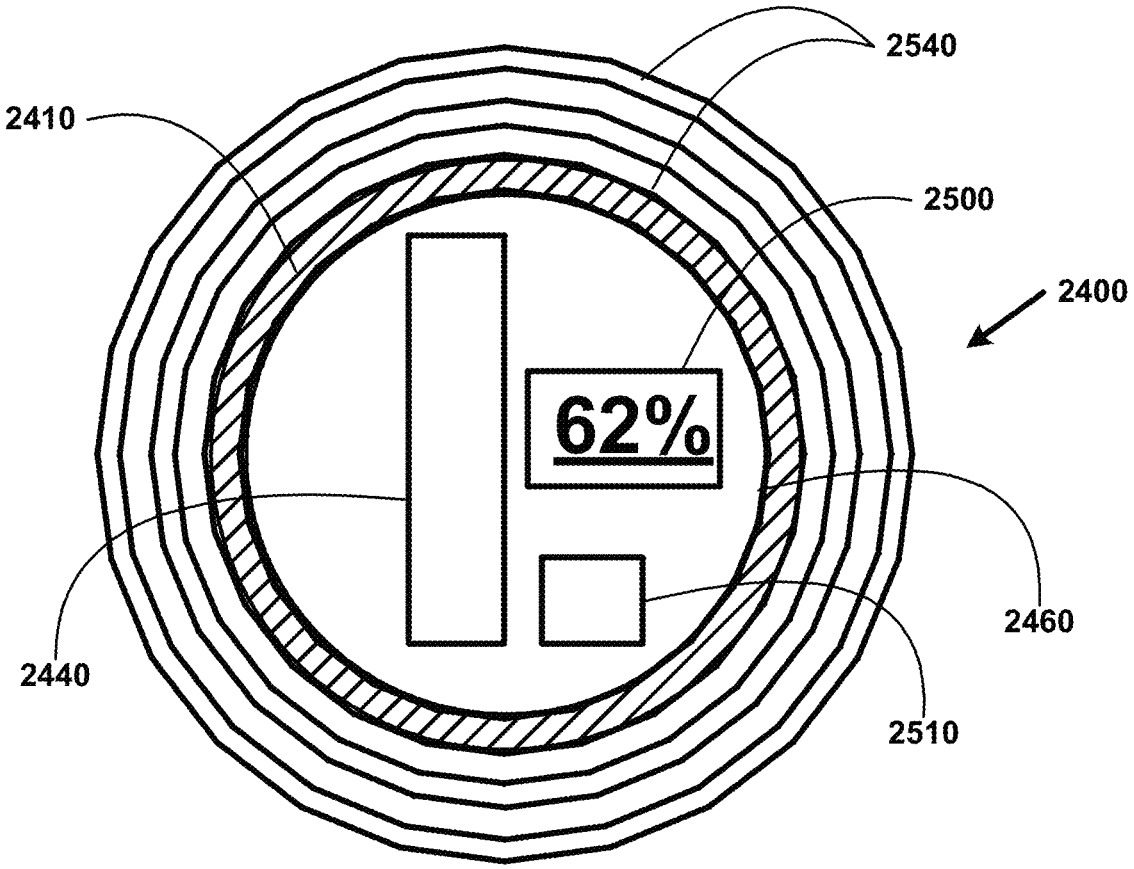
FIG. 25 shows for illustrative purposes only a top view of the two-way humidity control pack of one embodiment.

Top View of the Two-Way Humidity Control Pack:

FIG. 25 shows for illustrative purposes only a top view of the two-way humidity control pack of one embodiment. FIG. 25 shows from a top view the two-way humidity control pack 2400. The approximately circular 2460 shape of the two-way humidity control pack 2400 is shown substantially conforming to the circular shape of the cylindrical container 2410 and container circular cap 2540. The two-way humidity control pack 2400 includes a digital numerical RH ratings display 2500 of the relative humidity allowing a user to easily determine the controlled relative humidity inside the cylindrical container 2410 holding the smoking products 2420 of FIG. 24 contained therein. Custom branding 2440 can be displayed on either side of the two-way humidity control pack 2400.

The two-way humidity control pack 2400 includes two-way humidity control pack sensors and electronic devices 2510. The two-way humidity control pack sensors and electronic devices 2510 include a humidity sensor, a micro dehumidifier, a micro humidifier, a digital processor, a flexible wireless rechargeable battery and a near-field communication (NFC) device. The digital processor receives the humidity level detected by the humidity sensor and transmits the humidity level to the digital numerical RH ratings display 2500 using the NFC. The micro dehumidifier extracts moisture from the air inside the container 2020 of FIG. 20 and stores the moisture in a storage vessel to lower the humidity level to a predetermined range. The micro humidifier uses the extracted stored moisture to add moisture to the air inside the container 2020 of FIG. 20 to raise a detected humidity level to a predetermined range of one embodiment.

Figure 26:
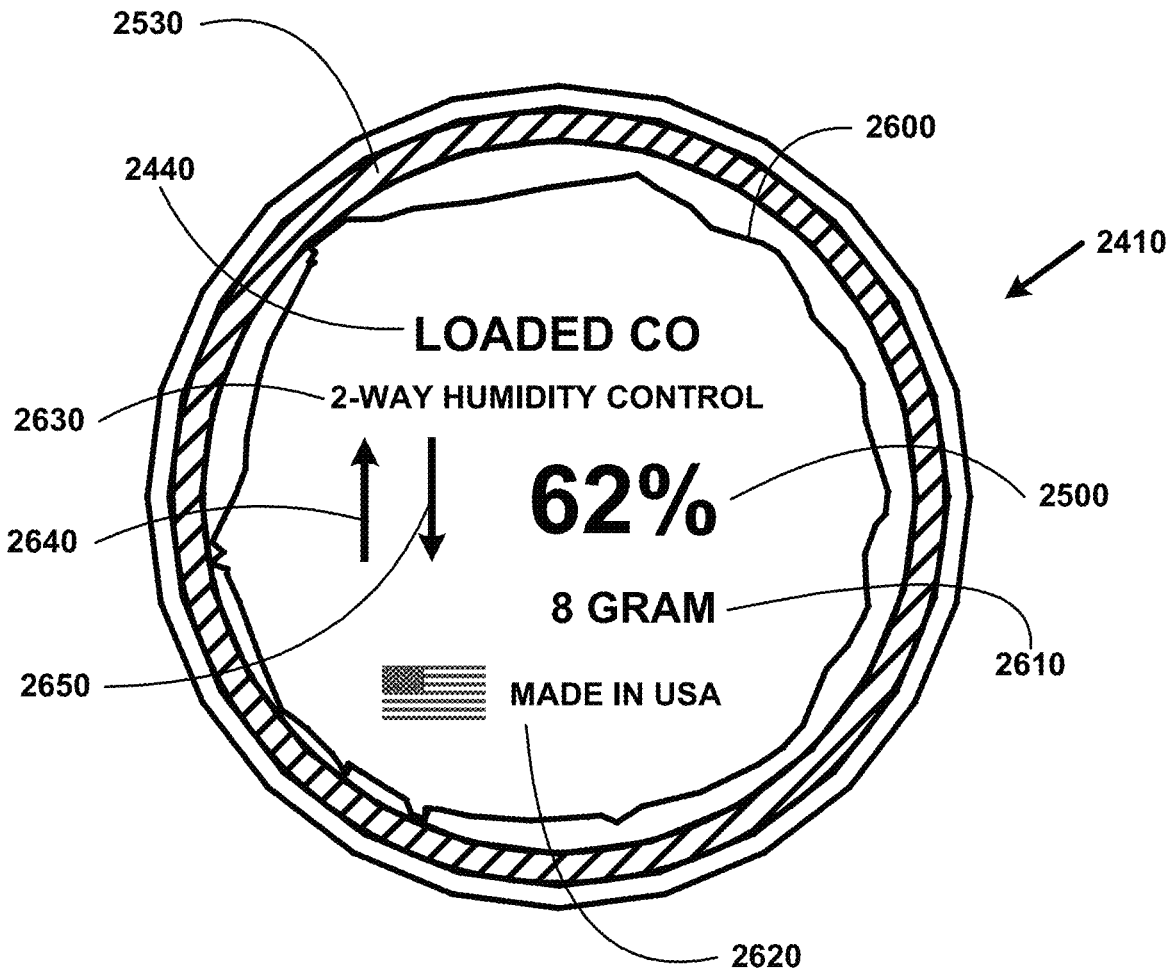
FIG. 26 shows for illustrative purposes only a bottom view of the two-way humidity control pack of one embodiment.

Bottom View of the Two-Way Humidity Control Pack:

FIG. 26 shows for illustrative purposes only a bottom view of the two-way humidity control pack of one embodiment. The two-way humidity control pack 2400 can be coupled with a pouch 2600 for use in a substantially sealed cylindrical container 2410 to control the relative humidity (RH) within the container 2020 of FIG. 20 it is enclosed within. The two-way humidity control pack 2400 in one embodiment can include at least part of a pouch 2600 surface which has a membrane capable of passing water vapor. The two-way humidity control pack 2400 in one embodiment can contain a buffering substance, for example a saturated salt solution selected according to the predetermined relative humidity, and modified by a nonelectrolyte, if necessary, to adjust the relative humidity.

The two-way humidity control pack 2400 is configured to maintain a particular RH or water activity (Aw) inside the container 2020 of FIG. 20 from the time it leaves the manufacturing plant, when it is opened by the consumer and during storage and usage by the user. This allows the product in the cylindrical container 2410 to not only reach the consumer with the proper moisture content, but also during the life of the product usage by the consumer. The two-way humidity control pack 2400 controls the RH and handles both moisture absorbed into the two-way humidity control pack 2400 from a very humid environment and controls the loss of moisture from the cylindrical container 2410 during a very dry environment.

Also, the two-way humidity control pack 2400 can be configured as a pouch 2600 with custom branding 2440 for example "LOADED CO" and/or advertisements on both the bottom and top near the numerical RH ratings 2430. The custom branding 2440 can be located on the two-way humidity control pack 2400 so the custom branding 2440 is noticeable and visible to the consumer. The pouch 2600 can also include a label indicating a volume for example 8 gram 2610 of smoking material originally packed in the pouch 2600, the production location in this example made in USA 2620, the label can include the two-way humidity control pack 2400 data that includes its capacity for example 2-way humidity control 2630, instructions to increase the RH showing as an arrow pointing upward 2640 and an arrow pointing downward 2650 and the digital numerical RH ratings display 2500 visible on the top end of the pouch 2600 of one embodiment.

Figure 27:
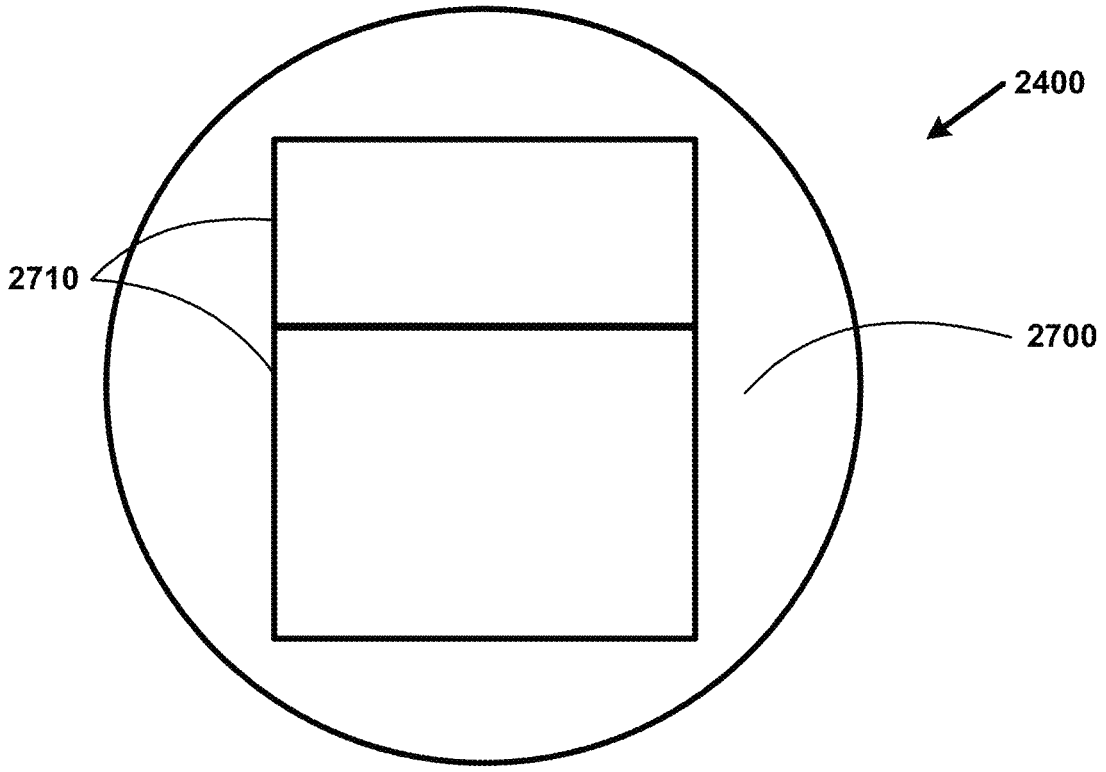
FIG. 27 shows for illustrative purposes only two-way humidity control pack removable adhesive tabs of one embodiment.

Removable Adhesive Tabs:

FIG. 27 shows for illustrative purposes only two-way humidity control pack removable adhesive tabs of one embodiment. The two-way humidity control pack includes a self-adhering surface 2700 with a peel-off tab 2710 on either and/or both sides of the two-way humidity control pack. The self-adhering surface 2700 and peel-off tab 2710 are preferable clear, transparent or translucent. The peel-off tab 2710 of the self-adhering surface 2700 can be left un-peeled so the adhesive of the self-adhering surface 2700 is inactivated or the peel-off tab 2710 can be peeled-off the self-adhering surface 2700 to expose an adhesive surface that allows the two-way humidity control pack 2400 to adhere to inner surfaces of the cylindrical container 2410 of FIG. 24 of one embodiment.

Figure 28A:
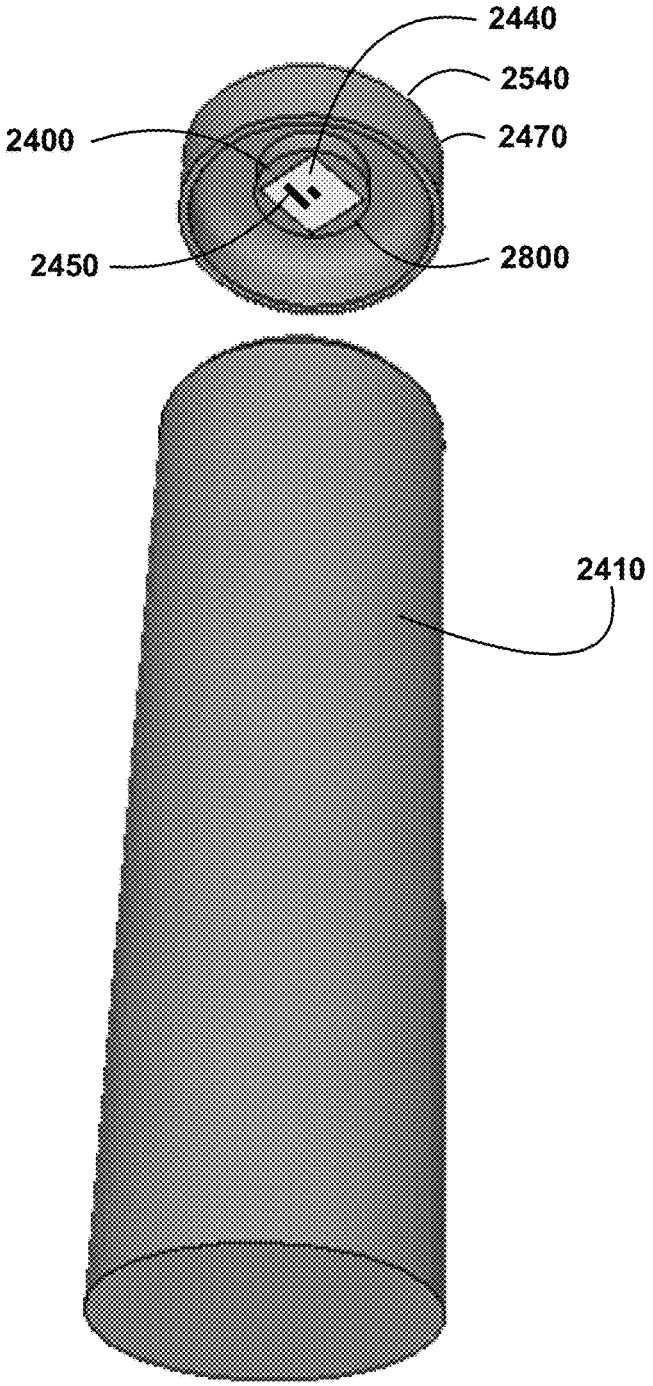
FIG. 28A shows for illustrative purposes only the two-way humidity control pack adhered to the inside surface of a container cap of one embodiment.
Figure 29A:
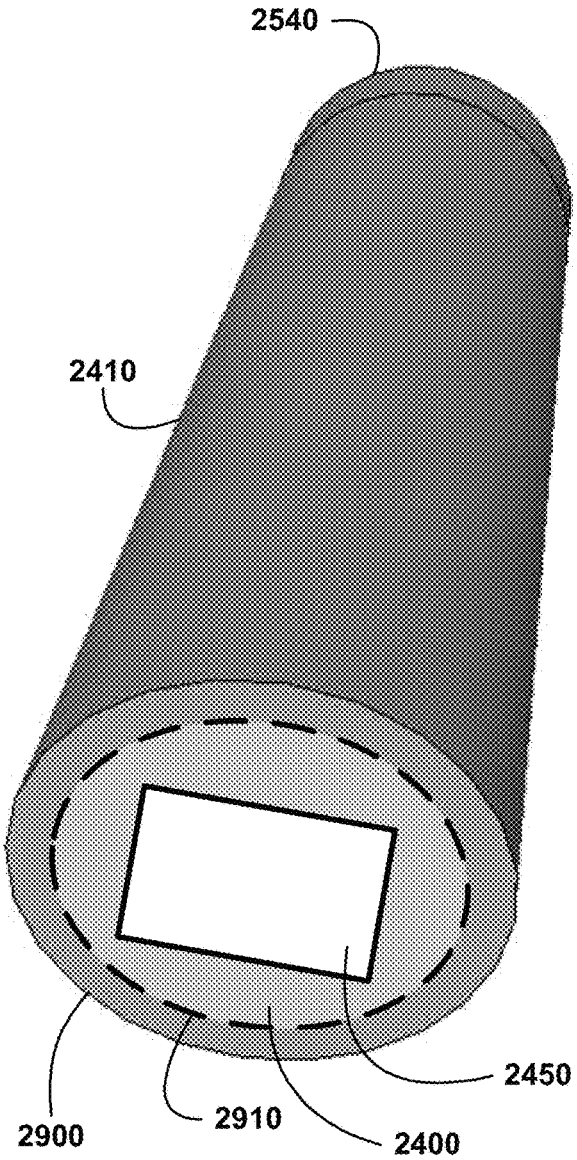
FIG. 29A shows for illustrative purposes only the two-way humidity control pack adhered to the inside bottom surface of a cylindrical container of one embodiment.
Figure 30A:
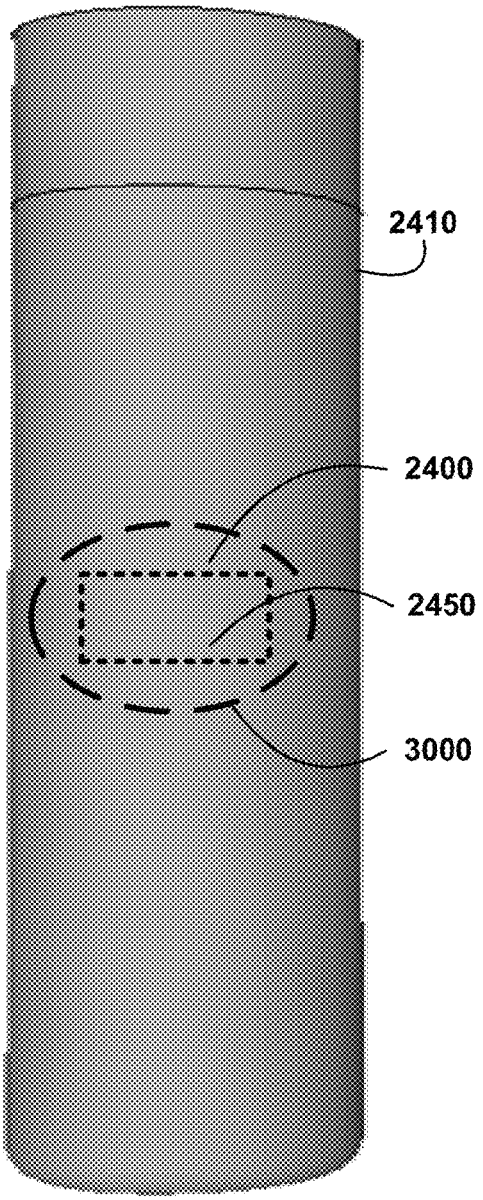
FIG. 30A shows for illustrative purposes only the two-way humidity control pack adhered to an inside sidewall surface of a cylindrical container of one embodiment.

Two-Way Humidity Control Pack Adhered to a Container:

The two-way humidity control pack 2400 can be evenly distributed throughout the inside of the cylindrical container 2410 of FIG. 24 and adhered and located on the inside top, bottom and side walls of the cylindrical container 2410 of FIG. 24 by using its self-adhering surface 2450 as illustrated in FIGS. 28A & B, FIGS. 29A & B and FIGS. 30A & B. The multiple positioning of the two-way humidity control pack 2400 can uniformly distribute controlled humidity throughout the cylindrical container 2410 of FIG. 24. Specifically, the two-way humidity control pack 2400 can be located throughout the inside of any cylindrical container 2410 of FIG. 24 in strategic locations by using its self-adhering surface 2450. The two-way humidity control pack 2400 can uniformly distribute controlled humidity throughout the cylindrical container 2410 of FIG. 24 when adhered to strategic locations that are predetermined to uniformly control the RH.

Two-Way Humidity Control Pack Adhered:

FIG. 28A shows for illustrative purposes only the two-way humidity control pack adhered to the inside surface of a container cap of one embodiment. FIG. 28A shows the two-way humidity control pack 2400 positioned and adhered to an inside surface 2800 of the circular cap 2540 including the circular cap 2470 of the cylindrical container 2410. The two-way humidity control pack 2400 includes the custom branding 2440 and self-adhering surface 2450 for adhering to the inside surface 2800 of one embodiment.

Figure 28B:
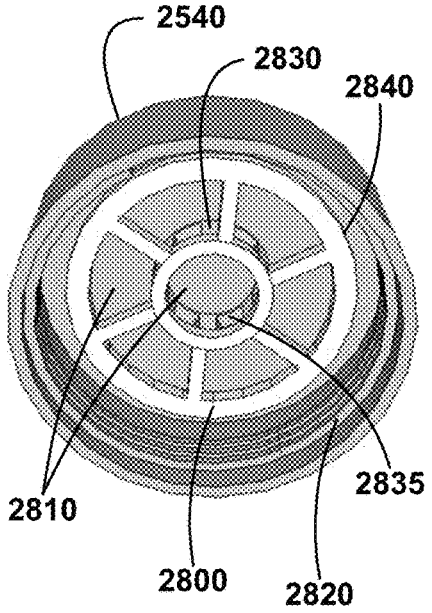
FIG. 28B shows for illustrative purposes only a container cap inside surface raised two-way humidity control pack mounting bracket of one embodiment.

Two-Way Humidity Control Pack Mounting Bracket:

FIG. 28B shows for illustrative purposes only a container cap inside surface raised two-way humidity control pack mounting bracket of one embodiment. FIG. 28B shows the circular cap 2540 with coupling threads 2820 on the inside and a container cap raised mounting bracket 2840. In this example the inside surface 2800 is the surface of the container cap raised mounting bracket 2840 facing the interior of the cylindrical container 2410 of FIG. 24. The container cap raised mounting bracket 2840 is raised on a vented pedestal 2830 with pedestal vents 2835 to allow air inside the container 2020 of FIG. 20 to circulate and come in contact with the two-way humidity control pack 2400 bottom surface and components. The container cap raised mounting bracket 2840 includes vents 2810 to allow air inside the container 2020 of FIG. 20 to circulate and come in contact with the two-way humidity control pack 2400 of FIG. 24 bottom surface and components. The two-way humidity control pack 2400 of FIG. 24 self-adhering surface 2450 of FIG. 24 is pressed against the container cap raised mounting bracket 2840 inside surface 2800 facing the interior of the cylindrical container 2410 of FIG. 24 of one embodiment.

Container Bottom Surface the Two-Way Humidity Control Pack:

FIG. 29A shows for illustrative purposes only the two-way humidity control pack adhered to the inside bottom surface of a cylindrical container of one embodiment. FIG. 29A shows the circular cap 2540 and cylindrical container 2410 exposing a container bottom 2900 area. A dashed line 2910 indicated the interior of the container bottom 2900 area where in this example the two-way humidity control pack 2400 self-adhering surface 2450 will be coupled to the cylindrical container 2410 of one embodiment.

Figure 29B:
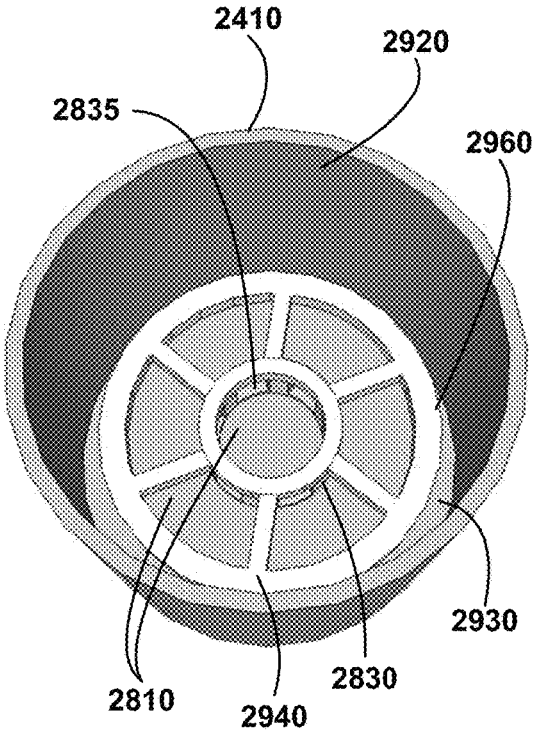
FIG. 29B shows for illustrative purposes only a container bottom surface raised mounting bracket of one embodiment.

Raised Mounting Bracket:

FIG. 29B shows for illustrative purposes only a container bottom surface raised mounting bracket of one embodiment. FIG. 29B shows the cylindrical container 2410 and container interior wall surface 2920. Coupled to a cylindrical container interior bottom surface 2930 is the vented pedestal 2830 with pedestal vents 2835 raising a container bottom raised mounting bracket 2960 above the cylindrical container interior bottom surface 2930. The container bottom raised mounting bracket 2960 includes vents 2810 to allow air inside the container 2020 of FIG. 20 to circulate and come in contact with the two-way humidity control pack 2400 of FIG. 24 bottom surface and components. The two-way humidity control pack 2400 of FIG. 24 self-adhering surface 2450 of FIG. 24 is pressed against the container bottom raised mounting bracket mounting surface 2940 to position the two-way humidity control pack 2400 of FIG. 24 of one embodiment.

Two-Way Humidity Control Pack Adhered:

FIG. 30A shows for illustrative purposes only the two-way humidity control pack adhered to an inside sidewall surface of a cylindrical container of one embodiment. FIG. 30A shows the cylindrical container 2410 and dashed lines indicating a position of the two-way humidity control pack 2400 and self-adhering surface 2450 coupled to an inside sidewall surface 3000 of the cylindrical container 2410 of one embodiment.

Figure 30B:
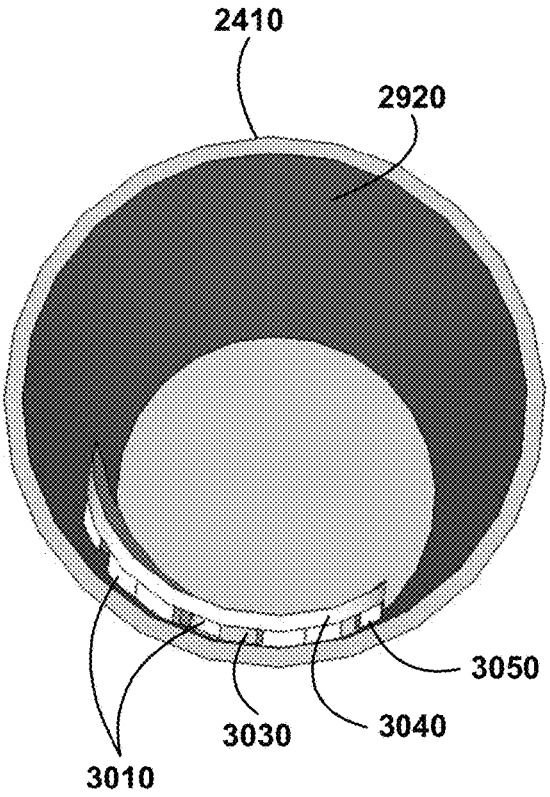
FIG. 30B shows for illustrative purposes only a two-way humidity control pack with raised legs of one embodiment.

Two-Way Humidity Control Pack with Raised Legs:

FIG. 30B shows for illustrative purposes only a two-way humidity control pack with raised legs of one embodiment. FIG. 30B shows the cylindrical container 2410 and a container interior wall surface 2920. A flexible two-way humidity control pack 3040 includes raised legs 3010 and the raised legs 3010 are used to offset the flexible two-way humidity control pack 3040 from the container interior wall surface 2920. The raised legs 3010 create multiple vent passages between the flexible two-way humidity control pack 3040 and the container interior wall surface 2920 to allow air inside the container 2020 of FIG. 20 to circulate and come in contact with the flexible two-way humidity control pack 3040 bottom surface and components. The raised legs 3010 surfaces next to the container interior wall surface 2920 are coated with an adhesive. The raised legs 3010 self-adhering surface 2450 of FIG. 24 are pressed against the container interior wall surface 2920 to position the flexible two-way humidity control pack 3040 on the interior sidewalls of the cylindrical container 2410 of one embodiment.

The two-way humidity control pack 2400 can be made in multiple shapes including circular, square, rectangular, and oval, a substantially curved shape, an octagonal shape and other shapes. The two-way humidity control pack 2400 shape can be geometrically compatible with many containers, for example cylindrical containers, for smoking materials including cigars and tobacco products. The two-way humidity control pack 2400 can be made with at least one peel-off tab 2710 of FIG. 27. The self-adhesive material 3050 is used to adhere the two-way humidity control pack 2400 to a surface. In one embodiment the custom branding 2440 of FIG. 24 is on the opposite side of the peel-off tab 2710 of FIG. 27 and self-adhesive material 3050 and the two-way humidity control pack is adhered to the inside of the circular cap 2470 of FIG. 24 of the container 2020 of FIG. 20, when the circular cap 2470 of FIG. 24 of the container 2020 of FIG. 20 is removed, the branding will be extremely noticeable and visible to the consumer.

In addition, the two-way humidity control pack 2400 can be coupled or integrated with a spacer 3030 including the container bottom raised mounting bracket 2960 that conforms to the bottom geometrical shape of the container 2020 of FIG. 20. The spacer 3030 can have a base with slots or perforations to allow airflow through the spacer 3030. The spacer 3030 can also include the vented pedestal 2830 in one embodiment and the raised legs 3010 in another embodiment that can be secured to an inside surface of the cylindrical container 2410 for example a cigar container to elevate the spacer 3030 above the inside surface of the container 2020 of FIG. 20 to allow air flow between the spacer 3030 and the humidity pack that can rest on top of the base of the spacer 3030. This will allow uniform control and humidity throughout the container 2020 of FIG. 20 of one embodiment.

Figure 31:
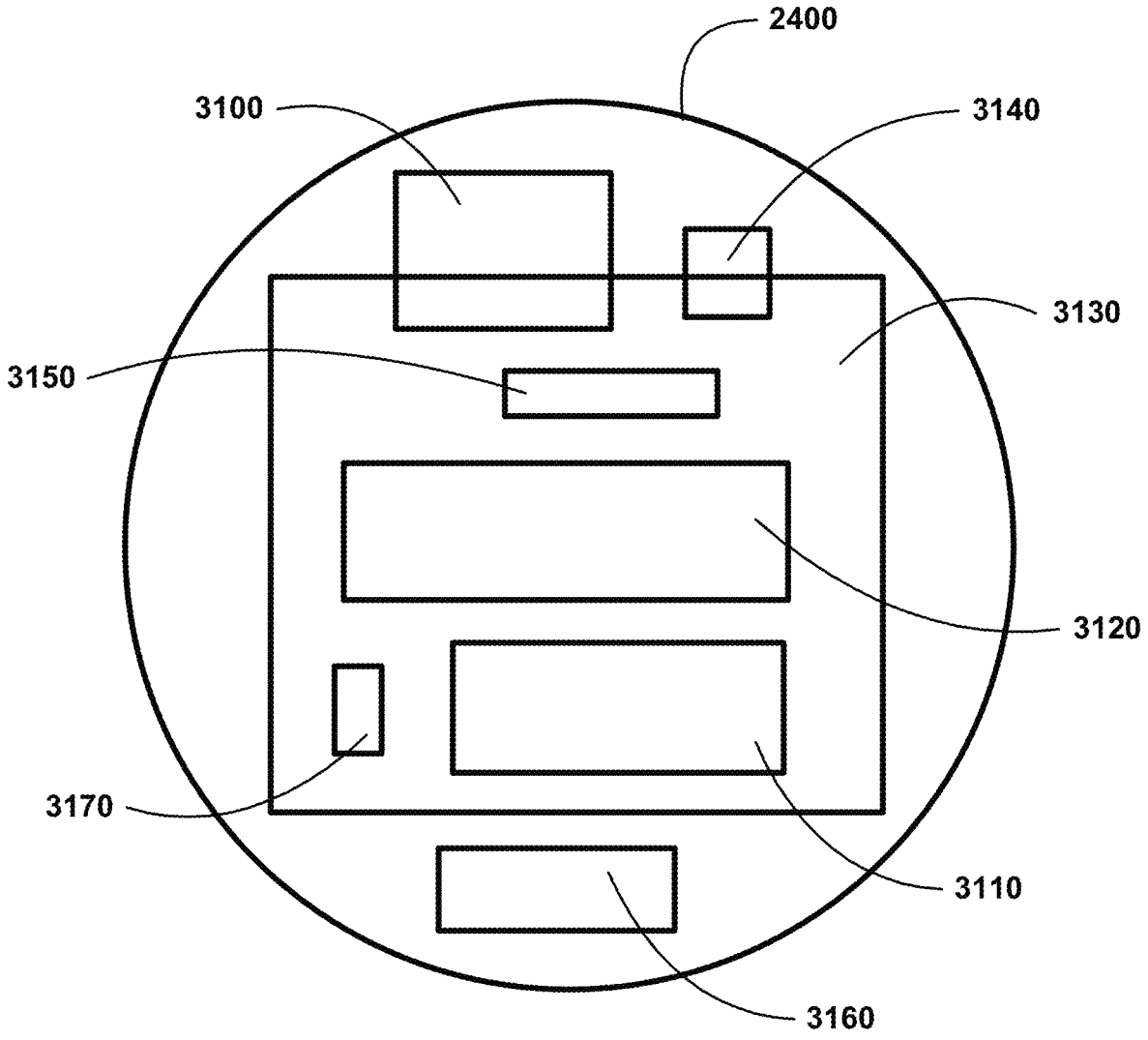
FIG. 31 shows for illustrative purposes only the two-way humidity control pack electronic sensors connectivity with digital devices of one embodiment.

Two-Way Humidity Control Pack Electronic Sensors Connectivity:

FIG. 31 shows for illustrative purposes only the two-way humidity control pack electronic sensors connectivity with digital devices of one embodiment. FIG. 31 shows the two-way humidity control pack 2400 includes sensors and electronic devices strategically located within or on the outside of the pack. The sensors and electronic devices can include quality 3100, activation 3110, Bluetooth® 3120, Wi-Fi 3130, RFID 3140, GPS 3150, gyroscope 3160 and accelerometer 3170.

The quality 3100 sensor can be used to monitor existing quality of the humidity pack. This allows a user to replace the humidity pack when it is no longer able to control the humidity appropriately and as indicated. The quality 3100 sensor has internal components and takes measurements of the RH to ensure the humidity pack is still effective for its rating. The Bluetooth® 3120 and Wi-Fi 3130 sensors can be used to wirelessly connect the two-way humidity control pack to a portable digital device. This allows remote monitoring and access to the humidity packs.

Also, an activation 3110 sensor and electro-mechanical probe can be used with the Bluetooth® 3120 and/or Wi-Fi 3130 sensor to remotely control the humidity of an individual humidity pack. The activation 3110 sensor can remotely control a membrane to control the passage of water vapor while containing the humidity controlling solution itself within the pack. This will allow the solution to control the humidity inside the package, while protecting the pack from wicking or leaking of the solution. The membrane can either be inherently water vapor-permeable water molecules that pass directly through the material of the membrane. Alternatively, the membrane can be impermeable but microporous with microscopic pores in it to allow water molecules to pass. Any microporous film which can contain the buffering solution and allow the transmission of water vapor in and out of the packet without allowing the solution itself to exit could be used. The activation 3110 sensor can control the surface tension of the humidity buffering solution, the nature of the film, the temperature, and the pressure applied.

The RFID 3140 sensor can be a tag that uses electromagnetic fields to automatically identify and track the two-way humidity control packet. The RFID 3140 tag can contain electronically-stored information. A passive tag can collect energy from a nearby RFID reader's interrogating radio waves. An active RFID 3140 tag can have a local power source (for example a battery) and may operate hundreds of meters from the RFID reader. Unlike a barcode, the RFID 3140 tag need not be within the line of sight of the reader. This allows it to be embedded within the closed container 2020 of FIG. 20.

Protective Container Safety Cap:

Child resistant safety caps are commonly used on prescription medication and dangerous chemicals that can be within the reach of a child. However, many other products, for example smoking products do not typically have child resistant and safety mechanisms to prevent unsuspecting children from accessing the tobacco. In addition, these products usually do not have mechanisms that will track and monitor the opening and closing of a cap that encloses these products and the location of the container 2020 of FIG. 20 containing these products.

It should be noted that the descriptions that follow, for example, in terms of the protective container safety cap 3200, is described for illustrative purposes and the underlying system can apply to any number and multiple types of the smoking materials. In one embodiment of the present invention, the protective container safety cap 3200 can be configured for use with containers that store cigars and smoking products. In another embodiment, the protective container safety cap 3200 with safety cap can be used for medical and legalized cannabis smoking products and other smoking products.

Figure 32:
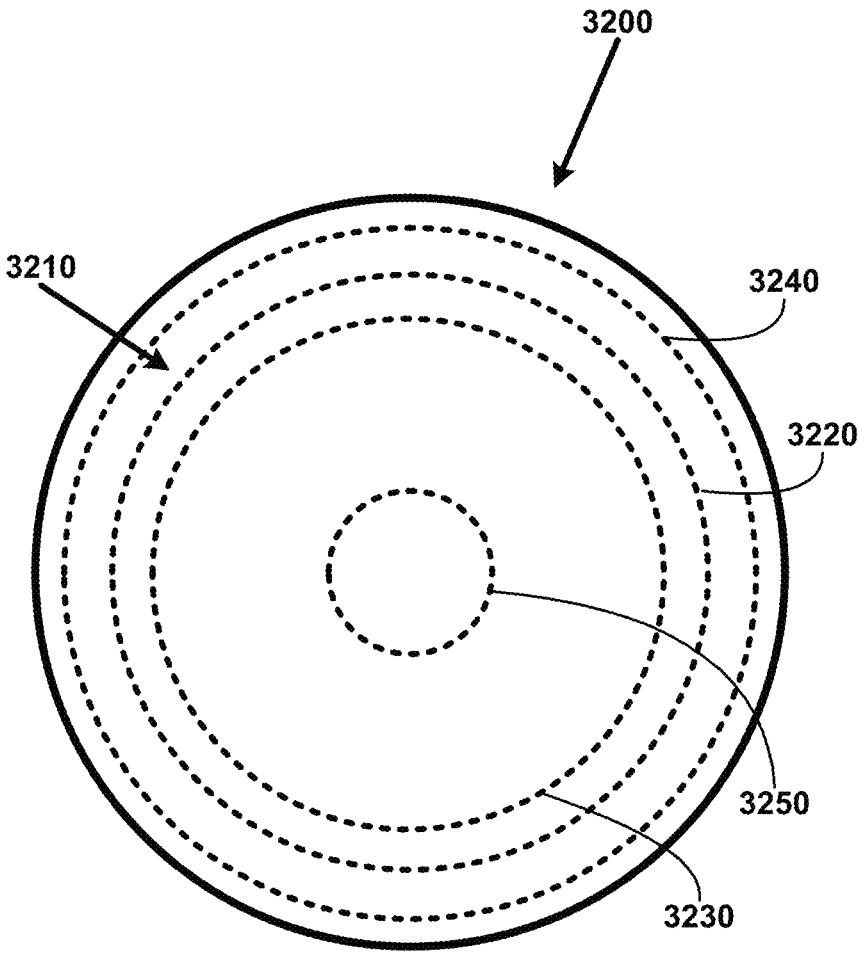
FIG. 32 shows for illustrative purposes only a top view of the protective container safety cap of one embodiment.

FIG. 32 shows for illustrative purposes only a top view of the protective container safety cap of one embodiment. The protective container safety cap 3200 in one embodiment is a screw-on child resistant with a double lined inside coupling 3210. The double lined inside coupling 3210 has an outer wall 3220 and inner wall 3230 and is adhered and connected to inner screw female threads 3240. The protective container safety cap 3200 can be made of any suitable material, for example aluminum or sheet metal.

The double lined inside coupling 3210 includes a crown, a skirt and a bead located at the lower edge of the skirt and coupled with the inner screw female threads 3240 that mate and screws together with male threads of a container 2020 of FIG. 20. The male threads are located around the outside mouth of a container 2020 of FIG. 20 that is used with the protective container safety cap 3200. Electronic sensor 3250 can also be integrated with the protective container safety cap 3200 in one embodiment, which will be discussed in detail below.

The invention accordingly consists in the features of construction, combinations of elements, and arrangements of parts which will be exemplified in the closure hereinafter described and of which the scope of application will be indicated in the appended claims. The products used with the protective container safety cap 3200 can be legalized and medicinal cannabinoid-based smoking products including cannabidiol antioxidant drugs with application as neuroprotectants. The infused cannabinoids can be used for treatment and prophylaxis of a wide variety of oxidation associated diseases, including ischemic, age-related, inflammatory and autoimmune diseases. In one embodiment, the cannabinoids do not include THC, HU-210, HU-211 or any other NMDA receptor antagonist and wherein the cannabinoid is not psychoactive, and is not psychotoxic even at high doses.

Figure 33:
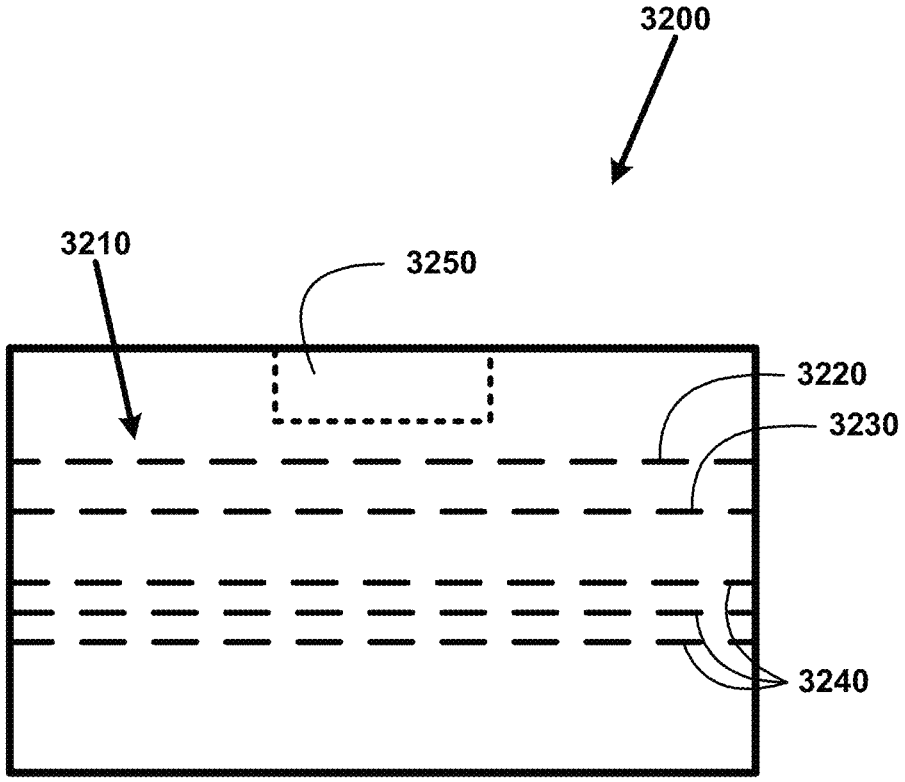
FIG. 33 shows for illustrative purposes only a side view of the protective container safety cap of one embodiment.

Side View of the Protective Container Safety Cap:

FIG. 33 shows for illustrative purposes only a side view of the protective container safety cap of one embodiment. FIG. 33 shows in one embodiment, the protective container safety cap 3200 includes a suitable selectively engageable, normally disengaged, torque transmitting double lined inside coupling 3210. The double lined inside coupling 3210 constitutes a form of irregularity on the crown, or the skirt, or the bead. The protective container safety cap 3200 further includes a component that allows the double lined inside coupling 3210 to be captive. The double lined inside coupling 3210 includes a crown, a skirt and an inwardly directed flange on the lower edge of the skirt. The double lined inside coupling 3210 has formed on its interior the other half of the selectively engageable, normally disengaged, torque transmitting features.

The structures and features of the double lined inside coupling 3210 are such that in a normal condition the inner wall 3230 and the outer wall 3220 of the double lined inside coupling 3210 are disengaged from each other so that the protective container safety cap 3200 turns and twists. The twisting motion is not transmitted to the inner wall 3230, thus preventing the opening of the protective container safety cap 3200 by a child. This is the case when a predetermined pressure that a typical child cannot provide is not applied, thereby preventing engagement of the outer wall 3220 with the inner wall 3230 and opening of protective container safety cap 3200 of one embodiment.

Figure 34:
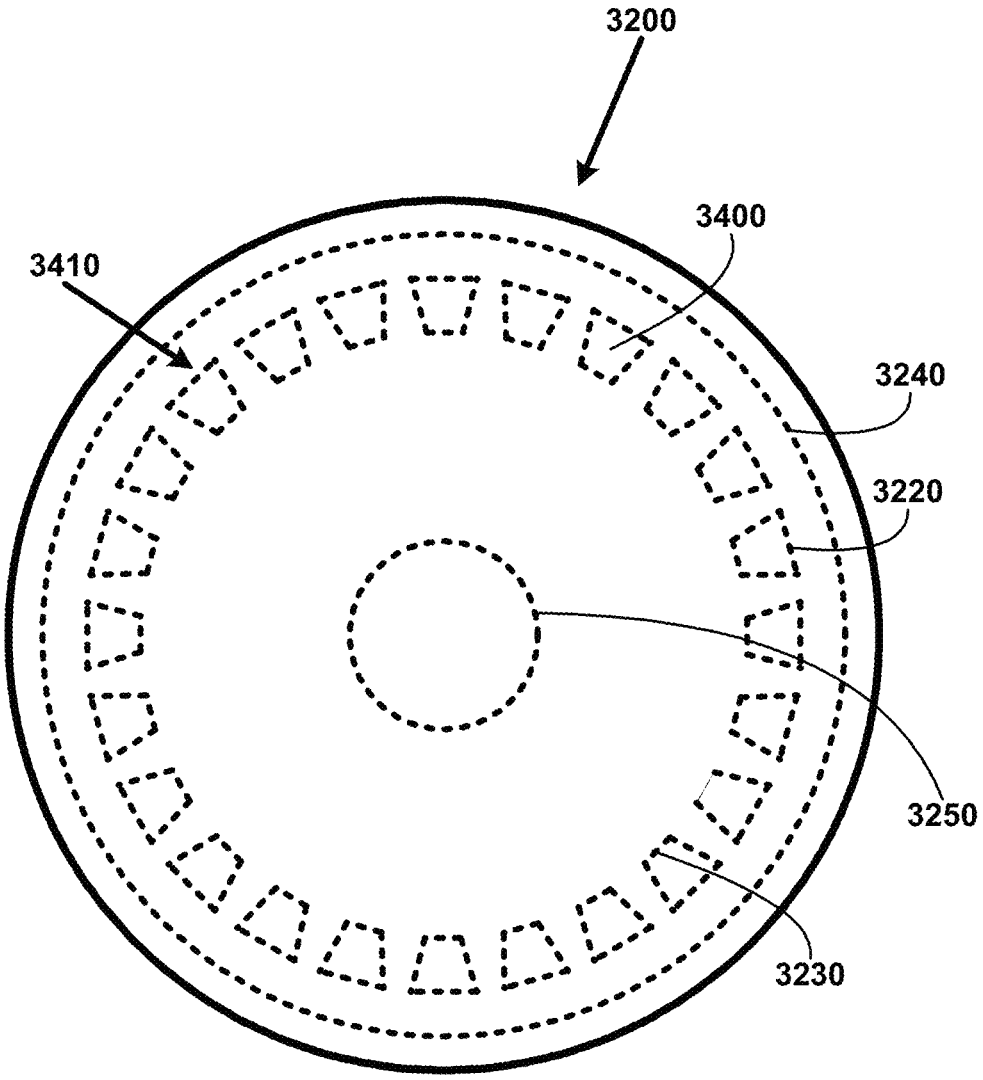
FIG. 34 shows for illustrative purposes only a top view of the protective container safety cap of one embodiment.

Top View of the Protective Container Safety Cap:

FIG. 34 shows for illustrative purposes only a top view of the protective container safety cap of one embodiment. FIG. 34 shows the protective container safety cap 3200 with a tab and lock system. In one embodiment, the protective container safety cap 3200 is used as a child resistant closure for a medicinal cannabis container 2020 of FIG. 20. The protective container safety cap 3200 of one embodiment uses a torque transmitting coupling 3400. The torque transmitting coupling 3400 allows the user to transmit force to the inner wall 3230 with a twisting force applied to the outer wall 3220. The torque transmitting coupling 3400 includes a first half, preferably plastic, and a second half, which is also preferably plastic. The first half is part of the outer cover and the second half is part of the inner cap.

In one embodiment, the torque transmitting coupling 3400 includes geometrically shaped features, for example a pattern of irregularities on the undersurface of the outer wall 3220 and matching irregularities on the outer surface of the inner wall 3230. In another embodiment, the torque transmitting coupling 3400 includes plural irregularities that include a series of driving components between the inner wall 3230 and the inner surface of the skirt of the cover. The driving components are configured to cooperate with matching indentations in the inner wall 3230 and the outer wall 3220 of the skirt of the double lined inside coupling 3210.

The matching irregularities on the inner wall 3230 and the outer wall 3220 of the protective container safety cap 3200 are disengaged in one position or, if engaged, are not operatively engaged. In this case, the matching irregularities slide out of engagement when torque is applied to the outer cover. Normal disengagement is affected by a suitable structure of the double lined inside coupling 3210 and protective container safety cap 3200. In one embodiment, when the protective container safety cap 3200 has a central downward tab on the inner wall 3230, this allows engagement of the crown of the protective container safety cap 3200 to keep the cover elevated. This allows, due to the resilience of the double lined inside coupling 3210, the double lined inside coupling 3210 to be forced down to cause the outer wall 3220 and the inner wall 3230 of the torque transmitting coupling 3400 to be operatively engaged of one embodiment.

Figure 35:
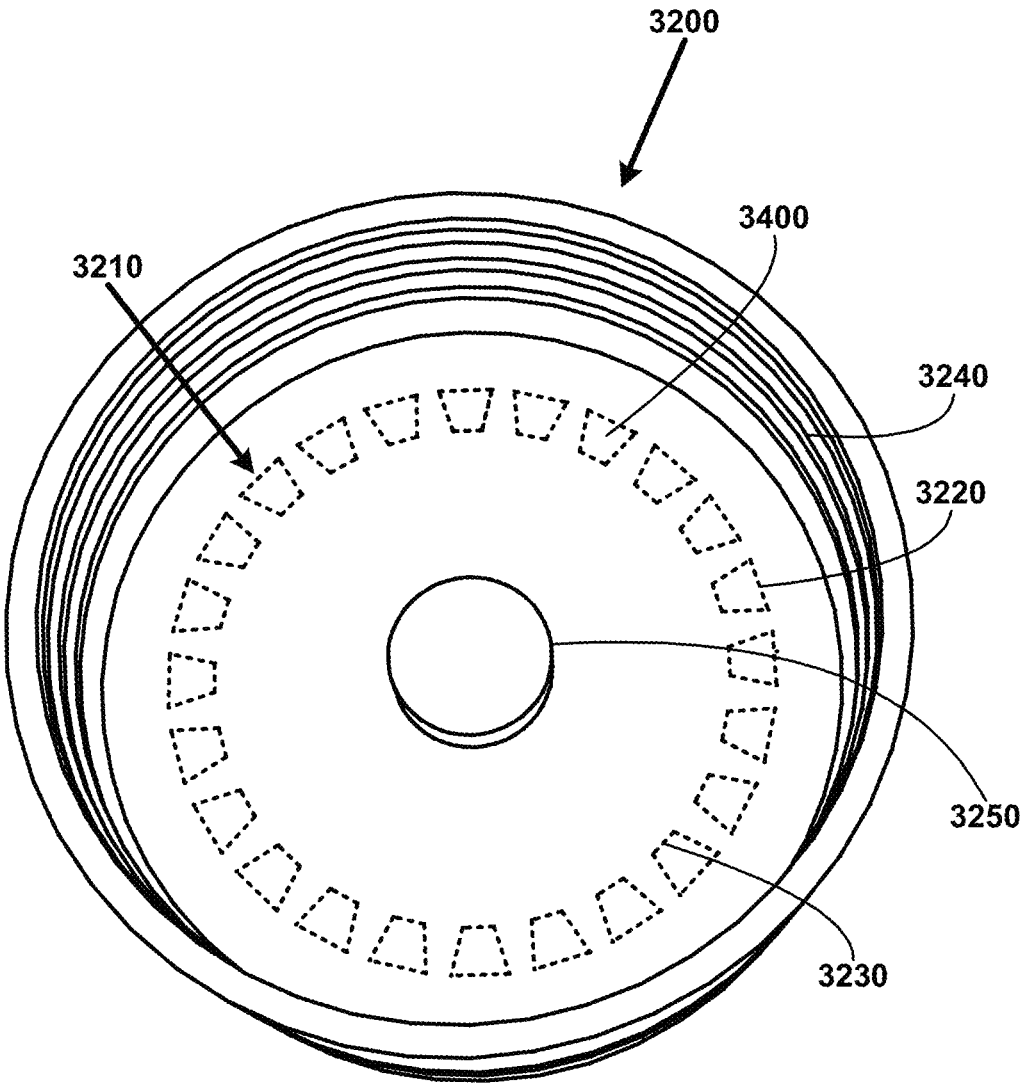
FIG. 35 shows for illustrative purposes only an inside view of the protective container safety cap of one embodiment.

Inside View of the Protective Container Safety Cap:

FIG. 35 shows for illustrative purposes only an inside view of the protective container safety cap of one embodiment. FIG. 35 shows a tab and lock system with a plastic insert of one embodiment. FIG. 35 shows the Electronic sensor 3250 coupled to the protective container safety cap 3200 and inner screw female threads 3240. In another embodiment, the outer wall 3220 and the inner wall 3230 act as two halves and are maintained with the torque transmitting coupling 3400 normally disengaged to provide matching irregularities on the inner surface of the skirt of the double lined inside coupling 3210 and the outer wall 3220 of the skirt of the inner wall 3230. The double lined inside coupling 3210 and the irregularities the torque transmitting coupling 3400 to freely turn on the inner wall 3230 unless the torque transmitting coupling 3400 is constricted by squeezing the skirt. This allows the torque transmitting coupling 3400 to be sufficiently flexible to allow enablement of the skirt to be deflected inwardly enough to create an engagement between the irregularities on the torque transmitting coupling 3400 and on the protective container safety cap 3200. This allows torque to be transmitted and engagement of one embodiment.

Inside View of the Protective Container Safety Cap:

FIG. 35 shows for illustrative purposes only an inside view of the protective container safety cap of one embodiment. FIG. 35 shows a tab and lock system with a plastic insert of one embodiment. FIG. 35 shows the Electronic sensor 3250 coupled to the protective container safety cap 3200 and inner screw female threads 3240. In another embodiment, the outer wall 3220 and the inner wall 3230 act as two halves and are maintained with the torque transmitting coupling 3400 normally disengaged to provide matching irregularities on the inner surface of the skirt of the double lined inside coupling 3210 and the outer wall 3220 of the skirt of the inner wall 3230. The double lined inside coupling 3210 and the irregularities the torque transmitting coupling 3400 to freely turn on the inner wall 3230 unless the torque transmitting coupling 3400 is constricted by squeezing the skirt. This allows the torque transmitting coupling 3400 to be sufficiently flexible to allow enablement of the skirt to be deflected inwardly enough to create an engagement between the irregularities on the torque transmitting coupling 3400 and on the protective container safety cap 3200. This allows torque to be transmitted and engagement of one embodiment.

Figure 36:
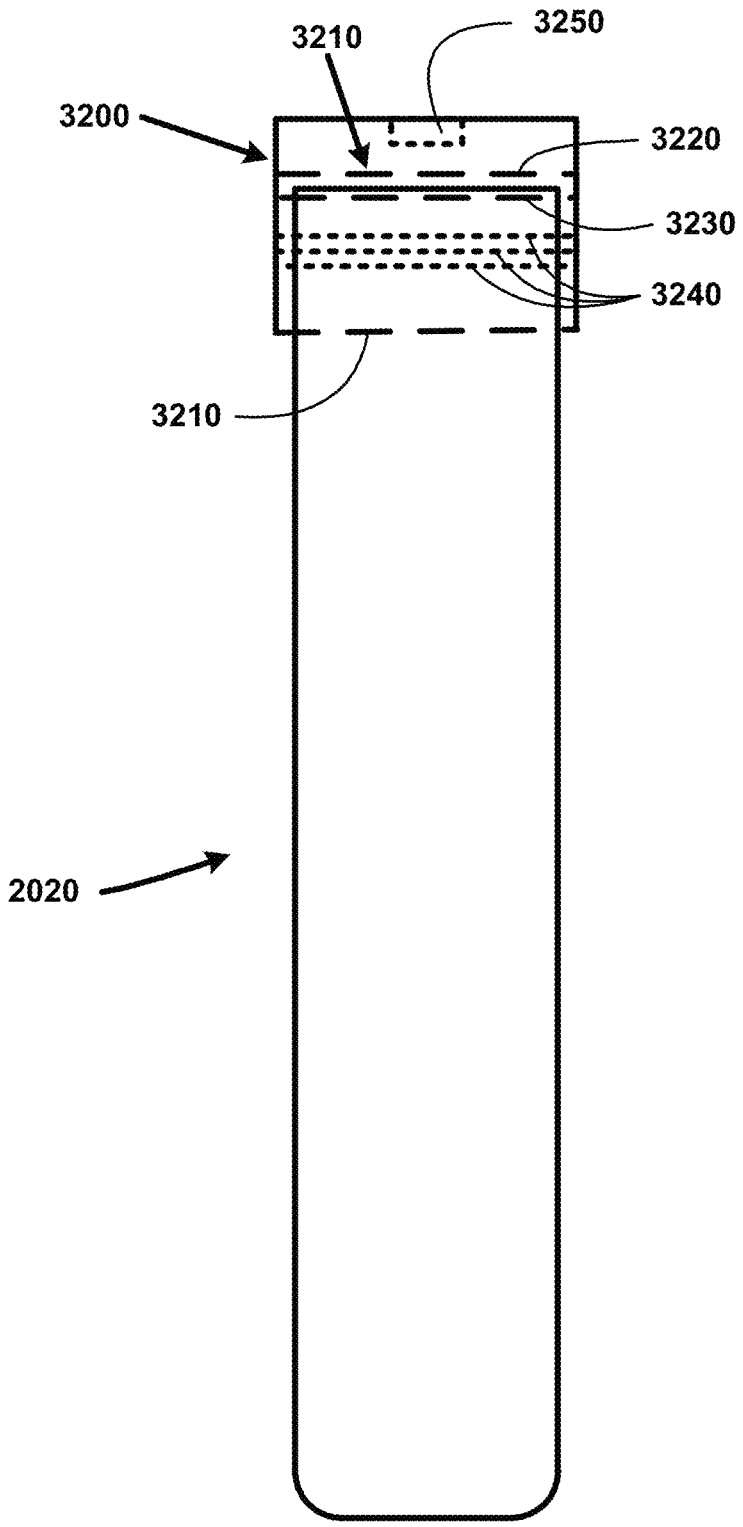
FIG. 36 shows for illustrative purposes only the protective container safety cap of one embodiment.

Protective Container Safety Cap:

FIG. 36 shows for illustrative purposes only the protective container safety cap of one embodiment. FIG. 36 shows the protective container safety cap 3200 used for capping a tobacco product container 2020. In one embodiment of the present invention, the protective container safety cap 3200 can be configured for use with containers that store cigars and smoking products. In another embodiment, the protective container safety cap 3200 can be used for smoking materials including for example medical and legalized cannabis smoking products to prevent small children from accessing the container 2020. The protective container safety cap 3200 also includes electronic sensors 3250 and electronic devices within the protective container safety cap 3200.

In another embodiment, the electronic sensors 3250 and electronic devices of the protective container safety cap 3200 includes an RFID chip and/or a GPS semiconductor chip to locate and track the matchstick and pick combination device 1900 of FIG. 19. In one embodiment, the electronic sensors 3250 and electronic devices include a heat and humidity sensory to detect and monitor the humidity and heat of the tobacco product the matchstick and pick combination device 1900 of FIG. 19 is embedded within. The electronic sensors 3250 and electronic devices can be wirelessly connected to an external computing device and a software application via any suitable wireless connection, for example Wi-Fi and/or Bluetooth®.

In addition, the protective container safety cap 3200 can be used for medicinal cannabis and/or prescription cannabis for tracking patient use of the medications to assist in medication treatment to monitor their progress toward recovery or health maintenance. The protective container safety cap 3200 can be used with a container 2020 that includes a text section with prescription and/or cannabis medicinal information, a smart label programmable memory device, one or more rechargeable battery systems, other digital devices and Wi-Fi direct near field communication transmitter used to transmit patient prescription use of one embodiment.

The protective container safety cap 3200 in one embodiment can be a smart label safety cap 3705 that includes one or more digital electronic systems to remind patients of usage times and dosages. The smart label safety cap 3705 can be configured for coupling a prescription smart label 3708 to be coupled to the container 2020 and including one or more systems used to monitor the physical use of the patient prescription medication and monitor the contents of the container. The protective container safety cap 3200 can be connected to a mobile application for gathering, recording, storing and transmitting patient use data of one embodiment.

Figure 37:
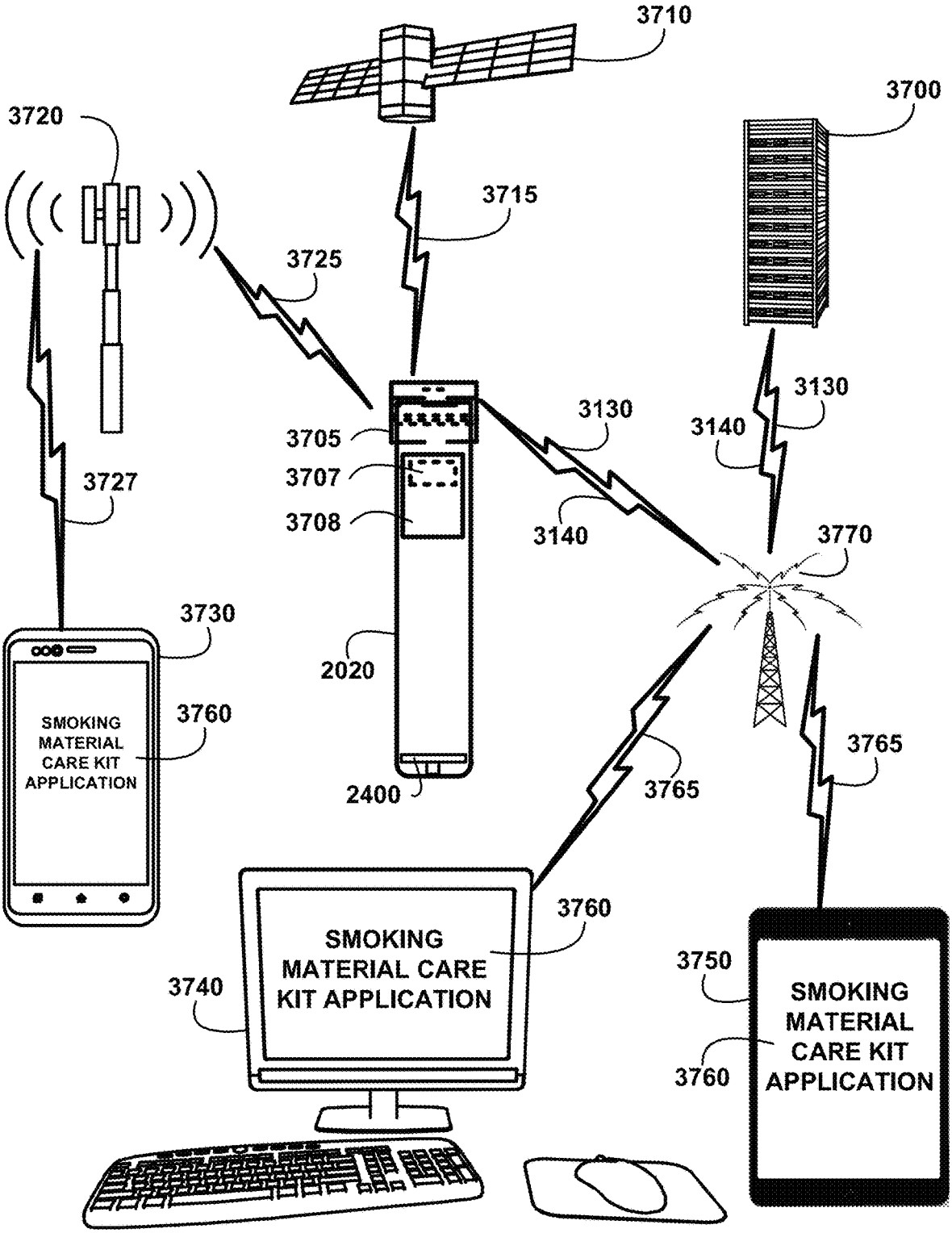
FIG. 37 shows for illustrative purposes only a smoking material care kit application of one embodiment.

Smoking Material Care Kit Application:

FIG. 37 shows for illustrative purposes only a smoking material care kit application of one embodiment. FIG. 37 shows the protective container safety cap 1300 coupled to the two-way humidity control pack 2400. The two-way humidity control pack 2400 includes electronic sensors and devices including Bluetooth® 3120, Wi-Fi 3130, RFID 3140, and GPS 3150. The protective container safety cap 3200 can be connected to a smoking material care kit application 3760 for gathering, recording, storing and transmitting of usage data including patient use data of a patient prescription medication kept in the two-way humidity control pack 2400 and monitor the contents of the two-way humidity control pack 2400 container 2020. A prescription smart label 3708 coupled to the two-way humidity control pack 2400 container 2020 includes electronic devices to determine a mass of the contents and the frequency of opening 3707 the two-way humidity control pack 2400 container 2020. For example a proximity sensor can measure a distance the protective container safety cap 3200 from the prescription smart label 3708 and when that distance exceeds a predetermined distance it is deemed an opening of the container 2020. For example sonic frequency emitter and receiver can emit a sound that will bounce from the top of the smoking material inside the container 2020. A time period is determined when the sonic frequency bounce is received. The longer the time period the lower the level of smoking materials is within the container 2020 and a change in the time period can be used to determine the change in smoking material level and therefore the change in the mass of smoking materials in the container of one embodiment.

The usage data is transmitted by the Bluetooth® 3120, Wi-Fi 3130 and RFID 3140. The location of the two-way humidity control pack 2400 container 2020 is captured using GPS 3150 from a satellite GPS signal 3710 and is transmitted with the usage data to a smoking material care kit server 3700. The user can review the usage data and GPS location from a WI-FI transmission 1230 from a WI-FI tower 3770 using a smart phone with the smoking material care kit application installed 3730 and from a cellular communication tower 3720 Bluetooth® 3120 transmission and a WI-FI transmission from the smoking material care kit server 3700. A user can retrieve the information using a computer with smoking material care kit application installed 3740 and using a tablet with smoking material care kit application installed 3750 via a WI-FI transmission from the smoking material care kit server 3700 of one embodiment.

Figure 38A:
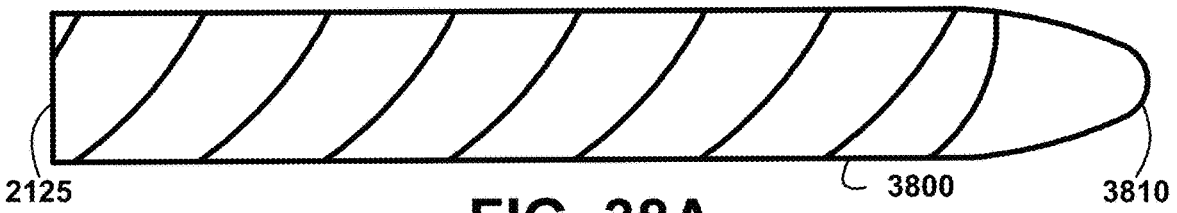
FIG. 38A shows for illustrative purposes only an example of uncut blunt rolled smoking product of one embodiment.

Uncut Blunt Rolled Smoking Product:

FIG. 38A shows for illustrative purposes only an example of uncut blunt rolled smoking product of one embodiment. FIG. 38A shows a blunt rolled smoking product 3800 including a cigar. The blunt rolled smoking product 3800 includes an uncut blunt end 3810 at one end and the ignition location 2125 at the other end.

Figure 38B:
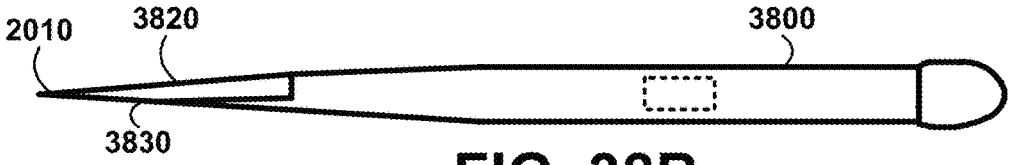
FIG. 38B shows for illustrative purposes only an example of matchstick and pick combination device sharpened edge of one embodiment.

Matchstick and Pick Combination Device Sharpened Edge:

FIG. 38B shows for illustrative purposes only an example of matchstick and pick combination device sharpened edge of one embodiment. FIG. 38B shows the matchstick and pick combination device 1900 distal end 1930 shaped in the pick 2010. The distal end 1930 in one embodiment includes a sharpened edge 3820 along one side in a section leading to the pick 2010 of one embodiment.

Figure 38C:
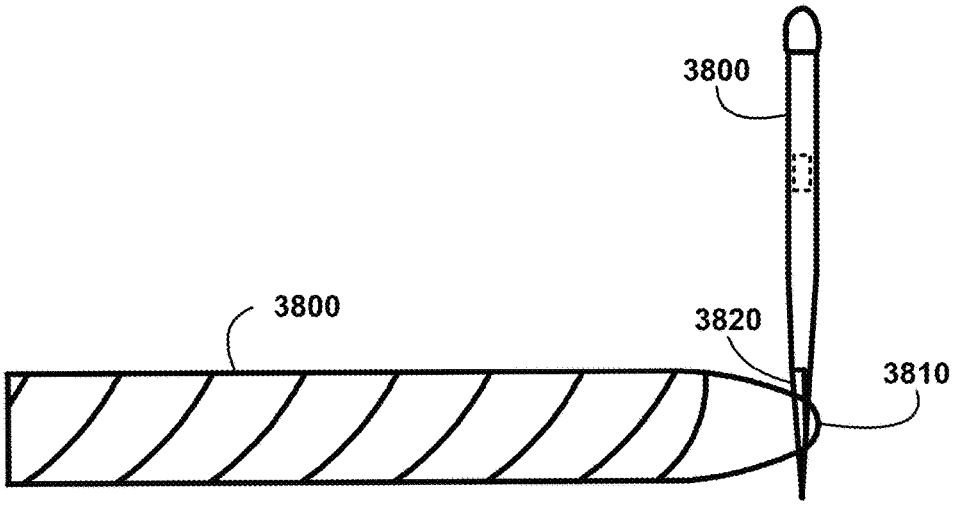
FIG. 38C shows for illustrative purposes only an example of cutting a blunt rolled smoking product of one embodiment.

Cutting a Blunt Rolled Smoking Product:

FIG. 38C shows for illustrative purposes only an example of cutting a blunt rolled smoking product of one embodiment. FIG. 38C shows the matchstick and pick combination device 1900 sharpened edge 3820 being used to cut the uncut blunt end 3810 of the blunt rolled smoking product 3800 of one embodiment.

Figure 38D:
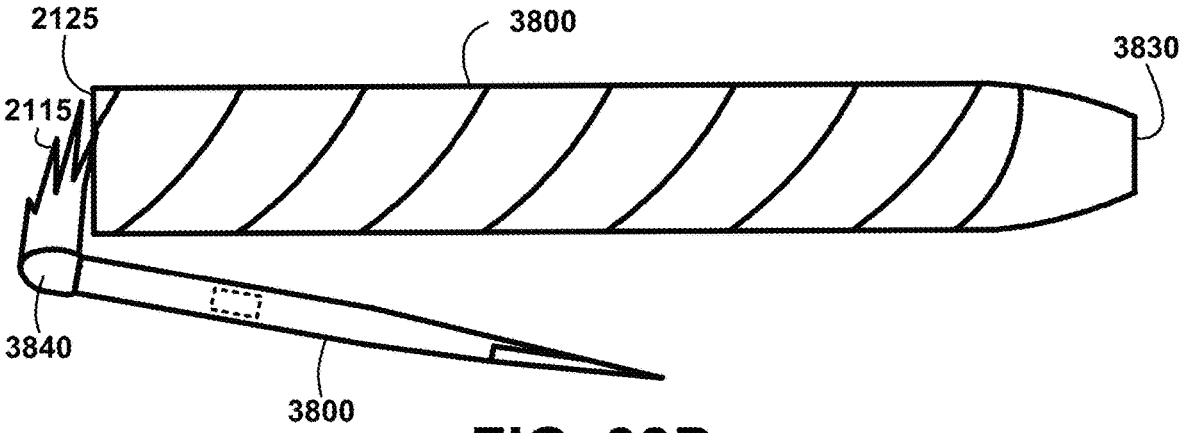
FIG. 38D shows for illustrative purposes only an example of igniting a cut blunt rolled smoking product of one embodiment.

Igniting a Cut Blunt Rolled Smoking Product:

FIG. 38D shows for illustrative purposes only an example of igniting a cut blunt rolled smoking product of one embodiment. FIG. 38D shows the matchstick and pick combination device 1900 ignition section 1940 with the flame 2115 in proximity of the ignition location 2125 of the blunt rolled smoking product 3800. The flame 2115 is drawn into the ignition location 2125 to ignite the smoking material as a smoker inhales through the cut blunt end 3830 of one embodiment.

Figure 39A:
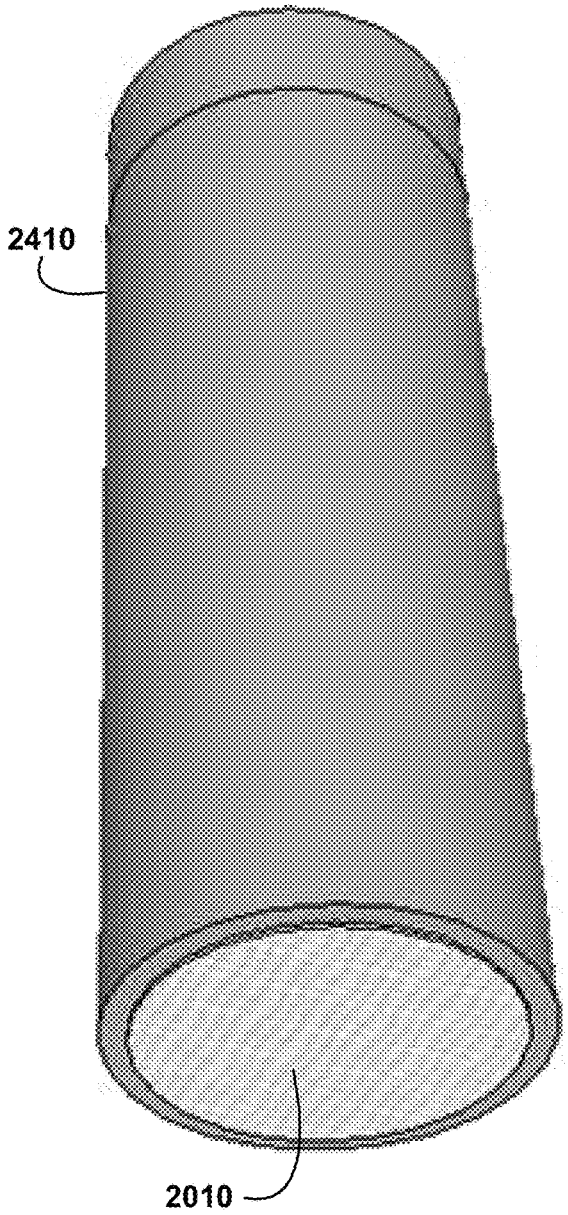
FIG. 39A shows for illustrative purposes only an example of a built-in bottom striking section of one embodiment.

Built-In Bottom Striking Section:

FIG. 39A shows for illustrative purposes only an example of a built-in bottom striking section of one embodiment. FIG. 39A shows the cylindrical container 2410 used to store smoking materials. The cylindrical container 2410 includes a built-in bottom striking section 3910 for use in striking the ignition section 1940 of FIG. 19 of the matchstick and pick combination device 1900 of FIG. 19 of one embodiment.

Figure 39B:
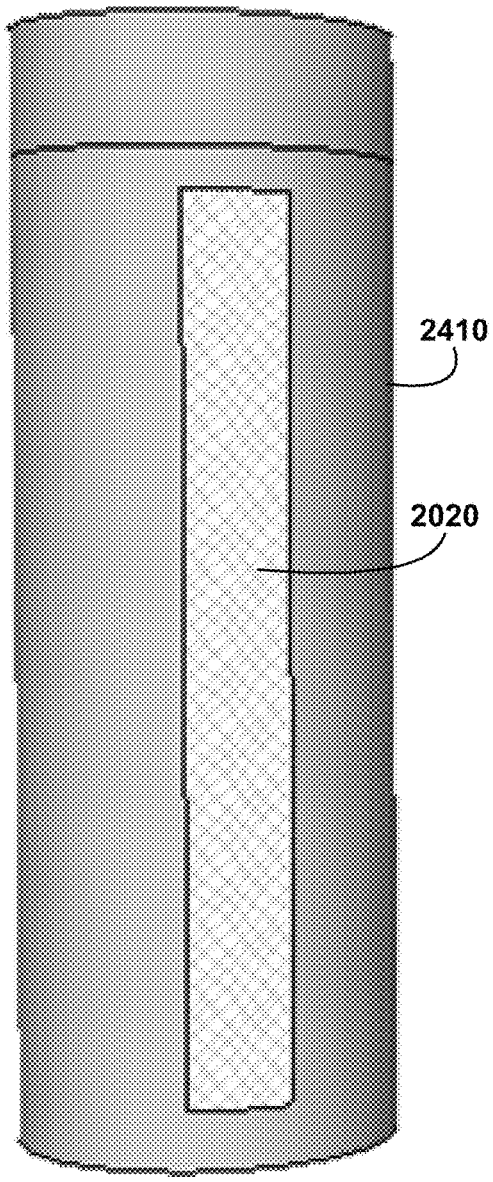
FIG. 39B shows for illustrative purposes only an example of a built-in sidewall striking section of one embodiment.

Built-In Sidewall Striking Section:

FIG. 39B shows for illustrative purposes only an example of a built-in sidewall striking section of one embodiment. FIG. 39B shows the cylindrical container 2410 including a built-in sidewall striking section 3920 for use in striking the ignition section 1940 of FIG. 19 of the matchstick and pick combination device 1900 of FIG. 19 of one embodiment.

Figure 40B:
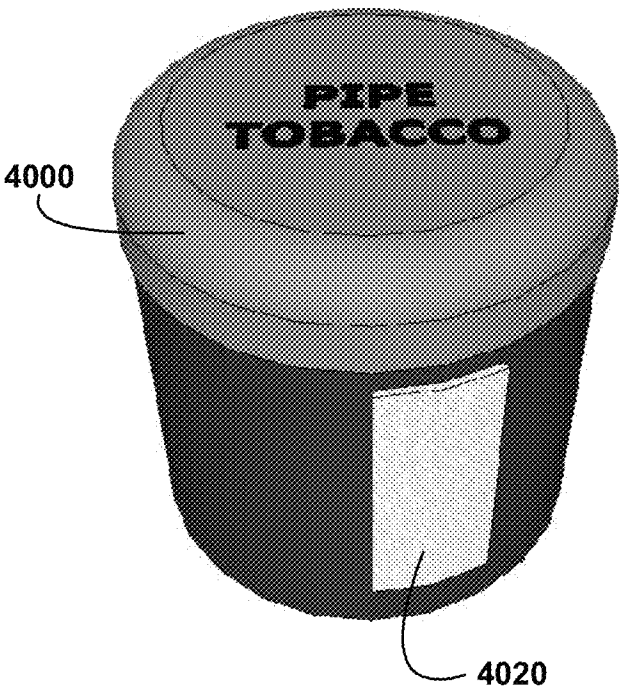
FIG. 40B shows for illustrative purposes only an example of an attached self-adhering striking section of one embodiment.
Figure 40A:
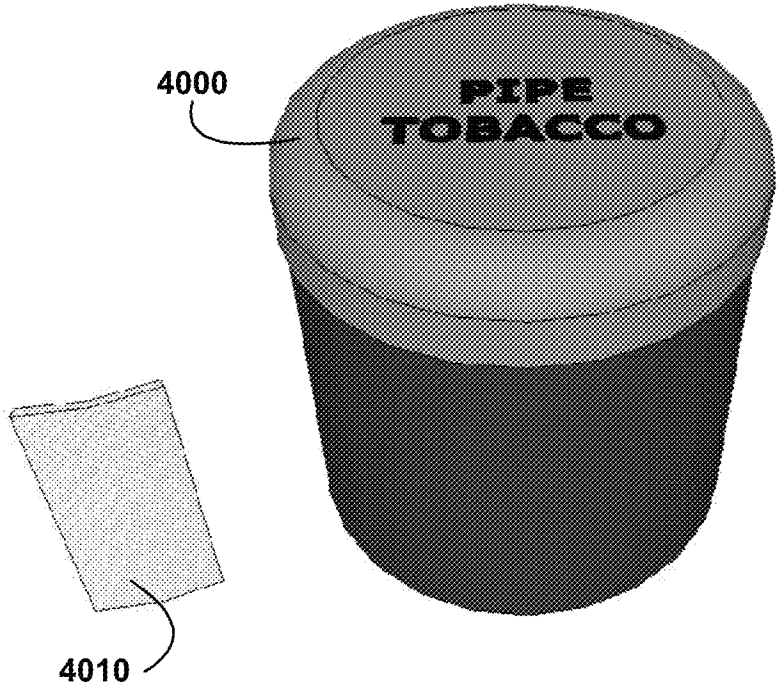
FIG. 40A shows for illustrative purposes only an example of a detached self-adhering striking section of one embodiment.

Detached Self-Adhering Striking Section:

FIG. 40A shows for illustrative purposes only an example of a detached self-adhering striking section of one embodiment. FIG. 40A shows a pipe tobacco canister 4000 which is a container 2410 of FIG. 24 of a smoking material for example pipe tobacco. FIG. 40A also shows a detached self-adhering striking section 4010 wherein the self-adhering material is use to attach the detached self-adhering striking section 4010 to the pipe tobacco canister 4000 of one embodiment.

Attached Self-Adhering Striking Section:

FIG. 40B shows for illustrative purposes only an example of an attached self-adhering striking section of one embodiment. FIG. 40B shows an attached self-adhering striking section 4020 wherein the detached self-adhering striking section 4010 of FIG. 40A has been coupled to the pipe tobacco canister 4000 using the self-adhesive material of the attached self-adhering striking section 4020 to bond the attached self-adhering striking section 4020. The attached self-adhering striking section 4020 provides a suitable surface for striking the ignition section 1940 of FIG. 19 against the attached self-adhering striking section 4020 to create frictional heat to ignite the ignition section 1940 of FIG. 19. The attached self-adhering striking section 4020 provides on any container a surface on which to ignite the smoking material of one embodiment.

Figure 41:
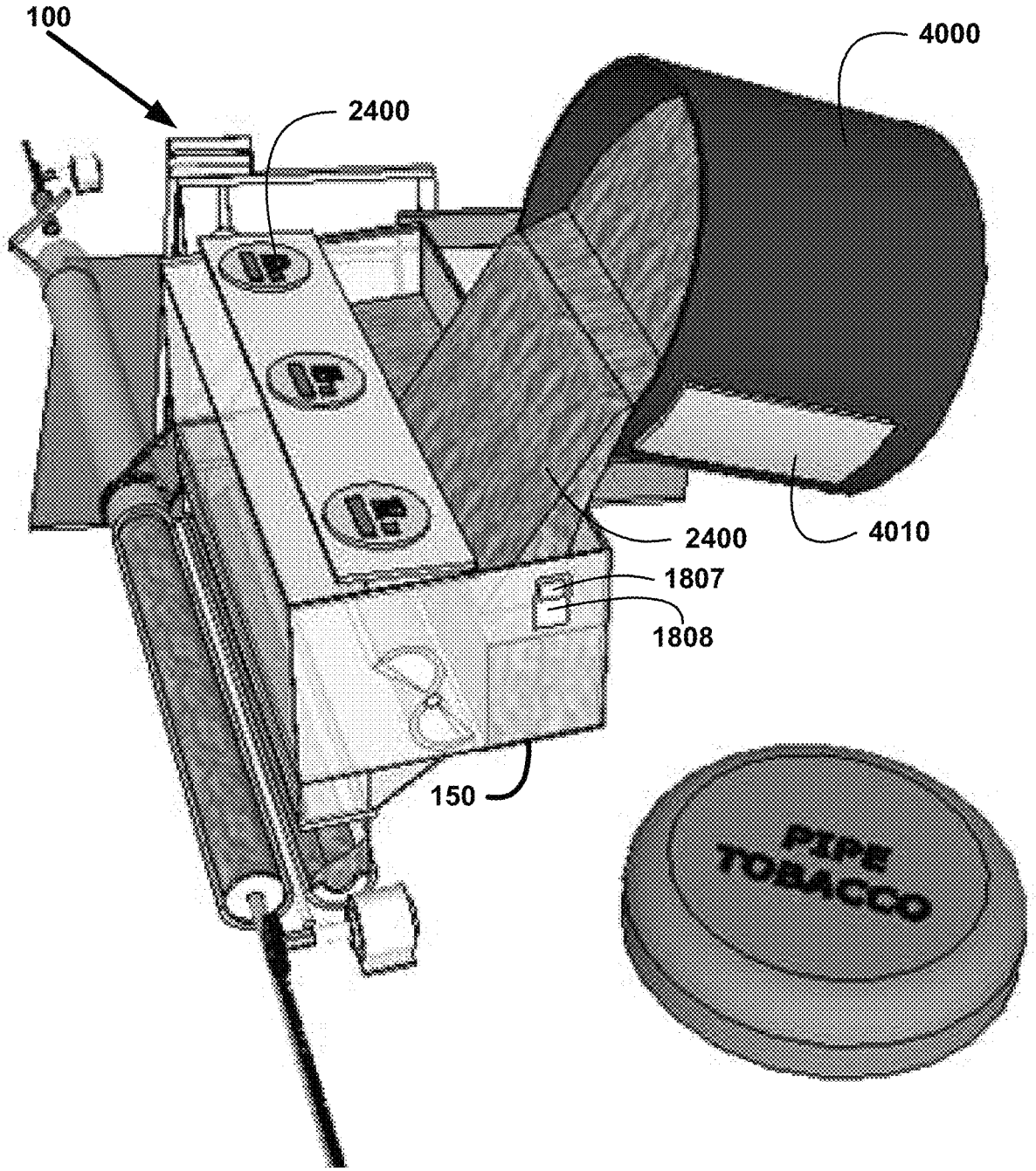
FIG. 41 shows for illustrative purposes only an example of refilling a humidor from a container of one embodiment.

Refilling a Humidor from a Container:

FIG. 41 shows for illustrative purposes only an example of refilling a humidor from a container of one embodiment. FIG. 41 shows the blunt rolling device 100 with the humidor supply dispenser 150. The level of the smoking material is down and additional smoking material is being added from a smoking material container for example the pipe tobacco canister 4100 which is a container 2410 of FIG. 24. The pipe tobacco canister 4100 includes the two-way humidity control pack 500 adhered to the lid or cap. In this example three (3) of the two-way humidity control pack 2400 are adhered to the lid of the humidor supply dispenser 150. The prescription smart label 1808 is attached to the humidor supply dispenser 150. The two-way humidity control pack 2400 adhered to the lid will maintain the humidity of the freshly added smoking material.

The prescription smart label 1808 will track the use of the smoking material in the humidor supply dispenser 150 and can measure the frequency of rolling blunts of one embodiment. A prescription smart label 3708 coupled to the two-way humidity control pack 2400 coupled to the humidor supply dispenser 150 includes electronic devices to determine a mass of the contents and the frequency of rolling a blunt. For example a motion detector can detect when the smoking material is loaded for filling the rolled wrapper layer 1430.

The prescription smart label 3708 can record the date and time when a smoking material is loaded for filling the rolled wrapper layer 1430 to determine the frequency of use. For example a sonic frequency emitter and receiver can emit a sound that will bounce from the top of the smoking material inside the humidor supply dispenser 150. A time period is determined when the sonic frequency bounce is received. The longer the time period the lower the level of smoking materials is within the container 2020 and a change in the time period can be used to determine the change in smoking material level and therefore the change in the mass of smoking materials in the container of one embodiment.

Figure 42A:
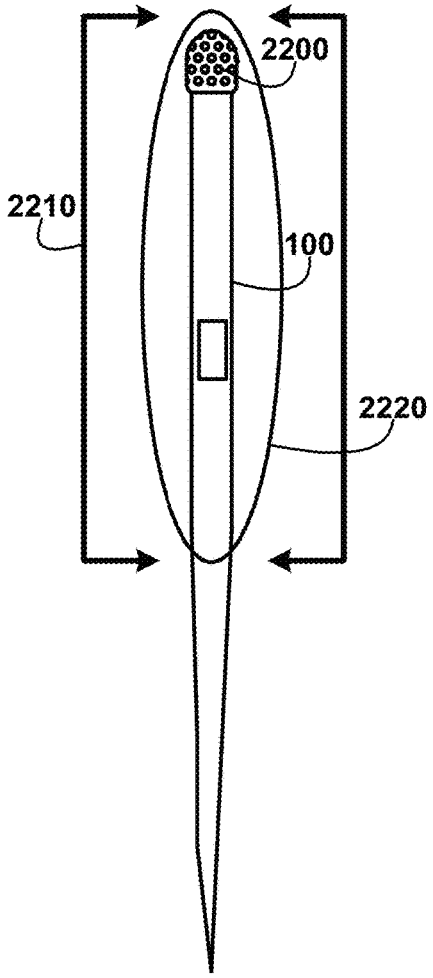
FIG. 42A shows for illustrative purposes only an example of a perforated ignition section of one embodiment.

Perforated Ignition Section:

FIG. 42A shows for illustrative purposes only an example of a perforated ignition section of one embodiment. FIG. 42A shows in one embodiment a perforated ignition section 4200 of the matchstick and pick combination device 1900. A cross section indicator 4210 shows the section of the matchstick and pick combination device 1900 shown in detail "A" section 4220 of one embodiment.

Figure 42B:
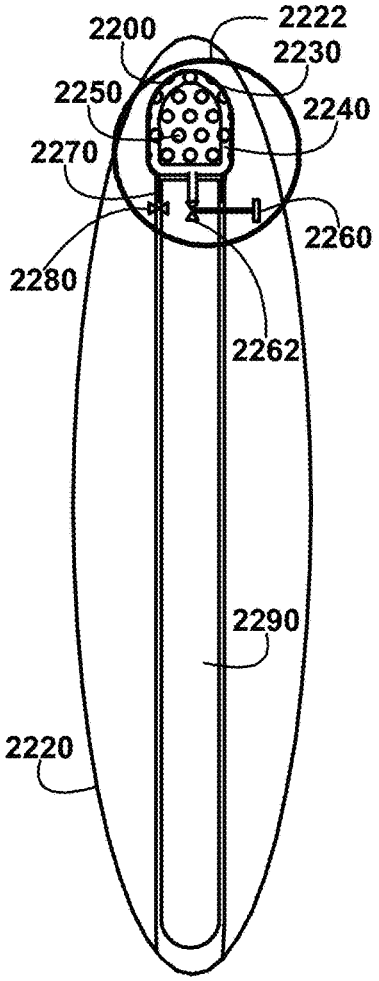
FIG. 42B shows for illustrative purposes only an example of a fuel supply cavity of one embodiment.

Fuel Supply Cavity:

FIG. 42B shows for illustrative purposes only an example of a fuel supply cavity of one embodiment. FIG. 42B shows the detail "A" section 4220 and a detail "B" section 4222. The detail "A" section 4220 shows the perforated ignition section 4200 including a perforated ignition section threaded coupling 4270 used for coupling the perforated ignition section 4200 module to the elongated section 110 of FIG. 1 of the matchstick and pick combination device 100 of FIG. 1. The perforated ignition section 4200 includes an ignition section striking structure 4230, a fuel feed chamber 4240, a fuel volume regulator, a release valve activator 4260, fuel release valve 4262 and a plurality of a fuel feed orifice 4250. The elongated section 110 of FIG. 1 includes a fuel fill valve 4280 and a fuel supply cavity 4290.

In this example is one embodiment of a fuel burning matchstick and pick combination device 100 of FIG. 1. The fuel burning matchstick and pick combination device 100 of FIG. 1 can include storing and burning a fuel including butane. The fuel burning matchstick and pick combination device 100 of FIG. 1 can be ignited multiple times as the fuel supply permits. Additionally the fuel supply can be refilled using the fuel fill valve 4280 for injecting from an external supply the fuel into the fuel supply cavity 4290. The perforated ignition section 4200 can be made of a suitable striking material including for example steel and used for striking against a suitable surface including for example an attached self-adhering striking section 2120 of FIG. 21B that include a suitable material including for example flint of one embodiment.

Figure 42C:
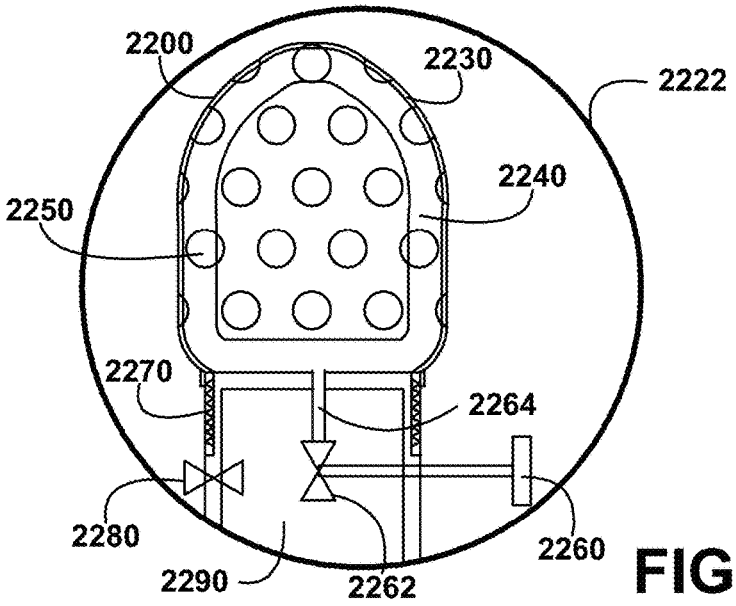
FIG. 42C shows for illustrative purposes only an example of a fuel feed orifice of one embodiment.

Fuel Feed Orifice:

FIG. 42C shows for illustrative purposes only an example of a fuel feed orifice of one embodiment. FIG. 42C shows the detail "B" section 4222. Showing is the fuel fill valve 4280 coupled to the fuel supply cavity 4290. The fuel volume regulator and release valve activator 4260 is twisted to regulate the volume of fuel to be released from the fuel supply cavity 4290. The fuel volume regulator and release valve activator 4260 is pushed into the fuel release valve 4262 to open the valve and release fuel through the fuel feed tube 4264 into the fuel feed chamber 4240. In the fuel feed chamber 4240 the fuel vaporizes into a gas and mixes with ambient air. The ignition section striking structure 4230 is struck on a suitable surface to create a spark from frictional heat generated and ignites the fuel gas and air mixture passing through the plurality of the fuel feed orifice 4250 openings. The ignited perforated ignition section 4200 can then be used to ignite a smoking material.

The perforated ignition section 4200 can in various embodiments include one or more different sized fuel feed orifice 4250 for use with different fuels for example butane, propane, typical lighter fluid and others. The perforated ignition section 4200 can be coupled to the elongated section 110 of FIG. 1 of the matchstick and pick combination device 100 of FIG. 1 using the perforated ignition section threaded coupling 4270. The user can change the perforated ignition section 4200 for a different fuel to be used and changed due to normal wear and tear or damage of one embodiment.

The foregoing has described the principles, embodiments and modes of operation of the embodiments. However, the embodiments should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. An apparatus, comprising:

a smoking material care kit;

a matchstick and pick combination device for igniting smoking materials;

a two-way humidity control pack device for controlling humidity of a smoking material stored in a smoking material protective container;

a plurality of sensors and electronic devices including a digital numerical relative humidity rating display, a humidity sensor, a micro dehumidifier, a micro humidifier, a digital processor, a flexible wireless rechargeable battery and a near-field communication device coupled to the two-way humidity control pack device and configured for the digital processor to receive a humidity level detected by the humidity sensor and transmit the humidity level to the digital numerical RH ratings display using the near-field communication device and is configured for the micro dehumidifier to extract moisture from air inside a smoking material protective container and store extracted moisture in a storage vessel coupled to the smoking material protective container to lower the humidity level to a predetermined range and is configured for the micro humidifier to release stored extracted moisture to add moisture to the air inside the smoking material protective container to raise a detected humidity level to a predetermined range;

a matchstick and pick combination device including a fuel supply cavity, fuel fill valve, perforated ignition section, perforated ignition section threaded coupling configured for coupling the perforated ignition section module to an elongated section, an ignition section striking structure, fuel feed chamber, fuel volume regulator, release valve activator, fuel release valve, fuel feed tube and a plurality of a fuel feed orifice configured to create a fuel burning matchstick and pick combination device;

a smart label safety cap including a prescription smart label electronically coupled to the two-way humidity control pack device, wireless connectivity to a smoking material care kit server and two-way humidity control pack device sensors and electronic devices wherein the smoking material care kit server is configured for receiving a satellite GPS signal location of the two-way humidity control pack device and user usage data gathered using the two-way humidity control pack device sensors and electronic devices and transmitting the satellite GPS signal location and user usage data to a user for location tracking and tracking patient use of medicinal cannabis and prescription cannabis to assist in medication treatment to monitor a user progress toward recovery or health maintenance; and a protective container safety cap device coupled to the protective container to prevent access to smoking materials inside the protective container by children.

2. The apparatus of claim 1, wherein the matchstick and pick combination device includes an elongated device having a proximal end and a distal end, an ignition section located at a tip of the proximal end, and a pick located at the tip of the distal end.

3. The apparatus of claim 1, wherein the matchstick and pick combination device includes an ignition section configured for igniting tobacco located in a tobacco repository of a smoking pipe and for igniting other smoking materials including blunt rolled smoking products including cigars.

4. The apparatus of claim 1, wherein the matchstick and pick combination device pick is configured for cleaning a tobacco repository of a smoking pipe to remove combusted materials and unwanted debris from the tobacco repository and cleaning a glass tip of a rolled blunt.

5. The apparatus of claim 1, further comprising a sharpened edge at a distal end configured for cutting a blunt end of a blunt rolled smoking product.

6. The apparatus of claim 1, wherein the two-way humidity control pack device can be configured in multiple shapes including circular, square, rectangular, oval, a substantially curved shape, an octagonal shape and other shapes.

7. The apparatus of claim 1, further comprising sensors and electronic devices including relative humidity quality, activation, Bluetooth®, Wi-Fi, RFID, GPS, gyroscope and accelerometer devices coupled to the two-way humidity control pack device and configured for creating connectivity to a digital device with a smoking material care kit application installed.

* * * * *